US011739521B2

(12) United States Patent
Lim

(10) Patent No.: US 11,739,521 B2
(45) Date of Patent: Aug. 29, 2023

(54) BUILDING SYSTEM

(71) Applicant: NXT IP PTY LTD., Perth (AU)

(72) Inventor: Matakii O'Goshi Lim, Perth (AU)

(73) Assignee: NXT BUILDING SYSTEM PTY LTD, Canning Vale (AU)

( * ) Notice: Subject to any disclaimer, the term of this patent is extended or adjusted under 35 U.S.C. 154(b) by 0 days.

(21) Appl. No.: 15/302,481

(22) PCT Filed: Apr. 7, 2015

(86) PCT No.: PCT/AU2015/000211
§ 371 (c)(1),
(2) Date: Oct. 6, 2016

(87) PCT Pub. No.: WO2015/154132
PCT Pub. Date: Oct. 15, 2015

(65) Prior Publication Data

US 2017/0022699 A1 Jan. 26, 2017

(30) Foreign Application Priority Data

Apr. 7, 2014 (AU) ..... 2014901242
Apr. 7, 2014 (AU) ..... 2014901244
(Continued)

(51) Int. Cl.
*E04B 1/30* (2006.01)
*E04B 1/16* (2006.01)
(Continued)

(52) U.S. Cl.
CPC ..... *E04B 1/30* (2013.01); *E02D 5/56* (2013.01); *E02D 5/801* (2013.01); *E02D 7/22* (2013.01);
(Continued)

(58) Field of Classification Search
CPC . E04B 1/30; E04B 1/3511; E04B 1/20; E04B 1/19; E04B 2/84; E04B 1/165;
(Continued)

(56) References Cited

U.S. PATENT DOCUMENTS 1,637,742 A * 8/1927 Edge ..... E04C 5/168 404/135
1,835,806 A * 12/1931 Olmsted ..... E04C 5/168 52/685
(Continued)

FOREIGN PATENT DOCUMENTS

CN 202990171 U 6/2013
FR 2460374 A1 1/1981
(Continued)

*Primary Examiner* — Brian D Mattei
*Assistant Examiner* — Omar F Hijaz
(74) *Attorney, Agent, or Firm* — Hultquist, PLLC; Steven J. Hultquist

(57) ABSTRACT

The invention relates to a system for erecting a building structure, the system comprising a foundation for receiving the building structure, and a plurality of inner and outer walls, roof and floor panels, the panels being adapted to engage each other for defining at least one story of the building structure, wherein the foundation comprises a first section and a second section, the first section being adapted to bear the load of the building structure and the second section being adapted to provide access to the interiors of the building structure.

8 Claims, 34 Drawing Sheets

(30) Foreign Application Priority Data

Apr. 7, 2014 (AU) ..... 2014901256
Apr. 7, 2014 (AU) ..... 2014901257
Apr. 7, 2014 (AU) ..... 2014901260
Apr. 7, 2014 (AU) ..... 2014901261

(51) Int. Cl.

| | |
|---|---|
| ***E04C 5/16*** | (2006.01) |
| ***E04C 5/06*** | (2006.01) |
| ***E04C 5/20*** | (2006.01) |
| ***E04B 5/32*** | (2006.01) |
| ***E04C 2/296*** | (2006.01) |
| ***E04C 5/065*** | (2006.01) |
| ***E04B 1/14*** | (2006.01) |
| ***E04C 2/52*** | (2006.01) |
| ***E04C 5/08*** | (2006.01) |
| ***E02D 5/56*** | (2006.01) |
| ***E02D 5/80*** | (2006.01) |
| ***E02D 7/22*** | (2006.01) |
| ***E02D 27/12*** | (2006.01) |
| ***E02D 31/10*** | (2006.01) |
| ***E04B 1/19*** | (2006.01) |
| ***E04B 1/20*** | (2006.01) |
| ***E04B 1/35*** | (2006.01) |
| ***E04B 2/84*** | (2006.01) |
| *E04C 2/00* | (2006.01) |
| *E04B 1/38* | (2006.01) |

(52) U.S. Cl.

CPC ..... *E02D 27/12* (2013.01); *E02D 31/10* (2013.01); *E04B 1/14* (2013.01); *E04B 1/165* (2013.01); *E04B 1/19* (2013.01); *E04B 1/20* (2013.01); *E04B 1/3511* (2013.01); *E04B 2/84* (2013.01); *E04B 5/328* (2013.01); *E04C 2/296* (2013.01); *E04C 2/521* (2013.01); *E04C 5/064* (2013.01); *E04C 5/0604* (2013.01); *E04C 5/065* (2013.01); *E04C 5/0627* (2013.01); *E04C 5/0636* (2013.01); *E04C 5/08* (2013.01); *E04C 5/168* (2013.01); *E04C 5/203* (2013.01); *E04B 2001/405* (2013.01); *E04C 2002/004* (2013.01)

(58) Field of Classification Search

CPC ..... E04B 1/14; E04B 2001/405; E02D 5/801; E02D 7/22; E02D 27/12; E02D 31/10; E02D 5/56; E04C 5/0636; E04C 5/0627; E04C 2/296; E04C 2/521; E04C 2002/004

See application file for complete search history.

(56) References Cited

U.S. PATENT DOCUMENTS

| | | | | | |
|---|---|---|---|---|---|
| 3,369,334 | A | | 2/1968 | Berg | |
| 3,802,790 | A | | 4/1974 | Blackburn | |
| 3,828,513 | A | | 8/1974 | Vanderklaauw | |
| 3,898,779 | A | | 8/1975 | Tracy | |
| 3,996,713 | A | * | 12/1976 | Haeussler | E04C 2/044 52/309.12 |
| 3,998,022 | A | | 12/1976 | Muse | |
| 4,060,954 | A | * | 12/1977 | Liuzza | E04C 5/168 52/677 |
| 4,164,831 | A | | 8/1979 | Messick et al. | |
| 4,461,130 | A | | 7/1984 | Shubow | |
| 4,532,745 | A | | 8/1985 | Kinard | |
| 4,598,523 | A | * | 7/1986 | Tolliver | E04C 5/168 52/685 |
| 4,702,048 | A | | 10/1987 | Millman | |
| 4,974,381 | A | * | 12/1990 | Marks | E04C 2/044 52/309.12 |
| 5,107,654 | A | | 4/1992 | Leonardis | |
| 5,396,747 | A | * | 3/1995 | Breuning | E04B 5/04 52/516 |
| 5,421,136 | A | * | 6/1995 | Van De Peer | E02D 27/08 52/294 |
| 5,797,230 | A | | 8/1998 | Lassen | |
| 6,000,194 | A | * | 12/1999 | Nakamura | B28B 19/003 52/309.12 |
| 6,460,213 | B1 | | 10/2002 | Flint et al. | |
| 6,779,312 | B2 | * | 8/2004 | Wright | E04G 21/142 52/125.2 |
| 6,789,366 | B1 | * | 9/2004 | Febra | B28B 23/0068 249/184 |
| 7,124,547 | B2 | * | 10/2006 | Bravinski | E02D 27/02 249/191 |
| 7,897,073 | B2 | * | 3/2011 | Haag | B28B 23/0068 264/228 |
| 8,505,267 | B2 | * | 8/2013 | Martin Hernandez | E04B 5/32 52/125.1 |
| 8,845,236 | B1 | | 9/2014 | Dosdourian et al. | |
| 8,984,826 | B2 | * | 3/2015 | Ciuperca | E04B 1/355 52/309.12 |
| 9,038,352 | B2 | * | 5/2015 | Miedzik | E04B 5/328 52/745.13 |
| 2003/0101677 | A1 | * | 6/2003 | Hewett | E04H 15/06 52/655.1 |
| 2003/0177733 | A1 | * | 9/2003 | Izquierdo | E04B 5/32 52/699 |
| 2004/0065034 | A1 | | 4/2004 | Messenger et al. | |
| 2008/0209843 | A1 | * | 9/2008 | Helms | E04C 5/163 52/677 |
| 2013/0036693 | A1 | * | 2/2013 | Lee | E04B 5/36 52/309.1 |
| 2013/0074433 | A1 | * | 3/2013 | Ciuperca | E04B 1/355 52/426 |
| 2020/0040574 | A1 | * | 2/2020 | Ekster | B32B 3/08 |

FOREIGN PATENT DOCUMENTS

| | | | | | |
|---|---|---|---|---|---|
| FR | 2601711 | A1 | | 1/1988 | |
| GB | 2426012 | A | | 11/2006 | |
| JP | 09151463 | A | | 6/1997 | |
| JP | 10-030615 | A | | 2/1998 | |
| JP | 2002339496 | A | | 11/2002 | |
| JP | 2003239392 | A | | 8/2003 | |
| JP | 2006194014 | A | | 7/2006 | |
| JP | 2013019249 | A | | 1/2013 | |
| KR | 10-0885865 | B1 | | 2/2009 | |
| NO | 2013067584 | A1 | | 5/2013 | |
| WO | WO-03002827 | A1 | * | 1/2003 | B28B 7/0029 |
| WO | 03048461 | A1 | | 6/2003 | |
| WO | 2009005449 | A1 | | 1/2009 | |
| WO | WO-2009104904 | A2 | * | 8/2009 | E01D 2/00 |
| WO | 2010018989 | A2 | | 2/2010 | |
| WO | WO-2012065534 | A1 | * | 5/2012 | E04B 1/165 |
| WO | WO-2015050502 | A1 | * | 4/2015 | E04C 2/049 |
| WO | WO-2015139935 | A1 | * | 9/2015 | E04B 1/20 |

* cited by examiner

BUILDING SYSTEM

CROSS-REFERENCE TO RELATED APPLICATIONS

This application is a U.S. national phase application under the provisions of 35 U.S.C. § 371 of International Patent Application No. PCT/AU15/00211 filed Apr. 7, 2015, which in turn claims priority of Australian Patent Application No. 2014901261 filed Apr. 7, 2014; Australian Patent Application No. 2014901260 filed Apr. 7, 2014; Australian Patent Application No. 2014901257 filed Apr. 7, 2014; Australian Patent Application No. 2014901256 filed Apr. 7, 2014; Australian Patent Application No. 2014901244 filed Apr. 7, 2014; and Australian Patent Application No. 2014901242 filed Apr. 7, 2014. The disclosures of such international patent application and Australian priority patent applications are hereby incorporated herein by reference in their respective entireties, for all purposes.

TECHNICAL FIELD

The present invention relates to building structures and methods for erecting building structures.

The invention has been devised particularly, although not necessarily solely, in relation to Building Structures comprising components fabricated off site such as prefabricated components.

BACKGROUND ART

The following discussion of the background art is intended to facilitate an understanding of the present invention only. The discussion is not an acknowledgement or admission that any of the material referred to is or was part of the common general knowledge as at the priority date of the application.

The process of erecting a building structure is typically a costly and cumbersome exercise. This is particularly true if the building structure comprises a plurality of storeys.

Solutions have been developed for facilitating the process for erecting building structures. For example, prefabricated building structures have been developed. Prefabricated building structures are buildings that include components that are manufactured off site and, prior to the process for erecting the building structure, the components are taken to the site. The components are built in a factory and shipped to the site. At site, the components are assembled together for erecting the building structure.

Prefabricated components not only facilitate the process of erecting building structures. Prefabricated building structures allow consumers to select from different wall system and finishes; thus, prefabricated building structures offer a multitude of options to the consumer allowing customising the building structure to the customer's needs and taste.

As mentioned before, erection of a prefabricated building structure requires assembly of the components that make up the building structure. The process for assembling the components typically may be a cumbersome process and requires skilled labour as well as specialized machinery. This increases the cost for erecting a building structure based on prefabricated components.

This is particularly true during the assembly of the components, such as prefabricated panels, that make up the walls of the building structure. Joining of the panels located adjacent to each other is cumbersome if conventional panels are used. Also, the unions between the conventional panels do not provide hermetic seals allowing air, humidity, smoke and fire to enter the building structure.

Further, installation of electrical and water services after assembly of the walls using conventional prefabricated panels is typically a cumbersome process. This is mainly due to the fact that conventional panels do not provide means for incorporating conductors, water and sewage services.

The following paragraphs provide a more detailed descriptions of the conventional components used for assembly of a building structure. These conventional components include panels and support structures defining roofs and floors of the building structure, means for joining the panels as well piles used when laying down a foundation for supporting the building structure.

Sandwich panels are a form of wall construction product that has been created to address the operational and functional shortfalls of mainstream systems. Bricks are slow to lay, offer little resistance to lateral forces and have poor insulation properties. Concrete is heavy and requires machines to form walls in-situ. Cement panels, produced off-site, are heavy to transport and difficult to handle and position in place.

The conventional sandwich panels are composed of an inner core of polystyrene, polyurethane or similar material, encased between two outer sheets that are composed of wood, cement fibre or other materials.

While addressing some of the shortfalls of mainstream wall materials and methods, conventional sandwich panels which were available prior to the current invention, bring their own flaws. In particular, sandwich panels offer limited load bearing capacity, being normally formed with thin outer sheets. The joins between successive sandwich panels forming a wall are typically of a simple nature, such as a butt join, rendering the arrangement poorly able to cope with wind, smoke and fire intrusion. Additionally, sandwich panels typically rely on their combined weight and that of any roof to hold them in place relative to the foundation block. This arrangement offers insufficient resistance against vertical displacement relative to the foundation in the event of strong winds.

Sandwich panels generally do not offer any means of incorporating plumbing lines and electrical or other cables within their structure, placing constraints on the logistics of construction so as to ensure that such pipes and cables can be inserted during the construction process.

Moreover, precast concrete sandwich wall panels have been used on virtually every type of building, including schools, office buildings, apartment buildings, townhouses, condominiums, hotels, motels, dormitories, and single-family homes. Although typically considered part of a building's enclosure or "envelope," they can be designed to additionally serve as part of the building's structural system, eliminating the need for beams and columns on the building perimeter. Besides their energy efficiency and aesthetic versatility, they also provide excellent noise attenuation, outstanding durability (resistant to rot, mould, etc.), and rapid construction.

Precast/prestressed sandwich wall panels are composed of two concrete wythes (layers) separated by a layer of insulation. One of the concrete wythes may be a standard shape, such as a flat slab, hollow-core section, double tee, or any architectural concrete section produced for a single project. In place, sandwich wall panels provide the dual function of transferring load and insulating the structure. They may be used solely for cladding, or they may act as beams, bearing walls, or shear walls.

Precast/prestressed concrete sandwich wall panels are used as exterior and interior walls for many types of structures. These panels may readily be attached to any type of structural frame, such as structural steel, reinforced concrete, pre-engineered metal and precast/prestressed concrete. The panels are typically precast at a manufacturing plant, trucked to the project site and erected by cranes.

Panels generally span vertically between foundations and floors or roofs to provide the permanent wall system, but may also span horizontally between columns. In this specification precast/prestressed concrete sandwich wall panels will be referred to as "sandwich panels" or simply as "panels."

Sandwich panels are similar to other precast/prestressed concrete members with regard to design, detailing, manufacturing, handling, shipping and erection. However, due to the intervening layer of insulation, they do exhibit some unique characteristics and behaviour.

Sandwich panels have all of the desirable characteristics of a normal precast concrete wall panel such as durability, economy, fire resistance, large vertical spaces between supports, and use as shear walls, bearing walls, and retaining walls. Sandwich panels can be relocated to accommodate building expansion. In addition, the insulation provides superior energy performance as compared to many other wall systems. There is virtually no limit to the R-value that can be provided. The hard surface on both the inside and outside of the panel provides resistance to forklift damage and vandalism and a finished product requiring no further treatment.

Current forms of precast concrete panels utilise a sandwich structure in which a thick sheet or block of insulating material is placed between two concrete sheets or sections, one typically considerably thicker than the other. The two outside concrete sections are fixed to one another via a multiplicity of ties that are placed in the mould prior to pouring and which are bound to each of the concrete sheets. This method of connecting two concrete sheets is associated with a number of potential difficulties. These include insufficient tensile capacity (allowing the concrete sheets to part) and deterioration of strength overtime. An objective of the current invention is to remedy this problem.

A further problem with the current form of precast concrete panels is a lack of capacity within the insulation or the panel in general to accommodate the installation of pipes, wires and cables within the panel. Current practice attempts to mitigate against this by installing such services in the panel mould. This reduces the adaptability and extendibility of the panel.

Architectural precast concrete has been used since the early 20th century, coming into wide use in the 1960s. The versatility of precast concrete makes it highly suitable for architectural applications. The exterior surface of a precast concrete piece can vary from a form face finish similar to cast-in-place to an exposed aggregate finish that is ornamental. Some precast panels act as column covers while others extend over several floors in height and incorporate window openings. Typically, the architect selects the cladding material for appearance, provides details for weatherproofing and specifies performance criteria. Typically, the structural engineer designs the structure to hold the cladding, designates connection points and evaluates the effects of structural movement on the cladding. Typically, the precast concrete manufacturer designs the cladding for the specified loads, erection loads and connection details, and provides for the weatherproofing, performance and durability of the cladding itself. Typically, each precast panel is independently supported to the building structure using an assemblage of metal components and anchors. Joints around each of the precast panels are usually filled with sealant.

Precast panels must be connected to each other upon installation. Currently, precast manufacturers use numerous different types of anchors or connections, the primary purpose of which is to fix precast panels in position relative to one another and ultimately transfer load to the supporting structure for strength and stability.

Connector designs take into account the tolerances for both the precast concrete components and the structure. Typical considerations may require clip angles and plates with slots or oversize holes to compensate for dimensional variations, field welding or sufficient shim spaces to allow for variations in elevation. The three main types of connections in current practice are bolted connections, welded connections and dowel/anchor bolt connections.

Bolted connections are sometimes employed due to the positive nature of the connection and the ability to adjust to variations in position after the panels have been placed. This type of connector is unsightly and permits incorrect placement due to its adaptability. An objective of the current invention is to remedy these drawbacks.

Welded connections are the most common and typical connection used in the erection of precast concrete. These connections are structurally robust and adjust easily to varying field conditions. The connections are usually made by placing a loose plate between two structural steel plates that are embedded both in the cast-in-place or the precast concrete panel and welded together. Some connections are designed to bend and yield in one direction while remaining rigid in all other directions. This method requires welding personnel and equipment on site and places insufficient control over placement. An objective of the current invention is to eliminate the need for specialised labour and equipment while maintaining a high level of control over placement so as to ensure conformance with the design specifications.

Connections in a dowel connection rely on the strength of the dowels in tension or shear which are a function of dowel diameter, embedded length and the bond developed. Threaded anchor bolts and rebar anchor dowels that protrude from the foundation and the panels are sometimes the medium for connecting precast members. This method is limited in application due to the restrictions placed on the means by which the precast panels are installed. Field conditions often require that one precast panel is maneuvered into place adjacent to one or two panels in such a way that the edges are in slight contact while the panel is being positioned. Dowel and bar connections do not permit this close contact while the panel is being positioned. An objective of the current invention is to permit contact between panel edges while one panel is maneuvered into place relative to its adjacent panel or panels.

Moreover, multi-story prefabricated building structures require floor structures that are lightweight and have a relative large load bearing capacity.

The biaxial hollow slab [EP0552201] was invented in the 1990s. This invention incorporated hollow bodies in concrete slabs in order to save material and weight. Different methods of incorporating the hollow bodies as well as designing these were described.

Several subsequent applications attempt to implement connection features in creative ways of fixing the individual voids between the top and bottom reinforcement without direct contact with one or both reinforcement meshes. These applications are highly impractical and as a consequence are expensive in material consumption, fabrication and transport as well as installation.

Patent 2010/076757 describes a displacement system, consisting of a series of displacement volumes placed in an exact uniform geometrical grid determined by a spacing system integrated in composite members through a geometrical locking system in the form of special designed three-dimensional steel structures, securing fast and precise implementation, and designed to ensure integrity and to increase the shear strength of the respective composite member.

This application presents a number of drawbacks. The first drawback is that the reinforcing mesh is secured to a truss arrangement via welding, which is labour intensive and slow. An additional drawback is the absence of an integrated chair system whereby the construction body can be elevated relative to the surface on which it is placed. A further drawback is the absence of any systematic means of strongly fixing the displacement volumes relative to each other and the support framework such that they would be able to withstand substantial handling forces or the flotation forces associated with injecting the hardening material in one step into the structural body.

Further, prefabricated buildings structures need a foundation on which the building structure rests. Formation of the slap is costly and cumbersome. This is because the foundation needs to have a high load bearing capacity. Thus, the foundation requires to rest on deeply ground embedded pillars.

Piles are used for foundations in order to transfer the load of a superstructure onto a suitable underlying soil stratum. Load is transferred to the ground through shear along the pile shaft and from the bearing pressure of the base. The ratio of capacity generated from either shaft friction and bearing pressure is dependent on the soil conditions and pile type. Traditionally piles have been installed using two approaches. The first involves driving the pile into the ground through the repeated application of impact load to the pile head until an acceptable installation depth is reached. The second, in its simplest form, uses an auger to bore a hole into the ground and replace the soil with concrete. The use of driven piles can cause significant disturbance in terms of noise and vibration during the installation process, something that can limit the use of the method in particular locations. Utilisation of bored piles, although not suffering the noise and vibration issues of driven piles, produces large volumes of spoil for each installed pile. Due to strict regulations, the disposal of the produced spoil can lead to significant expense for a project.

Developments in piling technology has seen a new generation of pile type which are formed using an auger tool that displaces the soil laterally creating a void, which is then filled with concrete. These pile types have installation characteristics of both traditional driven and bored piles. The development of this auger based piling technique has resulted in the generic terms 'driven' and 'bored' becoming obsolete. It is now common practice to use the definitions displacement or non-displacement (also referred to as "replacement"), which stem from the soil movement characteristics around the installed pile. Piles constructed using auger tools tend to have characteristics of both the more traditional displacement and non-displacement piles.

Replacement piles remove soil from the pile location to allow construction of the pile. Construction of replacement piles reduces lateral stress in the ground. The problems of noise and vibration associated with displacement piles may be avoided by using replacement piles, although this is at the loss of the benefit from soil compaction.

Displacement piles are generally classed as those which are either driven or jacked into the ground. The driving action during installation does not remove the in-situ soil but causes compaction primarily around the base of the pile. Displacement piles can be pre-formed from a range of materials, the most common being concrete and steel. Precast concrete piles are usually made in a square cross section while steel piles can be either circular tubing or in the form of I and H sections.

One form of displacement pile is the helical pile (also referred to as an anchor or pier, depending on the application, as well as a "screw pile"). Helical piles are manufactured steel foundations that are rotated into the ground to support structures. Helical piles are a valuable component in the geotechnical toolset. From an engineering and architectural standpoint, they can be adapted to support many different types of structures that represent a range of problematic subsurface conditions. From an owner developer standpoint, their rapid installation can often result in overall cost savings. From a contractor perspective, they are easy to install and their capacity can be verified to a high degree of certainty. From the public perspective, they are perhaps one of the most interesting, innovative, and environmentally friendly deep foundation solutions available today.

Historically, screw piles were used to support tension loads, compression loads, overturning moments, and combined loading—not unlike loads experienced by many modern foundations. In today's world, the application for screw piles is substantial.

Screw piles have found their way into nearly every aspect of civil construction: building foundation support for new construction, pedestrian bridges and walkways in environmentally sensitive wetlands and other areas, slope stability repair, tiebacks in temporary earth support, underpinning foundations for temporary structures, foundations for light and signage structures and wind generators, tension anchors for transmission towers and cell towers, underpinning of existing structures, foundations of bridge foundations, and a variety of other geotechnical applications.

Since the installation of screw piles is not limited to vertical applications such as a foundation under a building, screw piles are increasingly used as tiebacks to support excavation walls and other retaining structures. Small-diameter soil screws can be installed quickly into almost any type of soil, except gravel, to provide lateral earth support for a variety of construction applications.

Helical piles are well known as a further derivation of screw piles. Helical piles are utilised in the geotechnical industry to support or anchor building foundations in unstable soil and to stabilise or repair the integrity of existing foundations. A typical helical pile is part of an assembly that consists of at least one elongated shaft member having at least one helical plate member attached thereto and extending there around. The helical plate member is fixedly attached to the shaft member and the assembly is mounted in the ground for securing to a foundation or the like.

Typically, the helical plate member is placed in the ground and the helical anchor assembly is rotated about the longitudinal axis of the shaft member, which enables the helical plate member to engage with the ground material, drawing the entire assembly into the ground to form, typically with a plurality of other pile assemblies, a firm bearing or anchor point for the foundation. The pile assemblies can be utilised under compression, known in the art as underpinning, wherein the anchor assembly supports a body by absorbing a compression load between opposed ends, one of which is attached to the ground and the other of which is attached to the body. The pile assemblies can also be utilised under tension, known in the art as a tieback, wherein the pile (or anchor) assembly retains the body to the foundation by applying a tension load to the opposed ends thereof.

Typically, helical piles currently in use offer an inadequate capacity to penetrate difficult soils, particularly those containing gravels and boulders. Such obstacles tend to force the lead point of the helical pile off-line, resulting in a diminished load bearing capacity. An objective of the current invention is to address this deficiency.

Typically, helical piles currently in use offer inadequate control over the final angle of penetration, being that angle relative to the respective foundation upon the cessation of the driving action. This results in piles presenting angles removed from the vertical, which diminishes load bearing capacity. An objective of the current invention is to overcome this deficiency.

Typically, helical piles currently in use are not sufficiently strong to withstand high torque, particularly on the bearing blades. This can result in off-angle installation or premature end to the driving process with the result that the head of the pile is not situated in the correct load bearing strata. An objective of the current invention is to overcome this deficiency.

Further, the foundation needs to be able to account for soil expansion as well as earth displacement due to earthquakes.

The function of a footing is not only to distribute vertical loads from the building to the foundation, but to ensure that the building superstructure performs satisfactorily, particularly when it is on a foundation subject to movement due to moisture changes (reactive clay sites), settlement, etc. The most common movements arise as a result of moisture changes in reactive clay soils. As clay soils become wet, they swell or increase in volume, and as they dry out, they shrink. This is why cracks appear in clay soils during periods of prolonged dry weather. The more reactive the clay or the deeper the soil is affected, the larger will be the surface movement.

Constructing a concrete slab on the ground is the equivalent of covering the ground with an impermeable membrane. Any moisture rising beneath the slab can no longer evaporate from the surface. The soil in the centre of the slab therefore remains damp and the moisture content may even increase and, if reactive, will swell. However, around the edges of the slab, moisture will be able to evaporate during dry periods and permeate back under the slab during wet periods. Thus the edges of the slab will be subject to periods of heave and periods of loss of support when the slab has to cantilever out from the centre mound.

The use of concrete slab floor systems in the Australian residential construction industry has been steadily increasing since their introduction. In 1977 only about twenty percent of homes were built on concrete slabs, yet by 1992 almost eighty percent of new homes constructed had some form of concrete floor. The current percentage of residential constructions built on concrete slabs exceeds 90 percent.

A structure's resistance to movements caused by moisture variations in clay soils is determined by the type of footings, walls and building materials used. Modern steel reinforced concrete footings provide sufficient resistance to such movements under most circumstances. However, this has not always been the case. Many footing systems used in the past were unsuitable for the situations in which they were being used. Concrete footings only began to be used regularly near the end of the 19th century, and steel reinforcement was not employed until the 1920's.

Expansive soils are described as being those whose volume changes appreciably when subjected to variance in moisture content. The moisture content of a clay soil will be influenced by any structure built above. Seasonal moisture changes will also be encountered, primarily at the perimeter of buildings, which will cause uneven movements of the clay soil beneath. Cracking of brickwork and jamming of doors or windows are symptoms of a slab and footing system that have not been designed to resist movements of expansive soils.

A widely referred to model considers the interaction between footing systems and the foundation soil beneath. This interaction is influenced by moisture changes in the clay and the weight of the footing itself; if the footing was weightless and completely flexible, only the moisture variations would need to be considered. In such a situation, the soil would deform into a mound whose shape is assumed to be constant; the distance the soil deforms is termed as centre heave. In addition, edge heave may occur at the perimeter of slabs, and this is also taken into consideration when designing footings.

The dimensions of footing beams changed with the discovery that uplift forces and the surface area of footings in contact with the soil were the main factors to be considered in their design. Deep, narrow beams, trenched into the soil and reinforced with deformed steel bars became more widely used.

Predecessors to the wafflepod system included hollow terracotta blocks, which have been used in Australia since the 1880's for various purposes. In 1913, in an attempt to decrease the dead loads imposed by concrete slabs in multi storey buildings, terracotta blocks were used as lost formwork. The blocks were laid in rows, with reinforcing steel placed between them, effectively forming a type of ribbed or "waffle" slab. The Innes-Bell waffle was widely used in the 1930's, especially in situations which required minimal floor to floor heights and a lack of beams, such as car-parks.

Several other methods were used to form voids and lighten floor slabs. Asbestos House in Sydney was built in 1928 for James Hardie & Co., and used asbestos cement void forms, fabricated by James Hardie. Reinforced cardboard and coke breeze blocks were also used in the 1930's, as well as removable steel forms. However terracotta remained the most popular choice for this purpose.

The wafflepod system, developed by South Australian engineering firm Koukourou and Partners, was first used in the residential construction industry in 1985. A principal reason for the introduction of the wafflepod was to meet the need for a footing system that was economic on the reactive clay sites that are prevalent in South Australia. The design was influenced by suspended waffle floor systems used in the commercial industry. It is an "on ground" rather than "in ground" system; there is no need for the trenching associated with construction of a standard raft footing system.

The system uses cardboard, water resistant boxes which act as formwork for the narrow (110 mm wide) ribs. The standard box sizes are 1090 mm by 1090 mm, and they are produced in heights of 225, 300 and 375 mm, giving overall beam heights of 310, 385 and 460 mm respectively. These boxes are set out over the building area, and steel reinforcement is fixed above and between them. Concrete fills the 110 mm wide spaces, forming a grid of beams and creating a rigid structural element.

More generally, it is known to use cavity or void formers as space filling elements in the preparation of a concrete slab or foundation, for reducing the volume of concrete required to form the slab or foundation. Such foundations are commonly known as waffle slab foundations. The reduction of concrete content in a slab as a result of having multiple cavities on its underside serves in turn to reduce the cost of the slab, it also advantageously allows the slab to be built on unstable soil as expanding soils will flow into the formed cavities.

As the cavity formers must be sufficiently strong to support, firstly, the weight of workers when the formers are in place prior to a pour and, secondly, the load of wet concrete when it is poured, the cavity formers are traditionally prefabricated remote from the building site in standard sizes and then delivered to the building site ready to be set in place prior to pouring of the concrete. Known cavity formers include reinforced multiple web-cardboard or fibreboard boxes and so called pods of foamed polymeric material, such as polystyrene.

Cardboard or fibreboard formers must have sufficient structural integrity to support a wet slab for a prescribed period after a concrete pour, before they weaken through moisture absorption. Polystyrene pods overcome this limitation, but have the disadvantage that, when larger pods are cut into smaller shapes for filling cavities of irregular or smaller shape, large quantities of fine polystyrene particles are often generated. Such polystyrene particles present an environmental problem because they are easily scattered by a breeze. Furthermore, polystyrene pods do not disintegrate to more completely form the cavity or void and this presents a disposal and environmental problem when the slab is partially or wholly demolished or reshaped. For these reasons, the use of polystyrene as a cavity former is being restricted in some locations.

Typically, slab formation preparations involve levelling the ground on which the slab is to be formed, erecting shutters to define the perimeter of the slab, locating reinforcement for edge beams of the building to be constructed, laying down building film, such as plastics sheets, onto the levelled ground, and then arranging multiple cavity formers in a spaced array on the building film. Bar chairs are then located at spaced intervals in the spaces between the cavity formers, and then reinforcement bars are placed on the bar chairs to form a lattice of reinforcement bar surrounding the cavity formers. Bar chairs are also located on the tops of the cavity formers to support reinforcement mesh that is laid in a blanket covering. After these preparations, the wet concrete is poured about the cavity formers, and cures to form the concrete slab or foundation. A process along these lines is described, for example, in Australian patent 584769 to Koukourou & Partners Pty Ltd.

Australian petty patents 727681 and 727665 disclose cavity former modules fabricated in recycled plastic. The modules have multiple box elements joined in an integral structure that also defines channels between the box elements. Reinforcing bars are supported in the channels on spaced integral bracket elements that each have an upper edge shaped to centre the bar, while reinforcing mesh rests on upstanding ribs formed integrally on the top surfaces of the box elements. It has been found that, while cavity former modules of this kind alleviate the environmental concerns of polystyrene pods and address the labour costs of foundation preparation, the modules often require a volume of plastic that adversely affects their economics relative to cardboard and polystyrene. They are also bulky to transport.

It is against this background that the present invention has been developed.

SUMMARY OF INVENTION

According to a first aspect of the invention there is provided a panel for defining a wall structure, the panel having a lower end adapted to be mounted on a foundation, and an upper end adapted to receive a roof structure, the panel comprising first and second outer layers, and an inner core, the core comprising a plurality of holes adapted for receiving fastening means for securing another panel to the panel to define a wall structure.

In a particular arrangement there is provided a plurality of multi-layered panels defining one or more straight walls. The term "wall" in this specification means such a series of multi-layered panels, each in a vertical orientation and securely butting against at least one other multi-layered panel along its edge and that of the other multi-layered panel and seated in a channel that is secured to a solid foundation composed of concrete or other solid material. In the case of multiple walls, each wall may be connected to another at either or both of its extremities along the edge of the respective outermost multi-layered panels. A wall may also be connected to another such that the edge of one wall butts against the face of the other at any point along its length. In this fashion, walls may be used to form a variety of open or closed configurations, the latter representing what would commonly be perceived as rooms.

Additionally, two multi-layered panels may be positioned such that a longer face of one panel abuts against a longer face of another panel, with the edges and tops of both multi-layered panels in line with each other. These panels may be combined with a combination of vertical steel tubes and steel tie rods, all connected to a solid foundation and put under tension so as to create a compressive force downwards thus fastening the resultant arrangement to the foundation and creating a load bearing free standing column following the injection of 50 mpa cement grout into selected holes running the full vertical extent of the panels.

Preferably, each multi-layered panel is 300 mm wide and 110 mm thick, composed of a 78 mm thick core of polystyrene held between two 16 mm thick sheets of low density compressed fibre cement by means of a strong adhesive. The polystyrene core offers excellent insulation while the outer compressed fibre cement sheets offer substantial load bearing capacity by virtue of their thickness.

The height of a multi-layered panel when in its vertical orientation is limited by the maximum height available of 16 mm low density fibre cement sheets as well as by engineering constraints placed by relevant building legislation. A multi-layered panel may be cut to a height less than the maximum to enable apertures to be formed within a wall, such as those for windows or doors.

Preferably, a multi-layered panel contains three holes spaced evenly along its width, each extending the entire height of the multi-layered panel. Preferably, each hole is cased with close fitting 3 mm thick PVC tubing, which adds to the load bearing capacity of the multi-layered panel. The holes may be filled with a strong core fill to further increase the load bearing capacity of selected multi-layered panels. Alternatively, the holes may act as conduits for cables and pipes, insulated by the PVC tubing, which may form part of an electrical or plumbing system but are not restricted to such use.

The two longer edges of each multi-layer panel are formed such that the cross sectional profile of one edge is the reverse of the cross sectional profile of the opposing edge. In this manner, a multi-step join between two multi-layered panels is created, whereby the edge of one multi-layered panel fits neatly into the edge of the adjoining multi-layered panel. Specifically, one edge of the polystyrene core is formed into a nine-face tongue element while the opposing edge is formed into a corresponding nine-face groove. Additionally, the edge of each low density cement fibre sheet is formed into a tongue with the opposing edges formed into corresponding grooves. In this manner, two multi-layered panels may be tightly joined along the multiple faces represented by the respective tongue and groove profiles, thus offering a substantial barrier to wind, water, smoke and fire. The multi-layered panels are held together by means of locking clips, which are made of metal bars formed into a square U shape. The side of each U shape is inserted into a recess formed at the outer edge of each outer hole in the polystyrene core, such recesses being created at both the top and bottom of the multi-layered panel.

A series of multi-layered panels may be so joined as to create a wall, which is held securely in a vertical orientation by attachment to steel columns at either longitudinal extremity. The steel columns are securely connected to a foundation block, which is typically composed of concrete. A metal channel is attached to the steel column via a series of bolts such that its groove runs vertically and in line with the column. The edge of the multi layered panel at the edge of the wall may be placed in the tight fitting vertical groove of the channel such that the steel column acts as a support for the wall. In this manner, two steel columns strongly support a wall in its vertical orientation by resisting lateral displacement as well as constraining the wall from any displacement along its longitudinal axis and creating a strong resistance against a parting of the multi-layered panels with respect to each other.

An alternative to a steel column arrangement just described is to employ a steel capping post, which is composed of two C-channels welded together such that the open faces of the channels are at right angles to each other. The capping post is of a height equivalent to the multi-layered panels to be joined. The edge of each of the respective panels is inserted into one of the channels of the capping post, thus forming a corner. Mechanical fastenings are applied to fix each multi-layered panel to its respective channel in the capping post. The void between the channel and the edge of its respective panel is filled with 50 mpa cement grout to provide a medium within which the fastenings may take purchase. The panels thus participating in the corner arrangement are fastened to the foundation block by means of tie rods, the details of which are described in a subsequent section of this specification.

The wall is seated at the bottom within a close fitting metal channel that is secured to a foundation block by means of a series of bolts thus creating a strong resistance against the multi-layered panels displacing laterally at the bottom relative to each other. The bottom channel is constructed with slots at intervals along the outer extremity of its bottom face in relation to the foundation block. The bottom channel is placed on the foundation block such that its bottom face protrudes away from the foundation block and places the slots aforementioned free of the foundation block thus allowing any water captured within the channel to drain free via the slots.

An additional or alternative method of providing resistance to any lateral deviation at an intermediate section of a wall is to place an additional multi-layered panel laterally adjacent to a selected multi-layered panel within the intermediate section such that the additional multi-layered panel is inwards of the wall with respect to the foundation block. The outer face of the additional multi-layered panel with respect to the foundation block is butted against the inner face of the multi-layered panel, with respect to the foundation block, that is part of the wall.

Preferably, tie rods, composed of cylindrical threaded metal bars, are inserted in all the holes of the dual panel arrangement just described. Tie rods are threaded into ferrules that are themselves threaded onto anchor rods that are fixed into the foundation block. The anchor rods and ferrules are so located as to correspond to the vertical holes within the polystyrene core such that the respective multi-layered panels may be seated in the correct position and over the ferrules. The tie rods protrude above the top of the respective multi-layered panels when such panels are seated within the bottom channel. Metal locking plates, composed of a flat metal bar with two holes, are placed over a pair of tie rods at the top of the wall such that the tie rods of the dual panel arrangement are held rigid in pairs relative to each other. A compressive force on the wall relative to the foundation block is created by tightening nuts on the tie rods following placement of a metal roofing plate, which forms a channel facing inwards relative to the wall. The nuts and associated washers are positioned within the channel and over the tie rods which protrude into the top channel through the bottom wall of the channel.

Tie rods are also inserted into the vertical steel columns previously described and the adjoining multi-layered panels. These tie rods are secured to the foundation block via ferrules threaded onto anchor rods as previously described and exert a compressive force on the wall relative to the foundation block through tightening nuts over washers located within the open groove of the roof plate which is placed over locking plates that hold pairs of tie rods fixed relative to each other, as described in the preceding section.

This structure, involving columns and top and bottom channels and tie rods, provides a wall composed of multi-layered panels highly resistant to lateral, longitudinal and vertical displacement forces. However, the differential between the resistive strength of the wall at the columns and the intermediate sections of the wall provides a relief mechanism in the event of extremely high winds such that the joins between some multi-layered panels in the intermediate section of the wall will give way thus reducing the overall forces on the wall as a whole while the columns will withstand greater forces and preserve the general integrity of the wall.

Apertures to accommodate window and door frames may be created within an intermediate section of a wall, being one that is free of columns or supporting panels, by inserting a configuration of multi-layered panels that are of a height that corresponds to the height of the bottom of the respective frame and to the height from the top of the respective frame to the top of the wall, and of a number that corresponds to the width of the corresponding frame. Preferably, the width of the frame shall be a whole multiple of 300 mm.

According to a second aspect of the invention there is provided a panel comprising a reinforcing structure and a plurality of cores incorporated in the reinforcing structure, wherein the reinforcing structure is embedded in a concrete casing.

In a particular arrangement there is provided a panel (also referred to as precast panel) comprising at least one body of insulating core encased within a body of concrete reinforced with a combination of reinforcing bars and reinforcing mesh. Preferably, reinforcing bars emanate from the concrete body so as to provide a means by which the concrete body may be connected to other concrete bodies. Preferably, multiple lifting plates are incorporated into the concrete body and engaged with the reinforcing structure so as to provide a means of attaching lifting equipment such that the concrete body may be handled and installed. Preferably, the concrete body incorporates multiple casting locks so as to enable strong accurate connection with other concrete bodies. The entire arrangement forms the current invention, known as encased core insulating precast panel.

Said panel can be made in a variety of sizes and thicknesses, the magnitude of which are a function of engineering requirements and production constraints. A panel face is that surface which forms the largest surface area of the panel. Panels may be said to have an inner face and an outer face. The inner face can be defined as that face closest to the insulating core, while the outer face is that face furthest removed from the insulation core.

Panels may be said to have, but not be limited to two basic orientations. The production orientation involves the inner face of the panel being closest to and approximately parallel to the typical floor of a production plant, due to the fact that the panel is formed by the pouring or injection of concrete into a mould populated by the various reinforcing and supporting arrangements previously described and to be elaborated in subsequent comments.

The working orientation involves both panel faces being perpendicular to the ground or to the floor of the respective building.

The encased core insulating precast panel may be said to be composed of three core components and a number of secondary components. The core components are the concrete casing, the insulating core and the reinforcing.

The concrete casing forms the dimensions of the panel and acts as a structural building component from which floors and walls may be constructed. Preferably, the concrete case is formed by the introduction of concrete slurry into a mould, which contains the insulating core, the reinforcing items and the supplementary components to be described presently.

Preferably, the insulating core is composed of two blocks of polystyrene. Each insulating core block may be formed from smaller bodies of insulating material joined together so as to form one body, the block, for all practical purposes. Preferably, each block forms a shape and is positioned such that its two larger faces lie parallel to the faces of the concrete casing and its edges lie parallel to the edges of the concrete casing. Preferably, each block is positioned such that three of its contiguous edges are inset a small distance from the corresponding three contiguous edges of the concrete casing. Preferably, each block is of a size such that when each block is in position, the remaining edges of both insulating core blocks are displaced from each other so as to leave a section of the concrete casing approximately bisecting the longer dimension of the panel free of insulating core in order to form an internal integrated beam of reinforced concrete extending across the entire panel. Preferably, each insulating core block is positioned such that the distance between one face from the corresponding face of the panel is less than the distance between the other face of the insulating core block from the correspond panel face.

Preferably, each insulating core block includes a series of tunnels extending from one edge of the block to the opposing edge such that the tunnels are approximately parallel to face of the block, and therefore to the face of the panel. Preferably, each tunnel presents an open face at the edge of the insulating core block that is closest to the shorter edge of the panel such that the open face of the tunnel is either at the top or bottom of the panel when in working orientation, depending on which block it is pail of. Preferably, each tunnel is lined with PVC pipe or similar material. Preferably, these tunnels provide a means of installing pipes, wires or cables in the encased core insulating panel at a time following the installation of the panel, thus permitting electrical and plumbing services to be installed following lockup.

Preferably, the reinforcing is comprised of an arrangement of steel mesh and steel bars. Preferably, each panel includes a skeleton, which may be described as a strength element that follows the entire perimeter of the panel, slightly inset from each respective edge, and across the width of the panel, roughly in the middle of its longer dimension and corresponding with the internal beam previously described. Preferably, this skeleton is composed of multiple steel bars arranged parallel to each other and following the general line of the respective panel edge. Preferably, these parallel steel bars are held in place relative to one another by a series of metal items spaced at regular intervals along the skeleton arrangement. Preferably, these metal items are formed of metal bars bent into a roughly rectangular shape. Preferably, the rectangular metal items hold the parallel steel bars in position by virtue of the steel bars being welded or clipped or wired to each rectangular spacer.

Preferably, the reinforcing includes steel mesh. Preferably, one sheet of reinforcing mesh is placed underneath and one placed above each block of insulation, separated from the insulation block by an arrangement of spacers. Preferably, the reinforcing includes multiple metal bars extending the full length of each panel and placed above the insulation blocks (meaning towards that panel face most removed from the respective face of the insulation block, at intervals roughly parallel to each other.

Preferably, each panel includes a series of reinforcing bars emanating from the top edge of the panel when in working orientation, so as to present a means by which one panel may be fixed relative to another panel whereupon one is on top of the other. Preferably, each protruding reinforcing bar includes a cross bar at the end embedded within the panel, effectively forming a T shape, such that the bar is fixed within the concrete casing and resists rotational and tensile forces.

Preferably, each panel includes a series of tunnels, each presenting an opening at the bottom edge of each panel, their position corresponding to the series of protruding reinforcing bars at the top of the panel, such that in the event that one panel is mounted on top of another panel in the working orientation, the protruding bars from the top edge of the bottom panel fit into the tunnels present in the bottom edge of the top panel. Preferably, the available volume between the protruding bars and their host tunnels may be filled with grout to fix the two panels firmly to one another laterally and longitudinally.

Preferably, each panel includes a series of reinforcing bars protruding from the outer face of the panel and positioned at intervals slightly below and parallel to the top edge of the panel when in working orientation. Preferably, each panel includes a further series of reinforcing bars, also protruding perpendicular from the outer face of the panel, and positioned at intervals across the width of the panel when in working orientation, at a height that corresponds to the internal beam described earlier. By such means, a panel may be connected to a building element that is orientated perpendicular to the panel, such as a floor. Preferably, each reinforcing bar includes a cross bar at the end embedded in the panel so as to resist rotational and tensile forces.

Preferably, each panel includes two lifting elements embedded within the top edge of the panel when in working orientation so as to provide a means of attaching the panel to a lifting and handling machine. Preferably, each lifting element includes a plate whose face lies flush with the face of the top edge of the panel. Preferably, such plate contains two threaded holes by which external items may be connected to the panel. Preferably, such plate is welded or similarly fixed to an arrangement of metal bars that extend into the concrete casing and fix the lifting element firmly to the panel. Preferably, the arrangement of metal bars is so formed so as to engage with the metal elements of the reinforcing skeleton and enable them to be welded or similarly joined together with the result that the lifting element is both embedded in the concrete casing and fixed to the panel skeleton.

Preferably, each panel includes a series of casting locks embedded within the concrete casing and engaged with the skeleton. Preferably, two types of casting lock may be distinguished. The middle casting lock can be defined as that which is used to join two panels in line, in the sense that upright vertical edge of one panel in working orientation is butted against the corresponding edge of another panel. The corner casting lock may be defined as that which is used to join one panel at right angles to another, in the sense that the upright vertical edge of one panel is connected to the face of another panel.

By the means so described in this summary, a reinforced concrete precast panel with insulating elements encased within the concrete casing is constructed to offer a novel composition of elements that produce a set of features that directly address the problems identified in the background.

According to a third aspect of the invention there is provided a locking system for joining first and second panels together, the locking system comprising a first body, a second body and a rod, the first body being adapted to allow selective displacement of the rod between an extended condition and a contracted condition, the second body being adapted to receive the rod in the extended condition for joining together the first and second bodies, wherein the first body is adapted to be secured in the first panel and the second body is adapted to be secured in the second panel for joining the first and second panels together when the rod is in the extended condition.

In a particular arrangement there is a mechanical lock configured to connect two precast panels to one another along their vertical edges or at right angles to one another by creating tension in a threaded metal rod that has purchase in each of the panels to be joined. The purchase is obtained by the incorporation of a manufactured element, referred to hereon as the body, embedded in the respective panel during the casting process. The said body creates a void in the surface of the respective panel such that access to the threaded metal rod is obtained to enable two nuts and a washer to be engaged with the threaded metal rod.

In the case of the two panels being joined in line with one another such that the join is along the edge of each of the panels, preferably the manufactured element is positioned relative to the two larger faces of the respective panel by means of a series of threaded rods inserted into corresponding threaded holes in the body. Preferably, said rods and holes are orientated perpendicular to the large faces of the panel. Preferably, said rods are of a length equivalent to the thickness of the respective panel, such that the extremities of each threaded positioning rod are approximately flush with the corresponding larger panel face. Preferably, one extremity of each threaded positioning rod is so shaped as to accept a cover, this cover being composed of a hard material, typically plastic, and forming a cone at its extremity such that the area of contact between the threaded positioning rod and the casting basin is minimal thus minimising the resultant interruptions to the panel surface post-casting.

Preferably, the manufactured element incorporates external markings such that there is consistency in positioning as measured from relevant reference points on the casting mould.

Preferably, in selected panels, the threaded metal rod is placed in the body prior to the body being incorporated into the panel via casting. Preferably, the nut and washer assembly is engaged with the threaded metal rod prior to placement in the casting mould. Preferably, the threaded metal rod is positioned such that it does not protrude beyond the extremity of the body that is positioned closest to the edge of the mould. Preferably, the manufactured element incorporates a hollow tunnel running its entire length. Preferably, the threaded metal rod is of sufficient length that is can simultaneously engage with the nut and washer assembly in each of the panels to be joined such that when tightening is applied to the nut and washer assembly the threaded metal rod forms a rigid connection between the corresponding panels. Preferably, the manufactured element incorporates a hollow pipe or tunnel from that end of the body furthest from and extending away from the edge to be connected such that the overall length of the manufactured element slightly exceeds the length of the threaded metal rod, thus enabling said rod to be contained within the length of the manufactured element during the casting process.

Preferably, the manufactured element incorporates a section along its length of sufficient width to enable a tool to be inserted to wind the tightening nut relative to the threaded metal rod during installation. Preferably, this section presents an open face oriented towards one face of the panel such that a cavity is formed in the face to enable external access to the nut and washer arrangement. Preferably, the manufactured element incorporates a cap that is seated tightly in the said cavity prior to casting in order to prevent the intrusion of hardening material into said cavity. Preferably, the said cap has dimensions such that the upper face relative to the manufactured element protrudes slightly above the corresponding panel face such that said cap may be located post-casting and removed to reveal a void enabling access to the threaded rod and associated nut and washer arrangement. Preferably, the body is so constructed that a shoulder is presented close to the open face of the cavity such that the bottom of said cap sits on the shoulder, preventing said cap from sinking and thus precisely preserving the height of the closed top surface of said cap relative to the body.

Preferably, the manufactured element incorporates a tunnel running its entire length. Preferably, said tunnel incorporates an internal thread at the end closest to the panel edge that is to be the connecting edge. Preferably, a manufactured threaded plug is threaded into said internal thread such that the plug incorporates a head larger than the diameter of the tunnel running through the manufactured element in order to prevent intrusion of hardening material into the hollow core of the manufactured element. Preferably, the manufactured element is positioned in the casting mould such that the outer surface of said plug head relative to the manufactured element lies flush with the edge of the panel. Preferably, the thickness of said plug head is such that when said plug head is removed post-casting the hollow core of the manufactured element presents an open face slightly inset from the edge of the panel in order to provide a free path for the threaded metal rod to extend beyond the outer extremity of the manufactured element.

Preferably, the nut and washer assembly incorporates a spring washer, a tightening nut and a locking nut. Preferably, upon two panels being placed alongside one another, one panel contains a casting lock with a threaded metal rod in situ while the adjacent panel contains a body and retreat tunnel assembly free of a threaded metal rod and a nut and washer assembly. Preferably, the threaded metal rod in the loaded panel is repositioned to present an end in the cavity of the casting lock in the adjacent cavity. Said repositioning is obtained by winding the tightening nut relative to the threaded metal rod thus inducing movement of said rod in an axis parallel to its length on the basis that the longitudinal position of said tightening nut remains fixed relative to the body of the corresponding casting lock. Preferably, a nut and washer arrangement is placed on the end of said rod presenting in the cavity of the casting lock in the adjacent panel. Preferably, the tightening nut in each casting lock is tightened such that tension is created in the threaded metal rod, thus drawing the two connecting edges of the corresponding panels together in compression against one another thus forming a strong connection between the two panels. Preferably, upon reaching the required tension the locking nut in each casting lock of the pair involved is tightened against the tightening nut such that the tightening nut is fixed in position and cannot rotate relative to the threaded metal rod.

Preferably, upon final positioning and tightening being achieved, the void is sealed by injecting a hardening material such that the resultant face is flush with the corresponding face of the respective panel.

In the manner so described, a precise, strong and attractive connection is achieved via the application of the current invention.

In the case of one panel being joined to another at right angles such that its edge of one is butted against the face of the other, preferably the panel presenting the face to the edge of the other incorporates a casting lock configuration as described in the preceding description, which for the purposes of distinction shall be known as the middle casting lock. Preferably, the panel presenting the edge to be joined to the face of the partnering panel incorporates a casting lock assembly designed to accommodate the particular geometry of the right angle join to be effected, such casting lock configuration to be known for the sake of distinction as the corner casting lock.

Preferably the corner casting lock incorporates a manufactured body whose length is substantially equal to the width of its host panel. Preferably, said corner casting lock incorporates a hollow core or channel extending along its entire length such that an aperture is presented at each end of the body. Preferably, said corner casting lock is positioned whereby each of its front and back ends lie precisely flush with the corresponding panel face such that an aperture is presented at each large face of the host panel. Preferably, said corner casting lock is positioned such that said hollow core is aligned with the hollow core of the middle casting lock with which it is to be partnered. Preferably, said corner casting lock contains precise reference markings on its external surfaces to enable precise placement relative to its host panel, the corresponding mould, and relative to the middle casting lock with which it is to be partnered.

Preferably, upon being embedded in its host panel said corner casting lock can accept a threaded rod inserted through its hollow core. Preferably, said threaded rod is of sufficient length to present a segment of its end into the cavity of the middle casting lock to which it is to be partnered. Preferably, said threaded rod incorporates a rounded head of larger diameter than said threaded rod such that the resultant shoulder between said head and said rod prevents said head from entering the hollow core extending the entire length of said corner casting lock. Preferably, said hollow core is of a diameter slightly larger than said rod to permit said rod to be inserted through the hollow core to protrude beyond the corner casting lock body sufficiently to present in the cavity of the corresponding middle casting lock. Preferably, said hollow core is of a diameter slightly larger than said head for a short segment such that said head does not protrude beyond the corresponding end of said corner casting lock when in a tightened configuration. Preferably, said head contains an internal indentation in its top of a shape and depth that presents a means by which a precisely engineered tool can exert significant purchase to enable said threaded rod to be tightened with considerable force. Preferably, a spring washer is positioned between the shoulder of said head and the face created by the hollow core reducing from a particular diameter to a smaller diameter.

Preferably, said threaded rod extends through the hollow core of said corner casting lock and into the cavity of the corresponding middle casting lock. Preferably, a tightening nut is threaded on said threaded rod following placement of a spring washer on threaded rod. Preferably, said nut is held fixed from rotating while an appropriate tool is engaged with the indentations in the head of said threaded rod and used to rotate the rod. Preferably, the rod is rotated until tension is created due to the edge of one panel meeting with the face of the panel to which it is being joined at right angles. Preferably, upon sufficient tension being produced to effect a strong connection between the two panels a locking nut is threaded onto the end of the threaded rod protruding into the cavity of the middle casting lock and wound tightly against the tightening nut such that said tightening nut is fixed in position relative to the threaded rod.

In this manner a panel may be precisely and strongly connected to another precast panel at right angles.

According to a fourth aspect of the invention there is provided a system for forming voids in foundations mounted on soil for receiving building structures, the system comprising a plurality of wafflepod segments, wherein each wafflepod segment comprises a plurality of pods and a base, each pod protruding from the base to define a cavity adapted to receive the soil during expansion thereof.

In a particular arrangement there is provided a system for forming voids in foundations of buildings so as to effectively deal with soil expansion and contraction and reduce the amount of concrete used for a given task. Said voids are created by the placement of wafflepod segments in a pattern within the area to be occupied by the foundation slab prior to the introduction of the concrete. The wafflepod segments are composed of pods integrated with a base, which sits on the ground. Each of the pods forms a hollow three dimensional protrusion from the base, essentially being a deformation of its surface, thus creating a cavity in the concrete slab. The wafflepod segments are so arranged such that the concrete foundation slab incorporates areas uninterrupted by pods thus forming a corresponding arrangement of solid concrete sections that lend load bearing capacity to the slab as a whole. A metal mesh is placed in the mould parallel to the base and situated above the highest point of the wafflepod arrangement but below the upper surface of the slab to act as a reinforcing element. The pods are so designed as to form voids that improve the relationship between the volume of concrete and its strength. The design of the pods is also aimed at improving the ability of the respective foundation block to cope with soil contraction and expansion. Additionally, the design of the wafflepod segments is intended to improve storage, transport, handling and installation.

Preferably, the wafflepod segment is constructed from industrial grade cardboard impregnated with wax or similar ingredient to render it functionally waterproof. Preferably, the wafflepod segment incorporates a base approximately square in shape when viewed from the top. Preferably, the base incorporates a vertically orientated lip at its outer edges and running continually around its entire perimeter such that the base forms a shallow dish, the sunken base of which incorporates the pods.

Preferably, each wafflepod segment contains five pods, one of which is the middle pod with the remaining four being outer pods. Preferably, the outer surface of the pods is continuous with the surface of the base in that the resultant protrusions are essentially deformations of the base. The effect is for the deformations to create voids between the base and the surface on which it is placed.

The base of a pod can be defined as the perimeter around the deformation it forms at the point at which is emerges from the un-deformed base. The area of the base of a pod can be defined as the area defined by its perimeter at the level of the un-deformed base. Preferably, the area of the base of the middle pod is approximately equal to the area of the base of each of the outer pods. Preferably, the combined base area of the five pods occupies approximately 75% of the area of the wafflepod segment base.

The base shape of a pod can be defined as the shape formed by an imaginary line tracing the perimeter of the pod base. Preferably, the base shape of the middle pod is approximately square when viewed from the top. Preferably, the base shape of each outer pod is composed of three identical concave lines forming a triangle, each side of which has been deformed into an identical curve, but not meeting at the corners. Preferably, the end of each concave segment is joined to the closest end of the adjacent segment by a convex segment, thus resulting in a perimeter forming an approximate triangle with concave sides and convex rounded corners.

Preferably, the outer pods are arranged symmetrically around the centre of the segment base. Preferably, the outer pods are arranged such that one corner, to be known as the outer corner, of the pod base is slightly inset from one corner of the segment base, such that each corner of the segment base is associated with one corner of one outer pod. Preferably, each outer pod is so arranged that a line bisecting the angle between the two corresponding sides (from the top view perspective) would also bisect the angle between the two corresponding sides of the segment base.

Preferably, the top surface of the middle pod forms a similar shape to the pod base but with a smaller surface area, thus forming an approximate hollow isosceles trapezoid, the height of which is slightly less than that of the outer pods. Preferably, the top surface of each outer pod is roughly equal in size and shape to the respective pod base with the result that three concave walls are created, essentially corresponding to a three dimensional extension of the outer pod base perimeter. Preferably, the height of the outer pods as measured from the lowest point on the wafflepod segment base is slightly less than the thickness of the foundation block into which it is to be embedded, this margin being sufficient to locate a sheet of reinforcing mesh between the top of the outer pod and the top surface of the respective foundation block.

Preferably, said sheet of reinforcing mesh is placed parallel to the surface of the foundation block (and therefore parallel to the largest face of the wafflepod segment base). Preferably, said reinforcing mesh is located slightly above the top surface of the outer pods with respect to the large surface of the foundation block. Preferably, said reinforcing mesh is positioned in the foundation block mould by resting on a series of spacer chairs, with each spacer chair being directly associated with a middle pod.

Preferably, said spacer chair incorporates a body known as the spacer chair seat supported by four legs which are connected to each other by cross struts so as to prevent the legs spreading relative to each other beyond their desired configuration. Preferably, said seat incorporates a threaded hole into which a multi-clip body can be inserted. Preferably, said multi-clip body incorporates two pairs of clips arranged such that each pair of clips attach to the rods of the reinforcing mesh, such rods being arranged in a two sets of multiple parallel rods, with each set of parallel rods being orientated at right angles to one another such that the mesh is composed of a regular series of rectangles, the perimeter of which is formed by the respective rods. Preferably, the four legs of the spacer chair are so arranged as to allow the spacer chair to sit over a middle pod such that the spacer chair seat is located slightly above the height of the surrounding outer pods and the seat centre is approximately vertically aligned with the centre of the respective middle pod.

It has been described in preceding content that the wafflepod segment base forms a shallow dish, the larger part of which is deformed to create the pods that will form voids in the host foundation block. The wafflepod segment base is so designed such that its perimeter is composed of a vertically orientated lip. For purposes of description, the lip corresponding to each side of the wafflepod segment base can be said to form a connecting edge, such that each wafflepod segment base incorporates four connecting edge. Preferably, each connecting edge incorporates two small sections in which the lip is widened so as to form a bulge, which can be known as an edge locator.

Preferably, wafflepod segments may be connected to each other by means of butting the edge of one to the edge of another with the ends of each being in line with the corresponding ends of the other. Preferably, the edges are held together by placing an inverted U connector strip over both edges. Preferably, said connector strip is approximately the length of the edges to be joined. Preferably, said strip is formed of a solid body that incorporates a channel along its entire length. Preferably, said channel is of a width and depth such that it fits neatly and tightly over the lips of the two connecting edges being joined. Preferably, said channel is flared such that the location and shape of the flare corresponds to the edge locators of the two edges being joined. By this means, the edges are fixed relative to each in three dimensions. Each wafflepod segment can be joined to other wafflepod segments along any and all of its four edges. In this fashion, multiple wafflepod segments may be combined to form voids in the host foundation block in any arrangement desired.

According to a fifth aspect of the invention there is provided a support structure comprising first and second meshes and at least one body sandwiched between the meshes, wherein the body comprises means for fastening the body to the meshes.

In a particular arrangement there is provided an integrated and unified construction body composed of a steel framework that determines the boundaries of the construction body and fixes a series of hollow spheroids precisely in relation to one another such that the injection or introduction of a hardening material, such as concrete, creates a closed structure containing a regular series of continuous hardened material in the spaces between the spheroids, thus forming a series of internal pillars that provide the structure with load bearing capability. The dimensions of the spheroids and their placement within the three dimensional boundary produces a load bearing capacity equivalent to that which would be obtained without the spheroids, but with significantly less material.

The principal elements that form the integrated construction body are reinforcing mesh, truss assemblies, hollow spheroids, bottom connector chairs and top connectors.

The reinforcing mesh is typically made of steel but not restricted to it, the criteria simply being strength and durability. The reinforcing mesh is composed of a series of small diameter rods that form a grid of rectangles or squares.

The truss assemblies are typically made of steel but not restricted to this material, the criteria being strength, durability and other properties required by engineering and manufacturing considerations. The truss assemblies are composed of small diameter rods. Three rods are arranged such that all are parallel in the longitudinal direction, with one rod elevated in the vertical dimension relative to the two lower rods, both of which are preferably at the same vertical elevation as each other. The degree of elevation of the top rod is a function of the design criteria and the diameter of the spheroids to be placed within the construction body. The rods are fixed in place relative to each other by means of a small diameter rods that connect one rod to another in such a manner that the top rod is connected to each bottom rod at a number of points sufficient to produce the required rigidity and at an angle when viewed in the cross section that results in the correct horizontal spacing between the two bottom rods in the cross section. Rods may also be used to connect the bottom rods to each other if required.

The hollow spheroids are composed of two segments that when aligned and joined together form an internal void that is spheroid in shape. Each segment thus contains a face that represents a hollow disk when viewed from the top, the outer circumference being identical to the outer circumference of the partial spheroid at the point of dissection and the inner circumference being parallel to the outer circumference and inset by an amount equal to the thickness of the material at the point of dissection. For the purposes of clarity this may be referred to at the seating face.

The face of the lower partial spheroid contains a protrusion following its inner circumference and extending upwards a short distance relative to the face thus forming a continuous lip. The thickness of the material of the lower partial spheroid in the area of dissection is greater than the thickness of material of the upper partial spheroid in the area of dissection. The design is such that the exposed seating face of the lower partial spheroid is of equivalent width to the seating face of the upper partial spheroid. The result is that the upper partial spheroid fits tightly over the lip of the lower partial spheroid with the effect that the two segments are fixed in the lateral direction relative to each other.

The protruding lip of the lower partial spheroid forms a face approximately vertical to the seating face, which for the sake of clarity may be called the vertical face. The vertical face contains one or more protrusions approximately perpendicular to it, the thickness of the protrusions such that the resulting outer face of the protrusion is flush with the outer surface of the lower partial spheroid. The width of each protrusion and its shape are discretionary within the constraints of engineering and manufacturing requirements and limitations. Notches with dimensions and locations corresponding precisely to the protrusions are incorporated into the upper partial spheroid such when the two segments are joined to form a spheroid the notches fit precisely over the protrusions. The effect is to fix the two segments relative to each other with respect to rotation.

The vertical face of the lower partial spheroid contains one or more protrusions approximately perpendicular to it. The outer face of the protrusions form a slope such that the thickest part of the protrusion lies closest to the seating face but does not coincide with it. The width and shape of the protrusion is discretionary within the constraints of engineering and manufacturing requirements and limitations. Indentations with dimensions and locations are incorporated into the inner surface of the upper partial spheroid such that when the two segments are joined the indentations fit precisely over the protrusions. The protrusions do not extend to the seating face and therefore include a face parallel to the seating face. Similarly, the indentations do not extend to the seating face of the upper partial spheroid and therefore present a face parallel to the seating face. The slope of the protrusions and the corresponding slope of the indentations do not intersect until the seating faces of the two partial spheroids intersect, thus representing a resistance immediately prior to joining. The material of which the partial spheroids are composed is selected such that there is sufficient compressibility to allow for this resistance to be overcome without requiring the application of undue force. The result is that the protrusions and indentations click together such that the end face of the indentation sits tightly against the end face of the corresponding protrusion. The effect is to fix the two segments relative to each other with respect to separation.

By the means so described, the two partial spheroids are prevented from sliding laterally relative to each other, rotating relative to each other and separating from each other with the effect that a complete hollow spheroid is created.

A set of protrusions are integrated with the outer surface of each partial spheroid. Each protrusion incorporates a hollow channel, of which the cross section profile corresponds to the cross section profile of the bottom reinforcing mesh rods. Preferably, the protrusions are located relative to each other and to the surface of the respective partial spheroid in two pairs such that each pair can accept the insertion of a particular rod of the reinforcing mesh, and that the alternative pair engages precisely with another rod of the reinforcing mesh. The protrusion pairs of each partial spheroid are positioned such that when the two segments are joined to form a complete spheroid the channels coincide precisely with the location of the reinforcing mesh rods, both in the horizontal and vertical dimensions. By this means, the spheroids are fixed to the top and bottom reinforcing mesh structures.

The bottom connector chairs are constructed of a light, strong material. Integrated into the structure are a pattern of protrusions, the extremities of which are in line with each other in the horizontal dimension such that they elevate the body of the structure from the surface on which it is placed. In this fashion, the protrusions function as legs.

Additionally, the structure contains protrusions emanating from the body in an approximate perpendicular manner. One set of protrusions is located at each end of the length of the structure, with another set of protrusions located inwards from the outer set at each end. The space between the inner and outer protrusions at each end corresponds precisely with the diameter of the rods forming the bottom reinforcing mesh to be integrated with the bottom connector chairs. The inner set of protrusions at each end incorporate a groove facing toward the centre of the structure and running along the corresponding face of the inner protrusion. The cross sectional profile is formed to correspond precisely with the rods forming the truss assembly to be integrated with the bottom connector chairs. The length of the structure and the location of the upright protrusions are designed such that the outer channel corresponds precisely with the pattern of rods in the bottom reinforcing mesh and the inner grooves correspond precisely with the desired placement of the truss assembly in relation to the bottom reinforcing mesh.

A set of substantially flexible straps composed of strong material are integrated with the body of the structure at a location slightly inside of the innermost faces of the inner protrusions. Slots are incorporated into the upright protrusions such that the straps can be passed through the slots with the effect of holding the rods of both the bottom reinforcing mesh and the truss assemblies in place relative to the body of the structure. The straps may be locked into place by mechanical means, the design of which is discretionary but constrained by engineering and manufacturing requirements and limitations. By such means as just described, a structure is obtained that can fix the bottom reinforcing mesh in relation to the truss assemblies and can elevate the bottom reinforcing mesh from the surface on which the construction body is to be placed.

The top connector locators three main components, which are the top locator nut, the intermediate locator disk and the bottom locator stem. The top locator nut incorporates a threaded cylindrical indentation in its bottom face running vertically and extending a distance less than the height of the top locator nut. Additionally, the top locator nut incorporates a solid unthreaded stem of a small diameter than the indention and protruding from the top of the top locator nut, parallel to and within the threaded indentation. The unthreaded stem extends to a position slightly offset from the bottom face of the top locator nut. The top locator nut incorporates a set of outer faces that facilitate engagement with an appropriate tool such that sufficient tightening force can be applied.

The intermediate locator disk incorporates a hollow centre, the diameter of which is slightly larger than that of the threaded indentation in the top locator nut. The thickness of the intermediate locator disk is greater than the combined thickness of the top reinforcing mesh rods and top truss rod to be engaged. The intermediate locator washer incorporates two sets of notches through the wall created by the hollow interior and the outer face. Each set of notches is a pair. One element of the pair is placed at the extreme opposite of its corresponding partner such that a line drawn through their centres across the hollow interior would pass through the centre of the intermediate locator washer. The alternative set of notches is positioned similarly but in an orientation that would see a line through their centres intersecting the corresponding line of the other set of notches at right angles. The cross sectional profile of one set of notches is designed to correspond with the cross sectional profile of the bottom reinforcing mesh rods, while the cross sectional profile of the alternative set of notches is designed to fit over a truss rod placed on top of a bottom reinforcing mesh rod.

The bottom locator stem incorporates four straight threaded bars emanating from a solid base. Preferably the base is circular in shape so as to form a solid disk. Each threaded bar is curved across its width. The threaded bars are positioned such that a bottom reinforcing mesh rod can be placed snugly between them in one direction and that a bottom reinforcing mesh rod and the top rod of a truss assembly can both be placed, one on top of the other, snugly between them at right angles to the bottom reinforcing mesh rod. The length of the threaded bars is such that when the top locator nut is threaded to the maximum extent onto the bottom locator stem that has had the intermediate locator disk placed over it and has had the respective rods placed in their corresponding channels the unthreaded stem of the top locator nut places a compressive force on the rods.

By such means an arrangement is obtained by which the top reinforcing mesh is fixed precisely to the truss assembly.

The present embodiment of the invention comprises a displacement system, which solves several existing problems concerning the need for the hollow spheroids to remain rigidly fixed relative to each other against forces due to transport and installation that have the potential to move the spheroids relative to one another. In particular, the current invention solves the problem of the spheroids moving relative to one another due to the flotation forces produced when liquid or semi liquid hardening material such as concrete is injected into the spaces between the hollow spheroid elements.

In a particular arrangement the displacement system provides for displacement volumes in order to produce a structure that offers a uniform set of load bearing sites within the hardened composite materials. To that end, the spacing system that is part of the current invention fixes the hollow spheroids, each of which creates a single displacement volume, in a desired pattern. This facilitates transport of the system in bodies that are of a width and length suitable for the respective transport system, the thickness of the body being a function of its intended use. The advanced spacing system also enables swift and accurate installation of the construction body.

A construction body is therefore obtained, which reduces the amount of hardening material required for the given application, thereby reducing cost as well as enabling larger spans due to the weight reduction thus achieved.

The construction body can be implemented horizontally, vertically or slanted in such a manner as to fit with curved walls and roofs or complex slab on ground configurations. The construction body can be filled with hardening or non-hardening material on the building site or in a factory.

The hollow spheroids contain air, which behaves as insulation. The effect can be enhanced by adding insulation material in the spheroids. Insulating material may also be placed in the spaces between the spheroids.

According to a sixth aspect of the invention there is provided a screw pile for receiving a load, the screw pile comprising a shaft having a proximal end and a distal end, and a bit attached to the distal end of the pile, wherein the shaft comprises a plurality of helical plates arranged in a spaced apart relationship along the shaft.

In a particular arrangement there is provided a blade bit securely attached to the end of a metal shaft to which a series of helical bearing plates are attached. The metal shaft incorporates a threaded bush at the end opposite to the blade bit. The entire assembly forms what will be known in this specification as a blade pile, which has the principal purpose of transmitting the load from a building foundation to a suitably strong strata beneath the surface of the ground on which the foundation is laid. Alternatively, the blade pile may be used to create a ground anchor to which tension can be applied in order to tie down a construction body. Preferably, in both the compression and tension applications, the blade pile shares the construction burden with other blade piles in such a manner as to provide sufficient load bearing force for the task at hand.

Preferably, the blade bit incorporates a metal body that can be said to have a top and a bottom. The bottom of the blade bit body is that which corresponds to that end of the blade pile that occupies the deepest position with respect to the surface of the soil in which it is being applied. The top of the blade bit body lies closer to the soil surface than the bottom of the blade bit body when the blade pile is in a working orientation. The term "lower", when used in reference to a blade pile, refers to a location along the blade pile that is closer to the bottom of the blade bit bottom than the point that is being referenced in the description that utilises the term.

Preferably, the blade bit body forms a cylinder that has two diameters, which can also be considered to be two cylinders of different diameters formed from one continuous metal element. Alternatively, each cylinder may be formed from a separate metal element and the two cylinders joined so as to produce a body composed of a lower cylinder that is of a greater diameter than the upper cylinder attached to it. Preferably, the two cylinders are in line and share a common centre such that one is concentric to the other from a top view perspective. Preferably, the blade bit body is composed of a high grade steel.

Preferably, the bottom of the lower cylinder forms a cone.

Preferably, the lower cylinder of the blade bit body incorporates a series of indentations orientated in line with the longer axis of the cylinder. Preferably, the indentations are regularly spaced around the circumference of the lower cylinder. Preferably, the length of each indentation, being its measure along the longer axis of the cylinder, extends from a point slightly below the top of the lower cylinder through the bottom of the lower cylinder, such that the lower edge of the indentation is coincident with the lower edge of the bottom cylinder. Preferably, the indentation forms a segment of a circle or ellipse when viewed in the cross section across its width. The overall effect is that each indentation forms a scallop in the edge of the bottom cylinder from the perspective of the bottom view, and forms a groove with an open face at the bottom from the perspective of a side view. Preferably, the function of the groove or indent is to facilitate the passage of the blade bit through soil by reducing the friction between the soil and the blade bit.

Preferably, a series of blades are attached to the surface of the lower cylinder of the blade bit body. Preferably, each blade is composed of a high grade steel.

Preferably, the blades are spaced evenly around the circumference of the lower cylinder. Preferably, the blades are so shaped as to follow the contour of the lower cylinder along its longer axis such that the bottom of the blades meet at the small diameter end of the cone formed by the bottom face of the lower cylinder. Preferably, the blades are so shaped that a point, being a small diameter face, is formed at the lower end of the bit so as to facilitate penetration into the soil by the bit.

Preferably, the blades are shaped so as to each form a cutting edge along its outer contour relative to the lower cylinder of the blade bit body. Preferably, the face formed between the cutting edge and the surface of the lower cylinder and orientated in the direction of rotation is flat and parallel to a line drawn from the centre of the tip of the respective blade, at right angles to the vertical axis of the lower cylinder, and through the centre of the lower cylinder such that the vertical axis of the face is aligned with the vertical axis of the lower cylinder and projects directly outwards from the surface of the lower cylinder. This is called the leading face.

Preferably, the outside edge of the blade is as narrow as engineering and manufacturing constraints permit so as to present minimal friction with the soil when the blade bit is rotated. Preferably, the contact face, being the face that forms the connection with the surface of the lower cylinder, is wider than the edge of the blade so as to present a sufficient area of contact between the blade and the bit body. The result is that the trailing face is at an angle to the leading face.

Preferably, each blade is strongly welded to the lower cylinder of the bit body.

Preferably, the upper cylinder of the bit body incorporates a series of roughly rectangular indentations in the face, with the longer dimension of the indentation aligned with the longer axis of the blade bit. Preferably, such indentations are regularly spaced around the circumference of the upper cylinder. Such indentations are designed to accept metal tabs inserted through corresponding slots in the shaft so as to greatly increase the strength (with reference rotational forces) of the connection between the bit and the shaft.

Preferably, the current invention incorporates a shaft that is in the form of a rod composed of high strength steel and of a diameter appropriate to the bit size and the rotational, bearing and tensile forces it must endure. The lower end of the shaft is that which connects to the blade bit. Preferably, the lower end of the shaft incorporates a hollow section of a diameter practically equal to the diameter of the upper cylinder of the blade bit such that the lower end of the shaft is able to slide over the upper cylinder of the blade bit. Preferably, the lower end of the shaft incorporates slots corresponding in shape and position with the indentations in the upper cylinder of the blade bit. Preferably, metal tabs are inserted through these slots and seated in the indentations, such that the tabs can be welded to the slots in the shaft, thus fixing them in place. By such means a strong connection is achieved between the shaft and the bit.

Preferably, the upper end of the shaft incorporates a hollow section. Preferably, a threaded bush is inserted into such hollow section and welded firmly to the shaft such that the upper end of the shaft presents a threaded aperture into which extension shafts can be threaded or threaded rods attached to bearing plates can be threaded. Preferably, the upper end of the shaft incorporates a series of slots that provide access to the surface of the inserted threaded bush and enable welded connections between the bush and the shaft.

Preferably, the upper end of the shaft incorporates a series of tabs welded to the outer surface such that they form protrusions. Preferably, the machine applying torque to the blade pile incorporates an apparatus that fits over the protruding tabs in such a way as to form a strong rotational connection with the shaft.

Preferably, the current invention incorporates a series of helical bearing plates spaced at discretionary intervals along the length of the shaft. Preferably, the helical bearing plates are of such diameter that a series of lines drawn between the outer edge of a bearing plate to the outer edge of the bearing plate adjacent to it and closer to the upper end of the shaft would collectively form the shape of a cone when viewed from the side with the shaft in vertical orientation. That is, the closer a bearing plate is to the upper end of the shaft, the larger its diameter.

Preferably, each helical bearing plate incorporates a base plate and a series of cutting blades. Preferably, each base plate forms a circular shape when viewed from the top and incorporates a hole in its centre with a diameter practically equal to the diameter of the shaft. Preferably, the base plate does not form a complete circle. Preferably, each base plate forms a partial helix when viewed from the side.

Preferably, each helical bearing plate incorporates a series of cutting blades spaced evenly around its circumference such that minimal gaps exist between the respective ends of the blades. Each cutting blade has a cutting edge, being that facing the direction of rotation, and a trailing edge. Preferably, the leading edge of the cutting blade is oriented such that its longer axis is almost at right angles to the base plate. Preferably, the leading edge of the blade is longer than the trailing edge. Preferably, the shape of each blade is such that the trailing edge is slightly inset towards the centre of the base plate thereby exposing the leading edge of the following blade (when viewed in a direction opposite to the rotation). Thus, the helical bearing plate exposes a series of cutting edges in the direction of rotation.

By such means as described, the screw pile can efficiently penetrate soil by virtue of the comprehensive blade bit and can contend with obstacles such as boulders and gravels without deviation. By such means as described, the helical bearing plates encourage penetration while holding the shaft vertical and positioning the shaft firmly in its required place upon reaching the target depth. By such means as described, the screw pile can have extension shafts attached if required. By such means as described, the screw pile can accept bearing plates via threaded stems so as to interface with the corresponding foundation and offer compressive and tensile strength as the situation may require.

Preferably, the current invention incorporates a cap, the function of which is to slide over the top of the screw pile shaft and present a surface on which the footings for the foundation may rest or over which the footings may be poured. The main body of the cap forms a frustum of a cone with an open end at the bottom. The closed upper end is formed by a circular face parallel to the end planes of the frustum and situated a slight distance downwards from the top of the body. Emanating upwards from this face is a further frustum, sharing a vertical axis with the face, with the top plane being a slightly larger diameter than the bottom plane. The result is a continuous cavity with an open face orientated towards the top and being of a smaller surface area than the closed face that is coincident with the face of the cap body. Concrete poured into said void will form a solid of which the bottom portion cannot slide over the inner frustum described, thus ensuring a permanent and fixed bond between the footing and the respective screw pile.

The hollow lower portion of the cap body incorporates a cylinder, the bottom of which presents an open face lower than the bottom of the cap body. The inside diameter of said internal cylinder is practically similar to the outside diameter of the screw pile shaft. Notches in the internal face of the internal cylinder correspond to tabs protruding from the shaft such that a direct connection between cap and the shaft, in the rotational aspect, can be achieved.

Preferably, the outside diameter of said lower internal cylinder is smaller than the inside diameter of the body, thus forming a continuous void with an open face orientated downwards. Preferably, a series of partitions regularly spaced around the circumference of the cap body each extends from the inside surface of the body to the outside surface of the internal lower cylinder thus forming a series of voids each with its face open towards the bottom. Incorporating said cap in the foundation footing produces a further solid bond between the screw pile cap and the foundation by virtue of the concrete filling said voids.

By this means as described above, said piling cap presents an element by which each respective screw pile may be firmly integrated with the foundation via incorporation in the footings.

According to a seventh aspect of the invention there is provided a system for erecting a building structure, the system comprising a foundation for receiving the building structure, and a plurality of inner and outer walls, roof and floor panels, the panels being adapted to engage each other for defining at least one story of the building structure, wherein the foundation comprises a first section and a second section, the first section being adapted to bear the load of the building structure and the second section being adapted to provide access to the interiors of the building structure.

Preferably, the second section is elevated with respect to the first section.

Preferably, the second section is adapted to receive a plurality of piles for supporting the building structure.

Preferably, the piles are arranged in a spaced apart relationship with respect to each other extending over the first section.

Preferably, the first section comprises a plurality of areas, each area comprising a set of piles.

Preferably, at least one area comprises means to account for the volume variations (such as expansion or contraction) of the soil on which the foundation rests.

Preferably, the means to account for the volume variations comprises a pod system in accordance with the fourth aspect of the invention.

Preferably, at least one second area comprises a concrete casting to define a footing.

Preferably, the first section at least partially surrounds the second section.

In a particular arrangement, the second section further comprises two first and second areas, and a path.

Preferably, the path and the perimeters of the first and second areas comprise concrete casting to define the footing.

Preferably, each of the first and second areas comprises sub-divisions comprising concrete casting to define inner footings within the first and second areas.

Preferably, the inner footings being adapted to receive the load of structures.

Preferably, the structures comprise elevator, staircase or services and pluming shafts.

Preferably, the foundation comprises concrete casting to define a platform for receiving the building structure.

Preferably, the inner walls comprise at least one panel in accordance with the first aspect of the invention.

Preferably, the panels of the inner walls are joined together via a mechanical joint in accordance with the third aspect of the invention.

Preferably, the outer walls comprise at least one panel in accordance with the second aspect of the invention.

Preferably, the panels are joined together via a mechanical joint in accordance with the third aspect of the invention.

Preferably, the roof and floor panels comprise at least one floor panel in accordance with the fifth aspect of the invention.

Preferably, the piles comprise screw piles in accordance with the sixth aspect of the invention.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
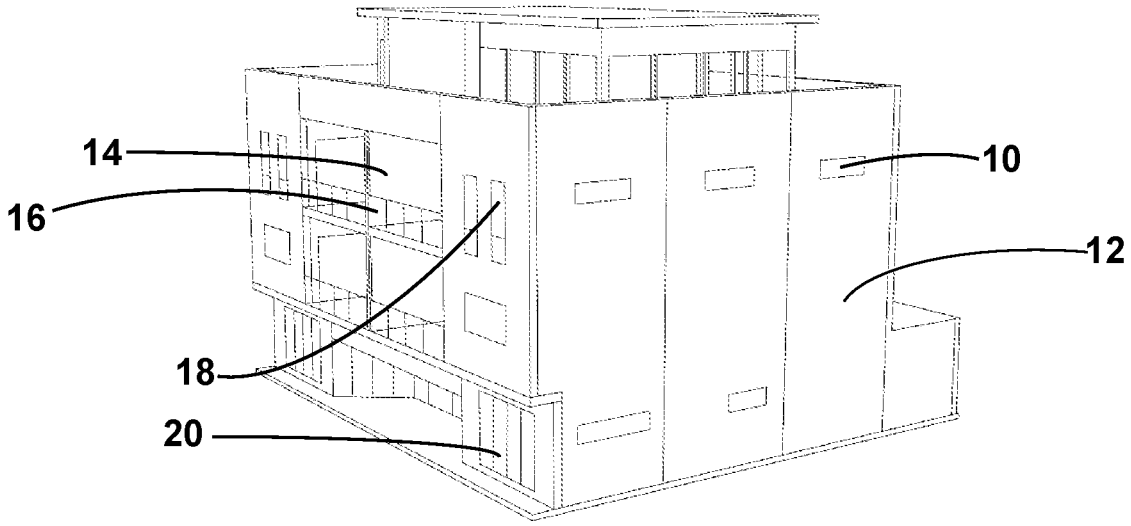
FIG. 1 is a schematic perspective view of a building structure in accordance with an embodiment of the invention.

FIG. 1 shows a particular arrangement of a building structure 10 in accordance with the present embodiment of the invention. The building structure 10 comprises a plurality of components that when assembled together define the building structure 10. These components include outer panels 12 and inner panels 14. The outer panels 12 include windows 18 and fixtures such as balcony barriers 16. In a particular arrangement the components and fixtures may be fabricated off site; in other arrangements they may be manufactured on site.

Figure 2:
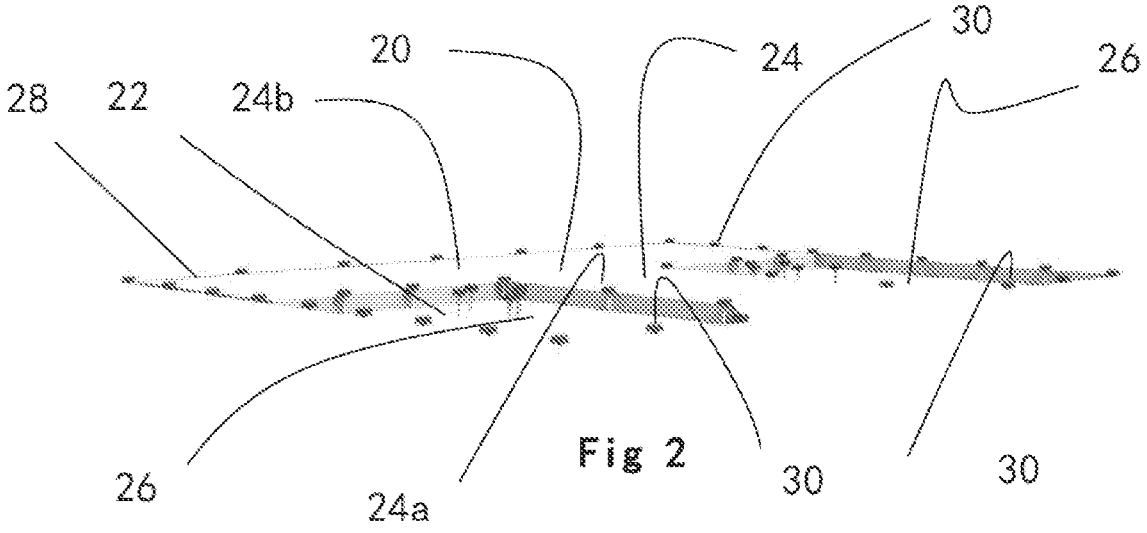
FIG. 2 is a schematic perspective view of the foundation of the building structure shown in FIG. 1 prior casting of the foundation.
Figure 3:
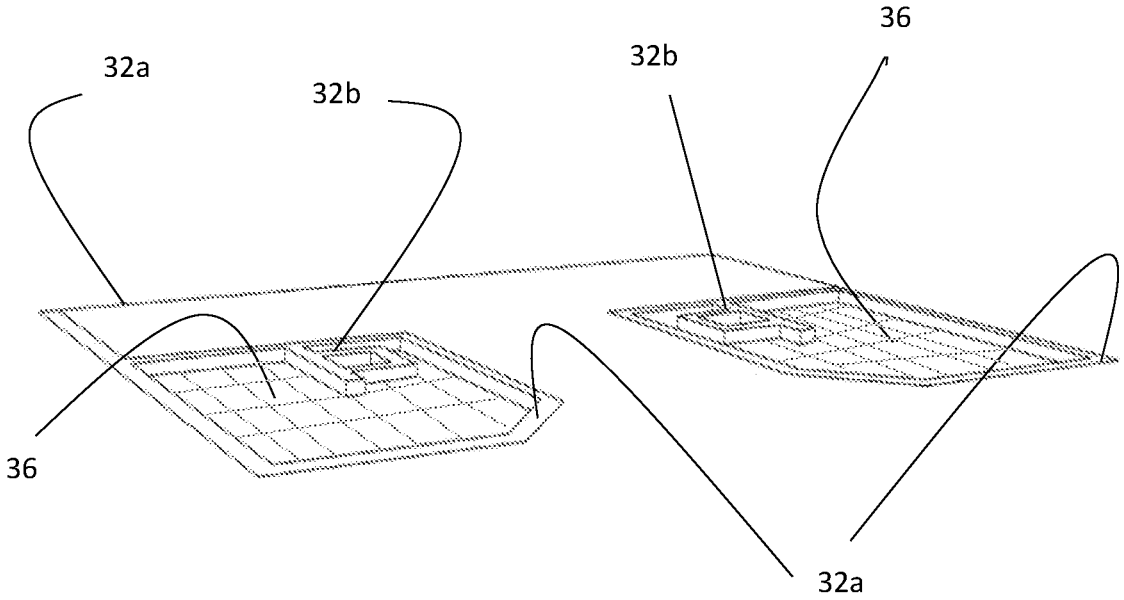
FIG. 3 is a schematic perspective view of the foundation of the building structure shown in FIG. 2 prior casting of the building structure incorporating means for forming voids in the foundation to account for soil expansion.

Further, the building structure 10 rests on a foundation 20. FIGS. 2 and 3 show the foundation 20 prior casting of the foundation 20.

The particular foundation 20 of the present embodiment of the invention comprises two sections 22 and 24. The section 22 is adapted to receive the load of the building structure 10 (referred to also as the load bearing section 22).

In the particular arrangement shown in the figures, the section 24 is T shaped having a longitudinal section 24*a* and a transversal section 24*b*. The section 22 partially surrounds the inner section 24. In particular, the section 22 comprises two areas 26 and a path 28. The two areas 26 are adjacent the longitudinal section 24*a* and the path 28 surrounds the transversal section 24*b*.

The two areas 26 and the path 28 are embedded into the ground such that the section 24 is elevated with respect to the section 22.

As mentioned earlier the section 22 is adapted to bear the load of the building structure 10. For this, a plurality of piles 30 is included in the section 22. The piles 30 are adapted to receive the load of the building structure 10. In a particular arrangement of the present embodiment, the piles 30 comprise the piles as shown in FIGS. 49 to 53 in accordance with the present embodiment of the invention.

We refer now FIG. 3.

As shown in FIG. 3, footings 32 are added to the section 22. The footing 32 provides a support surface for the cast to define the foundation 20. In the particular arrangement shown, the footings 32*a* cover the path 28 and the perimeter of the section 22. A footing 32*b* covers a particular section of the areas 26 of the section 22. The footings 32*a* are adapted to receive the outer side walls of the building structure 10. The footings 32*b* are adapted to receive shafts 34 (see FIG. 4). The shafts 24 may serve as elevator and staircase shafts to provide access to the upper storeys of the building structure 10.

Further, each section 26 of the sections 22 comprises a wafflepod system 36. As will be described at a later stage, the wafflepod slab 36 is adapted to define a plurality of voids and cavities for saving concrete during casting of the foundation 20 and to account for soil expansions and movement of the ground. In a particular arrangement of the present embodiment, the wafflepod system comprises the wafflepod system as shown in FIGS. 35 to 40 in accordance with the present embodiment of the invention.

We refer now to FIGS. 4 to 8. FIGS. 4 to 8 show the erection process of the building structure 10 shown in FIG. 1.

Figure 4:
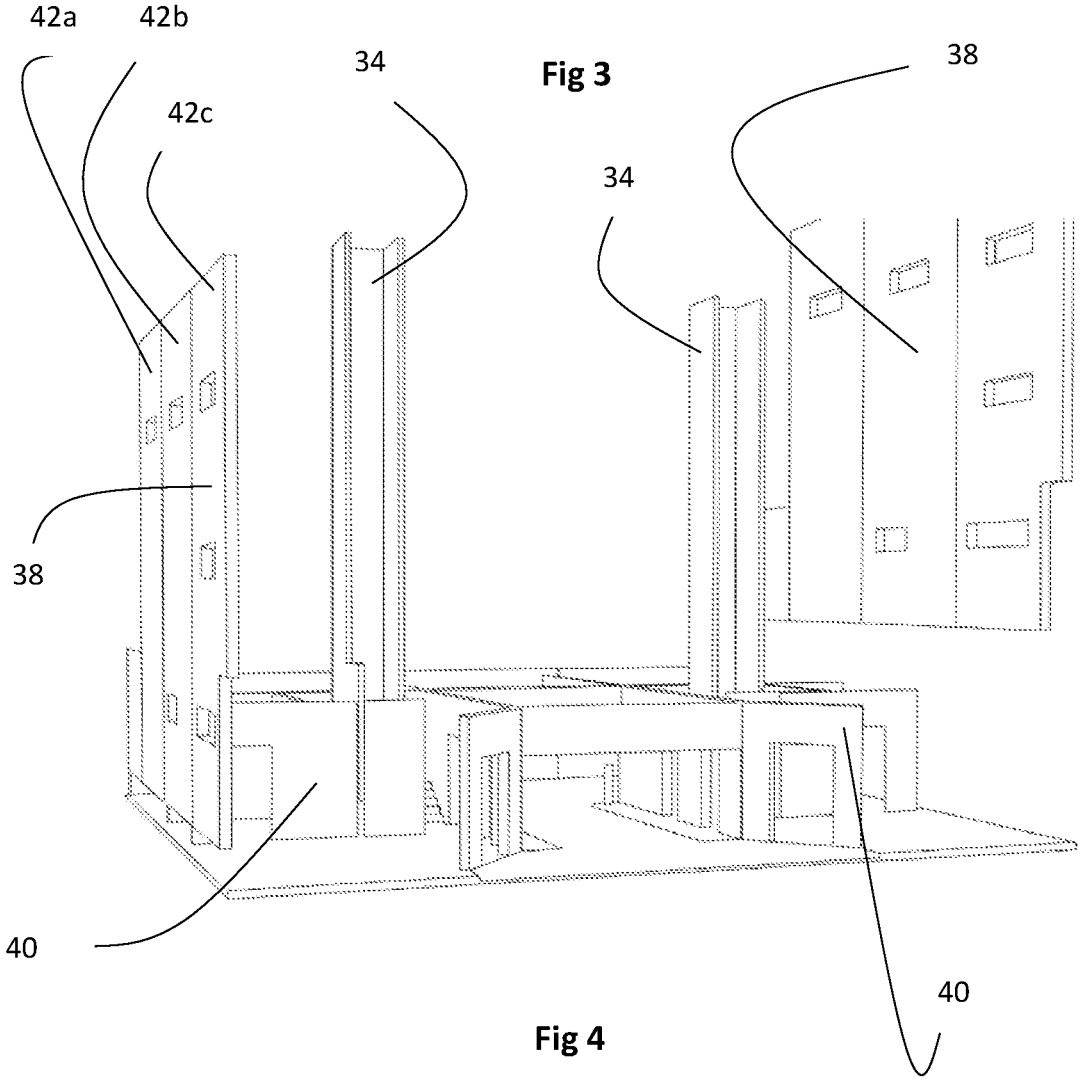
FIG. 4 is a schematic perspective view of the process of erecting the ground floor of the building structure shown in FIG. 1.

FIG. 4 shows the assembly process of the ground floor of the building structure 10. The first story is assembled by installing onto the foundation 20 outer and inner walls 38 and 40. Shafts 34 are mounted on footings 32*b*.

The inner and outer walls 38 and 40 are defined by panels that are adapted to be joined together to define the walls 38 and 40. As shown in, for example, FIG. 4, the side outer walls 38 are defined by three panels 42*a*, 42*b* and 42*c*. The inner walls 40 are defined also be a plurality of panels 42 that are adapted to be joined together. In a particular arrangement of the present embodiment, the inner panels may be the panels as shown in FIGS. 9 to 19 and the outer panels may be the panels shown in FIGS. 20 to 28 in accordance with the present embodiment of the invention.

Figure 5:
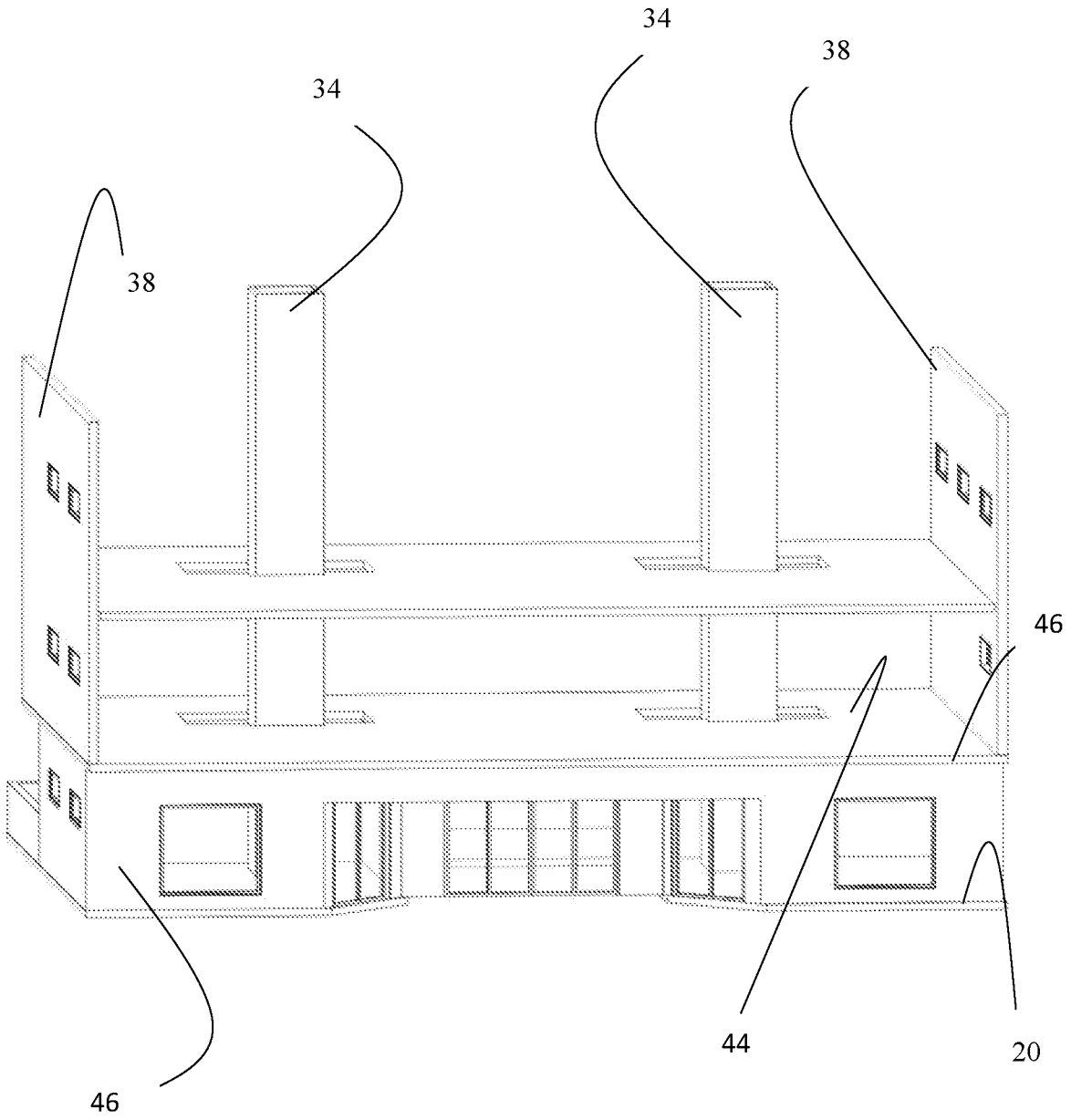
FIGS. 5 and 6 are schematic perspective views of the process of erecting the second and third story of the building structure shown in FIG. 1.
Figure 6:
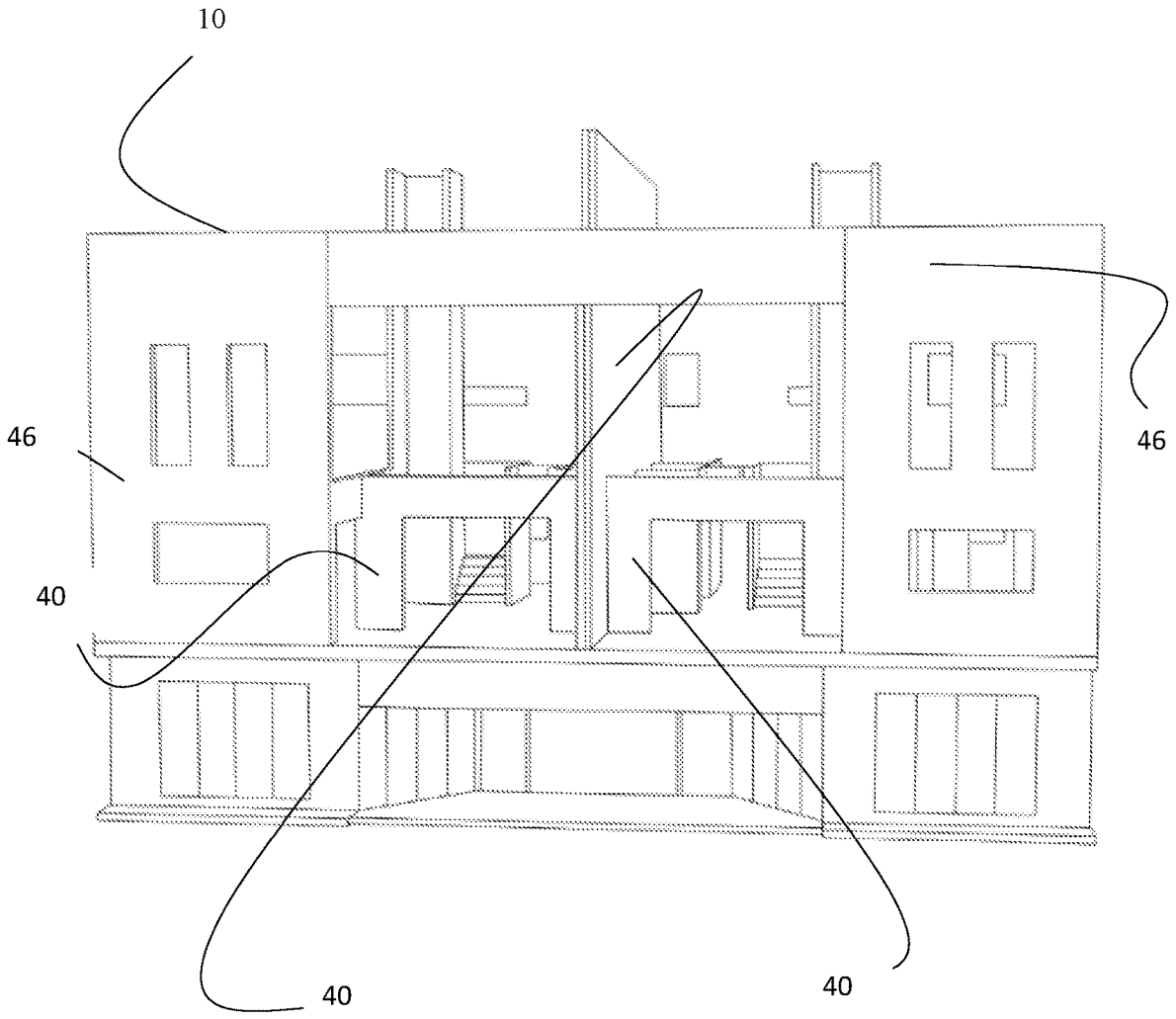

FIGS. 5 and 6 show installation of the first and second storeys of the building structure 10. The process for installing the first and second storeys includes providing the roof and floor structures of the first and second storeys.

As shown in FIG. 5, the roof and floor structures of the first story are provided by a floor panel 44 that covers the ground floor of the building structure 10. After installation of the floor panel 44 a layer of concrete is poured over the floor panel 44 to form the floor of the first story. At this stage, the inner walls 40 of the second story and the rear and front outer walls 46 are mounted on the floor panel 44.

Figure 7:
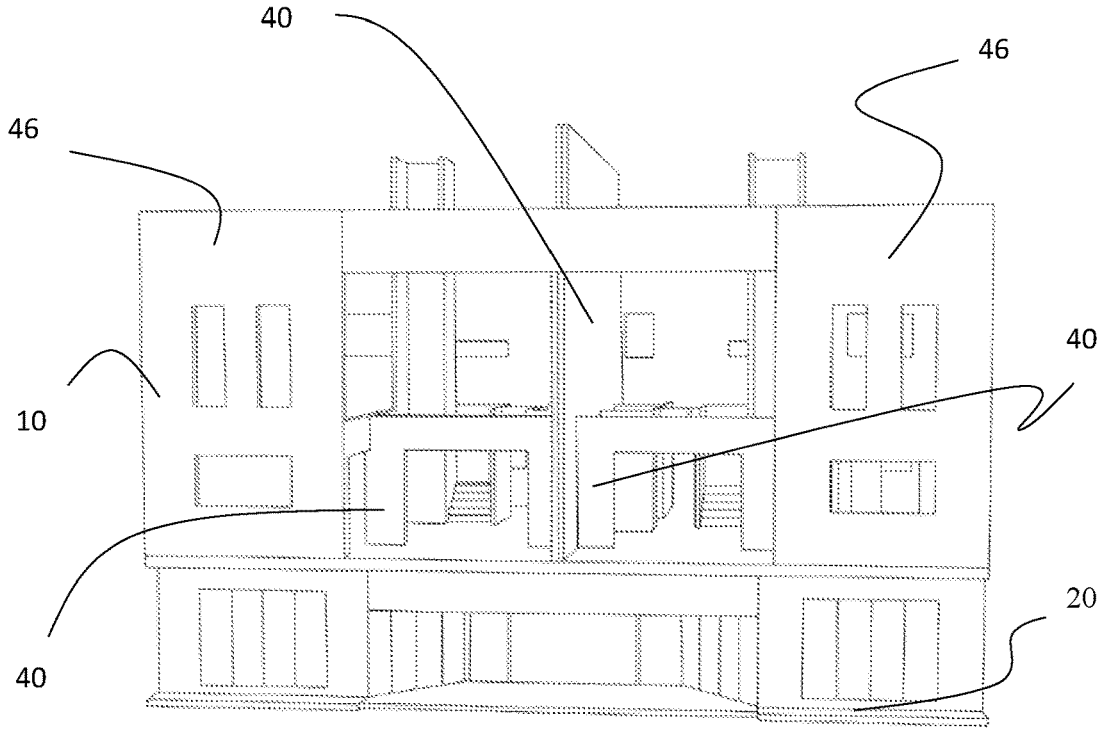
FIG. 7 is a schematic perspective view of the building structure shown in FIG. 1 including the ground floor, the first story and second story.

As can be appreciated in FIGS. 6 and 7, the third story is erected via a floor panel 44 to define, respectively, the roof and floor structures of the second and third storeys and via inner wall panels 40 as was described in relation to the second story.

Figure 8:
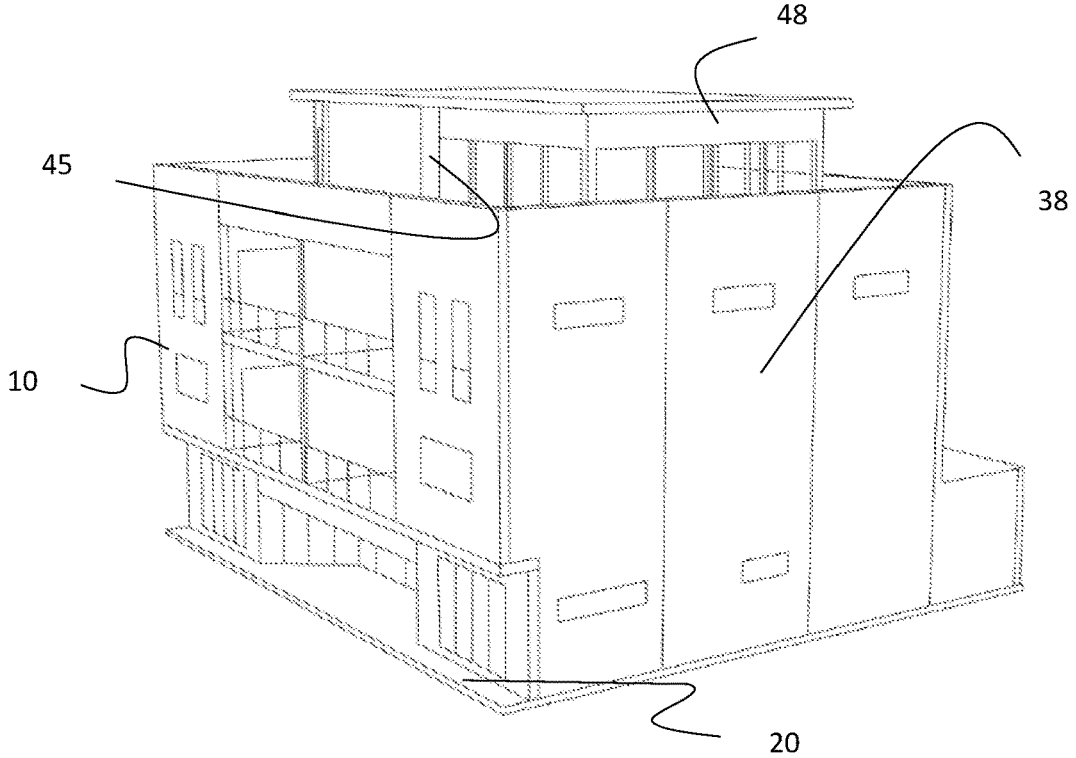
FIG. 8 is a schematic perspective view of the building structure shown in FIG. 1 including the upper story.

Referring now to FIG. 8, the fourth story is erected via a floor panel 44 to define the roof and floor structures of the third and fourth storeys and via inner wall panels 46 as was described in relation to the second and third story. The fourth story comprises a roof panel 48.

To finalise the building structure 10 as shown in FIG. 8 windows and fixtures such as the balcony barriers 16 are added in order to finalise the building structure 10 shown in FIG. 1.

In a particular arrangement of the present embodiment, the panels that define the floors and roofs of the first to fourth storeys are the floor panels as shown in FIGS. 41 to 48 in accordance with the present embodiment of the invention.

Figure 53:
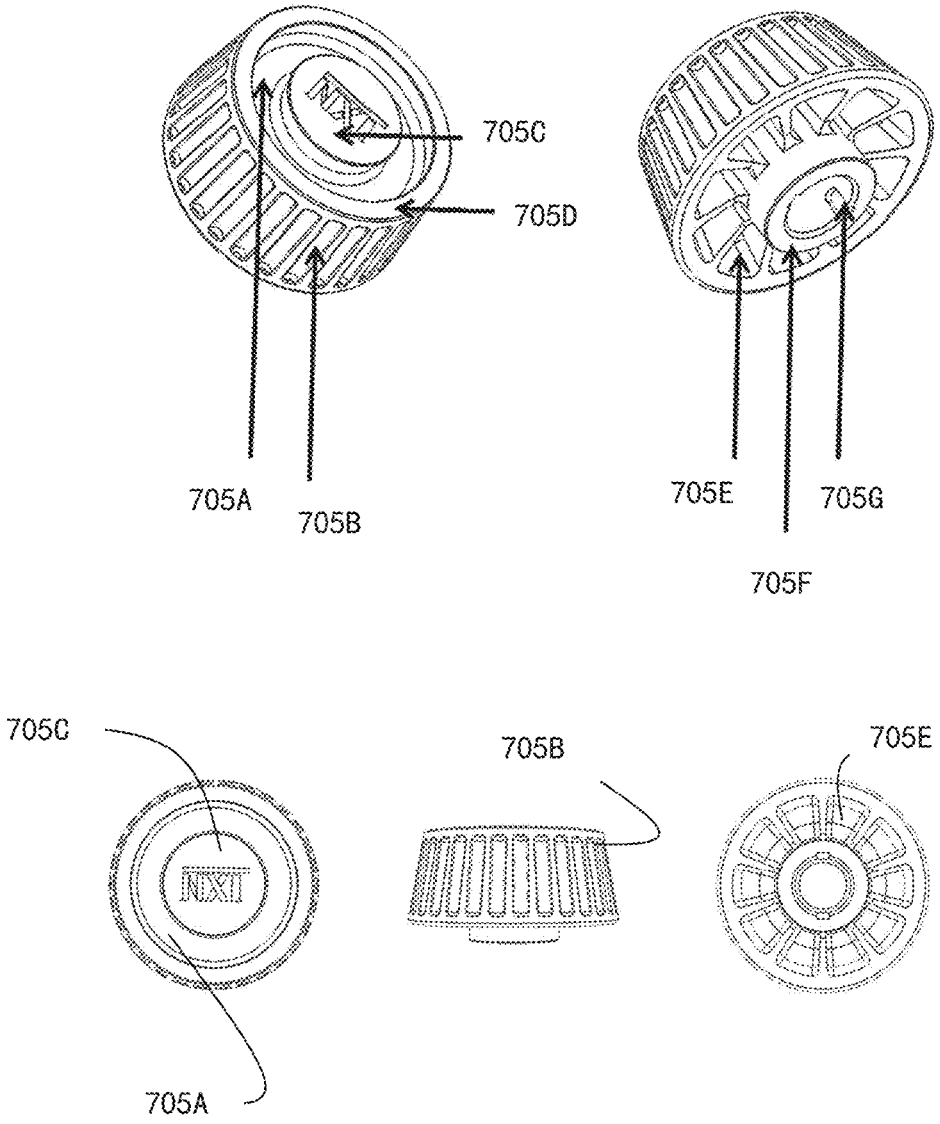
FIG. 53 depicts a cap of the helical screw pile assembly

As has been mentioned above, particular arrangements of the building structure 10 shown in FIGS. 1 to 9 may incorporate a plurality of components such as: the wall and floor panels, mechanical joints, the wafflepod system and the piles as shown in FIGS. 1 to 53. The following paragraphs provide descriptions of particular arrangements of any of these components.

Furthermore, these pluralities of components are adapted to be joined together so as to define particular arrangements of the building structure 10 in accordance with an embodiment of the invention. The following paragraphs also provide descriptions of how these components are joined together to define the building structure 10.

We refer now to FIGS. 9 to 19.

Figure 9:
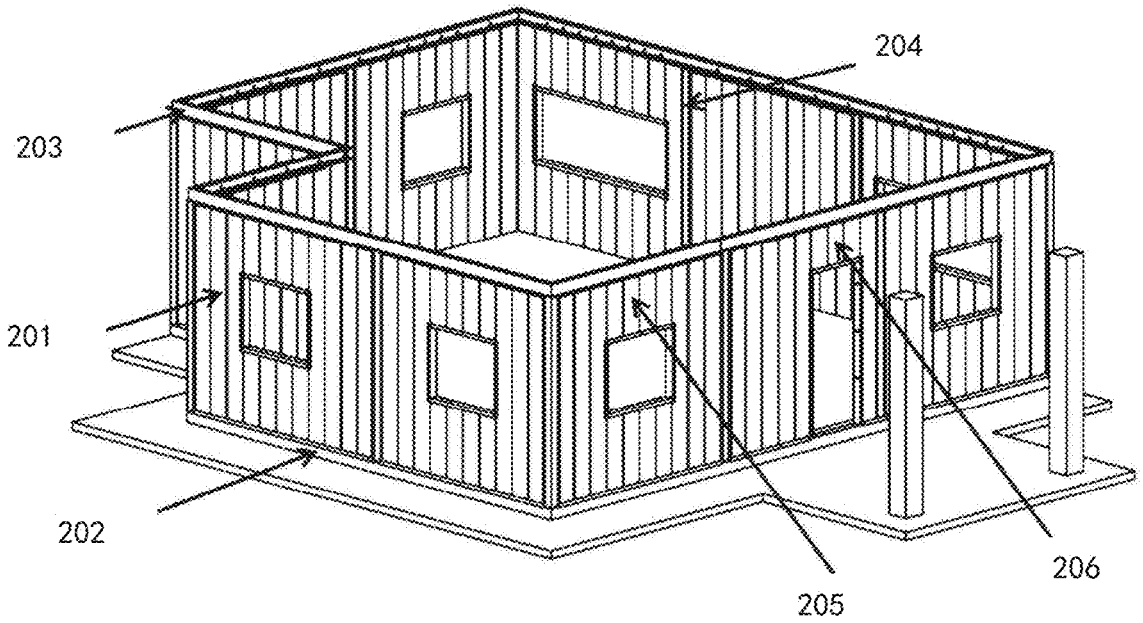
FIG. 9 contains a perspective view of a series of walls that form an enclosed space and are constructed of a series of multi-layered panels connected to each other.

Referring to FIG. 9 a series of multi-layered panels 201 (also referred to as panels) are connected to form an enclosed shape representing a single room. The multi-layered panels 201 are placed in a bottom channel 202 and are capped by a top channel 3 with the combined effect of constraining the multi-layered panels 201 such that they form a practically rigid structure that acts as a wall. A wall thus formed is not limited to the geometric configuration depicted, but may form a geometric shape composed of any combination of segments that are made up of a series of multi-layered panels joined together in a straight line. The segments may be arranged at any desired angle to each other.

Segments are supported by upright columns 204 at intervals not exceeding 3 metres. Multi-layered panels 201 may be cut to specific lengths to enable formation of apertures for windows and doors as in 205 and 206 respectively.

Figure 10:
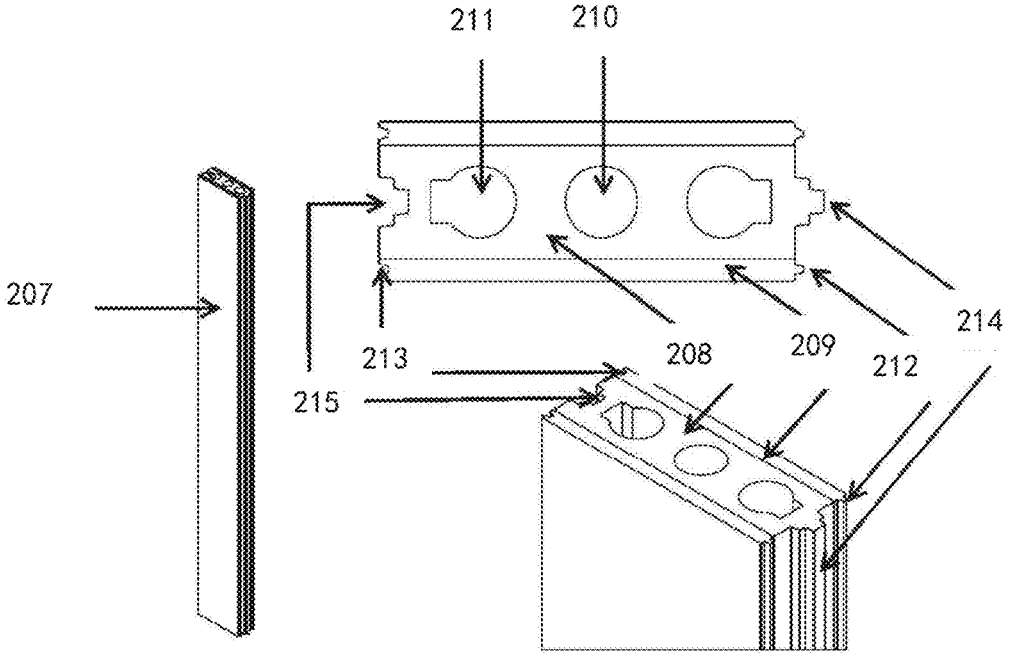
FIG. 10 contains a plan view of a multi-layered panel, a perspective view of a single multi-layered panel and a perspective view of the top edge of a single multi-layered panel.

Referring to FIG. 10, a single multi-layered panel 207 is shown to be composed of three layers of components. A polystyrene core 208 is encased within two 16 mm thick low density cement fibre sheets 209 with strong adhesive used to bind the three components together. The polystyrene core 208 has a central hole 210 extending the full height of the respective multi-layered panel and two edge holes 211 also extending the full height of the respective panel. The edge holes 211 are of a shape that allows for the insertion of locking clips shown in subsequent figures. Each outer sheet 209 has one edge forming a tongue shape 212 while the opposing edge has a corresponding groove shape 213 such that when one multi-layered panel 207 is joined to another along the edge, the tongue 212 fits neatly within the groove 213. The polystyrene core 208 has one edge shaped into a nine-face tongue 214 and an opposing edge shaped into a nine-face groove 215, such that when one multi-layered panel 207 is joined to another along its edge the nine-face tongue 214 fits neatly within the nine-face groove 215.

Figure 11:
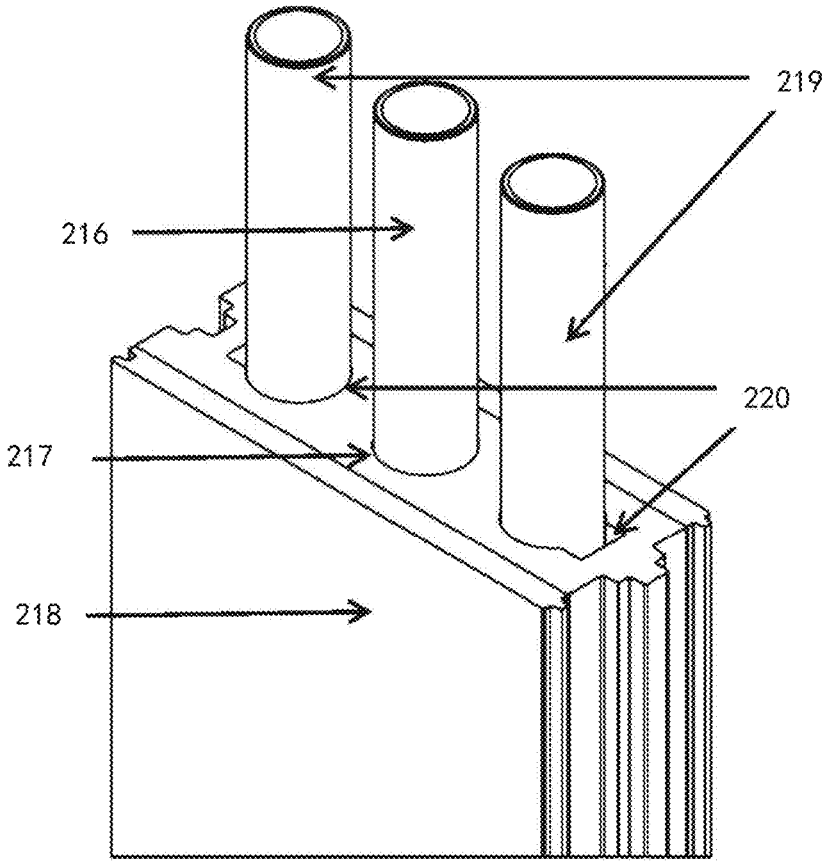
FIG. 11 contains a perspective view of a single multi-layered panel showing the placement of inner tubes.

Referring to FIG. 11, a 50 mm diameter PVC tube 216 is placed within a central hole 217 extending from the top edge to the bottom edge of a single multi-layered panel 218. When in its final position the top and bottom of the central tube 216 lie flush with the top and bottom edges of the multi-layered panel 218 respectively. Two outer 50 mm diameter PVC tubes 219 are placed in the respective edge holes 220, both of which extend from the top edge to the bottom edge of the multi-layered panel 218. When in their final position, the top and bottom of each of the two outer tubes 219 lie flush with the top and bottom edges of the multi-layered panel 218 respectively. The tubes 216 and 219 provide extra compressive strength to the panel 218, which may be further increased by filling with appropriate material that converts from a liquid to a high strength solid to form a solid core that completely fills the respective tube.

Figure 12:
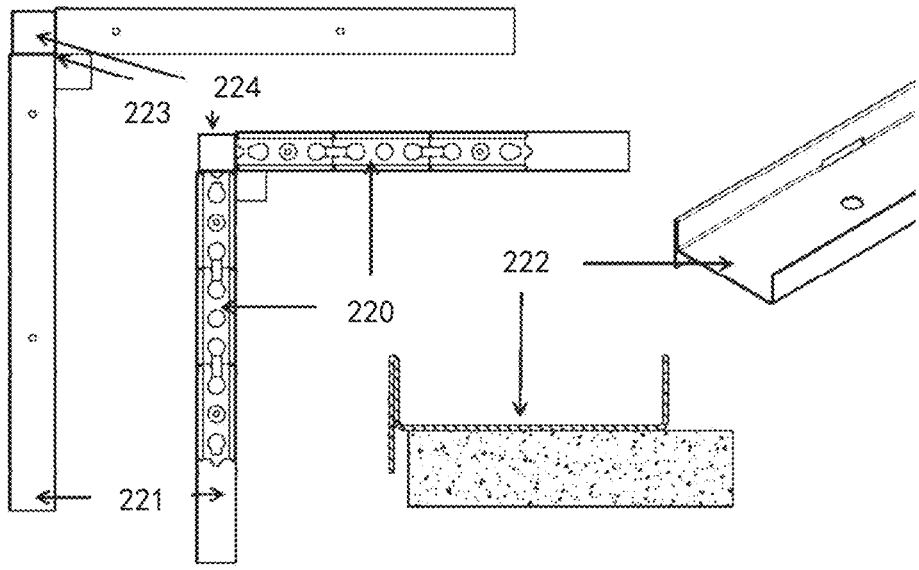
FIG. 12 shows a plan view of a bottom channel configuration, a plan view of said bottom channel configuration with a series of multi-layered panels in position, a cross section of a bottom channel in relation to a foundation for a building, and a perspective view of a bottom channel.

Referring to FIG. 12, a series of multi-layered panels 220 are placed such that their bottom edges lies within a bottom channel 221. The bottom channel 221 is of a size and shape 222 to enable the bottom edge of a multi-layered panel to be seated tightly within the bottom channel 222 when placed vertically. Two bottom channels may be positioned to form a right angle to each other where the respective inner edges of the bottom channels meet at their inner corners 223. The multi-layered panels at the edge of each of the two segments forming the right angle are connected to the respective edge of a vertical column 224 so as to form a robust join and maintain wall thickness at the right angle transition.

Figure 13:
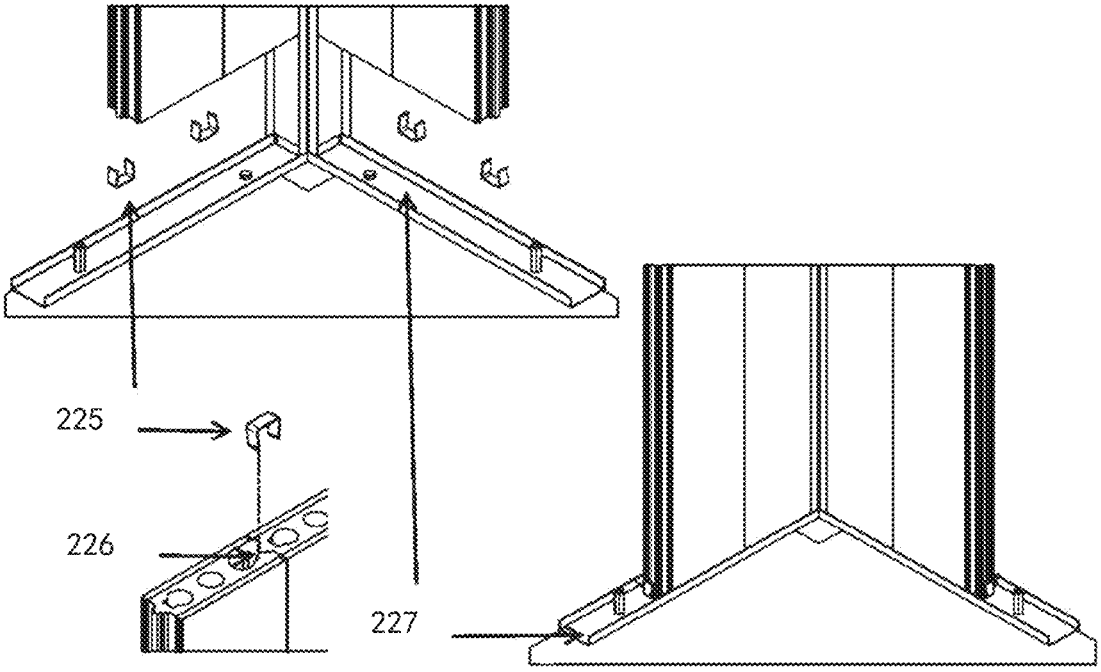
FIG. 13 shows a number of perspective views to describe the means by which a corner may be formed using a steel column and the means by which a wall is seated in a bottom channel.

Referring to FIG. 13, inter-panel locking clips 225 are shown in readiness for insertion into the locking clip recess 226 prior to the multi-layered panel being seated in the bottom C-channel 227 thus providing resistance against the respective multi-layered panels parting from one another.

Figure 14:
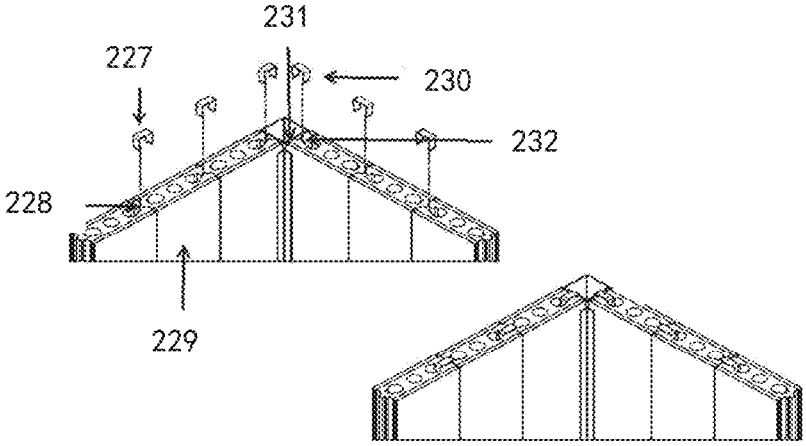
FIG. 14 shows perspective views of the means by which locking clips help to hold panels to each other and to a column.

Referring to FIG. 14, inter-panel locking clips 227 are shown ready for insertion into the locking clip recesses 228 in each of the multi-layered panels 229 to provide resistance against the respective multi-layered panels parting from one another. Panel-to-column locking clips 230 are shown ready for insertion in the hollow section of the column 231 and the locking clip recess in the adjacent panel 232, the dimensions of the clip being such that the respective multi-layered panel is held tightly against the column 231 so as to provide resistance against a parting of the multi-layered panel from the column.

Figure 15:
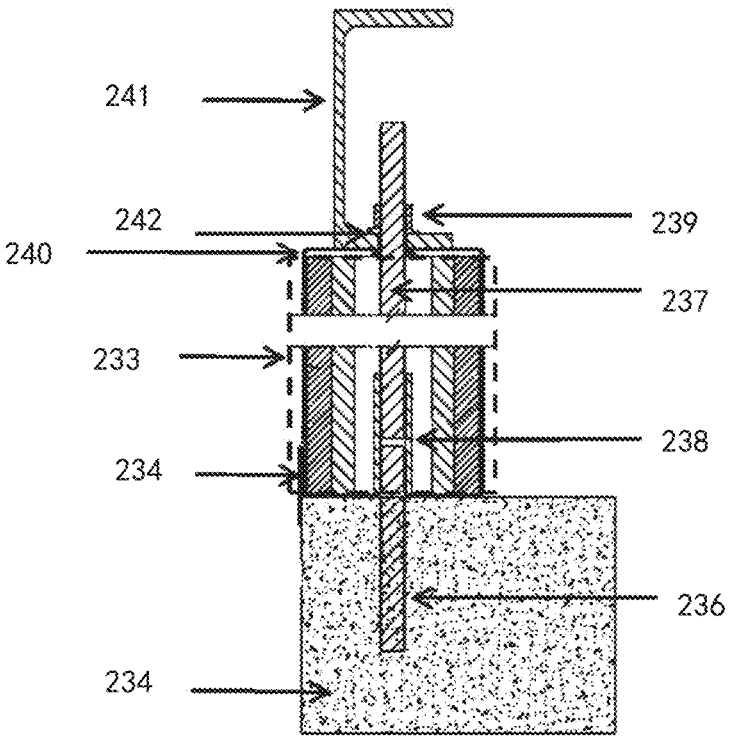
FIG. 15 shows a cross section view of a wall to illustrate the general arrangement of the key components to each other. The elements illustrated are the foundation block, bottom channel, multi-layered panel, top channel, anchor rod, ferrule, tie rod, washer, nut and roof plate.

Referring to FIG. 15, a multi-layered panel 233 is shown placed upright in bottom C-channel 234 that is placed on a foundation block 235. A threaded anchor rod 236 is fixed in the foundation block by means of a strong bonding agent within the hole created for the threaded anchor rod 236. A threaded tie rod 237 is connected to the threaded anchor rod 236 by means of a threaded ferrule 238. A compressive force is exerted on the multi-layered panel 233 by means of tightening locking nut 239 on threaded tie rod 237 following placement of top C-channel 240, roof plate 241 and tie rod washer 242. By this means, a strong resistance to a parting between the multi-layered panel 233 and the foundation block 235 is produced.

Figure 16:
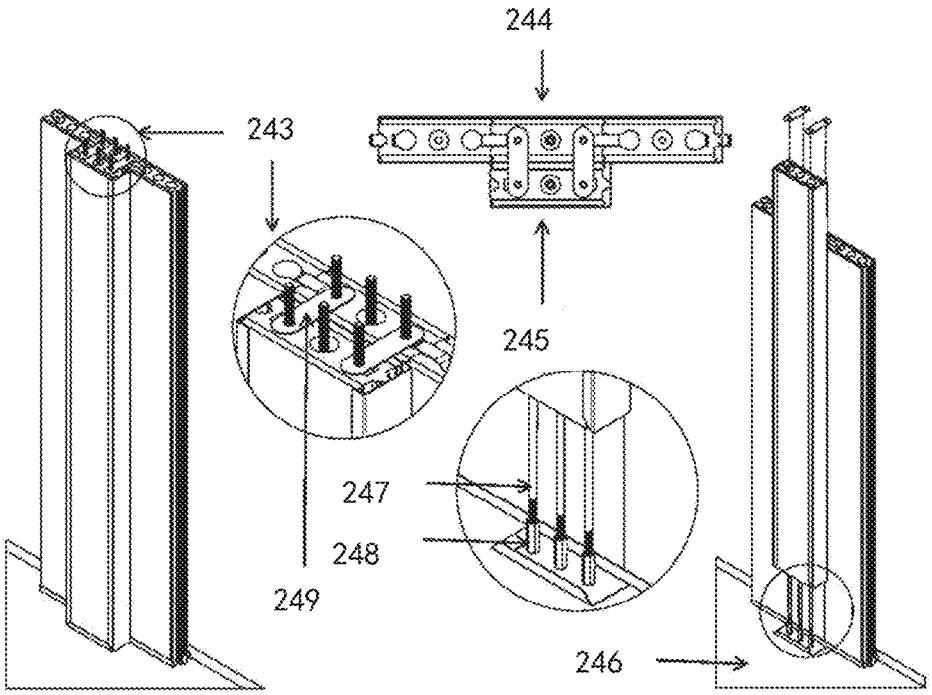
FIG. 16 shows the means by which a pillar is created using two multi-layered panels and the means by which a wall or pillar is fastened securely to the foundation.

Referring to FIG. 16, an arrangement is shown whereby tie rods 243 are inserted in two multi-layer panels, one of which 244 forms part of a wall segment as described in preceding figures and the other panel 245 which is placed adjacent to the former such that their two wider faces butt against each other in readiness for tensioning and thereby creating a strong connection between the participating multi-layer panels and the foundation block 246 when the tie rods 243 are finally tensioned as shown in FIG. 15. The tie rods 247 are threaded into ferrules 248 that are threaded onto anchor rods embedded in foundation block 246 as depicted in FIG. 15. Tie rod locking plates 249 are placed over tie rods 243 so as to form a rigid connection between a tie rod in one multi-layered panel and a tie rod in the adjacent multi-layered panel thus creating a strong resistance against a parting between the two multi-layered panels. The tie rods are eventually tensioned by tightening the corresponding nut.

Figure 17:
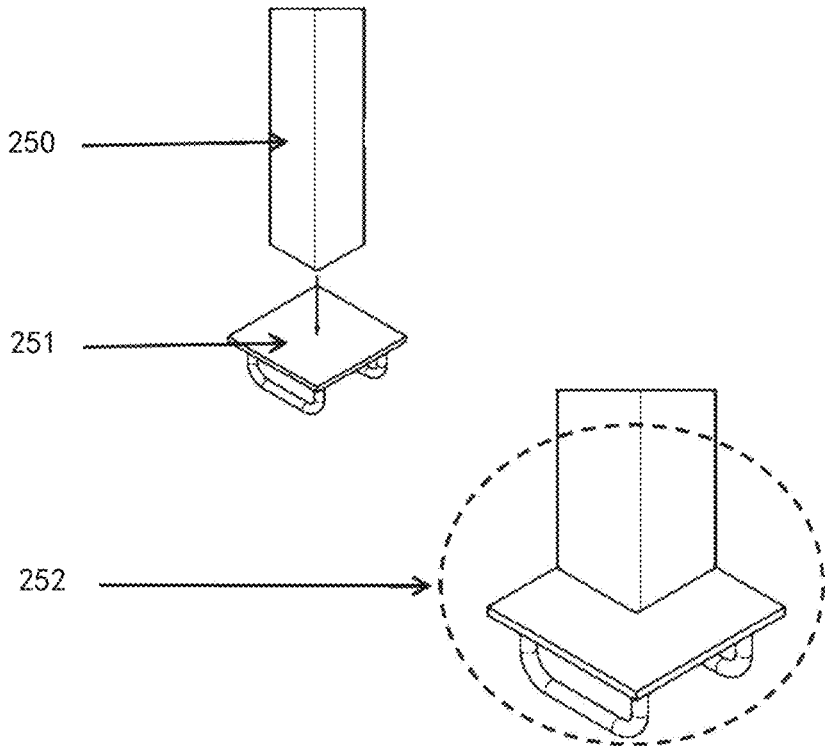
FIG. 17 shows the means by which a column is fastened to a casting plate, which is embedded in the foundation.

Referring to FIG. 17, a metal column 250 is shown in readiness for attachment to metal casting plate 251, which is embedded in the concrete foundation. The metal column 250 is welded to casting plate 251 to form a strong unit 52 ready to support any attached multi-layered panel.

Figure 18:
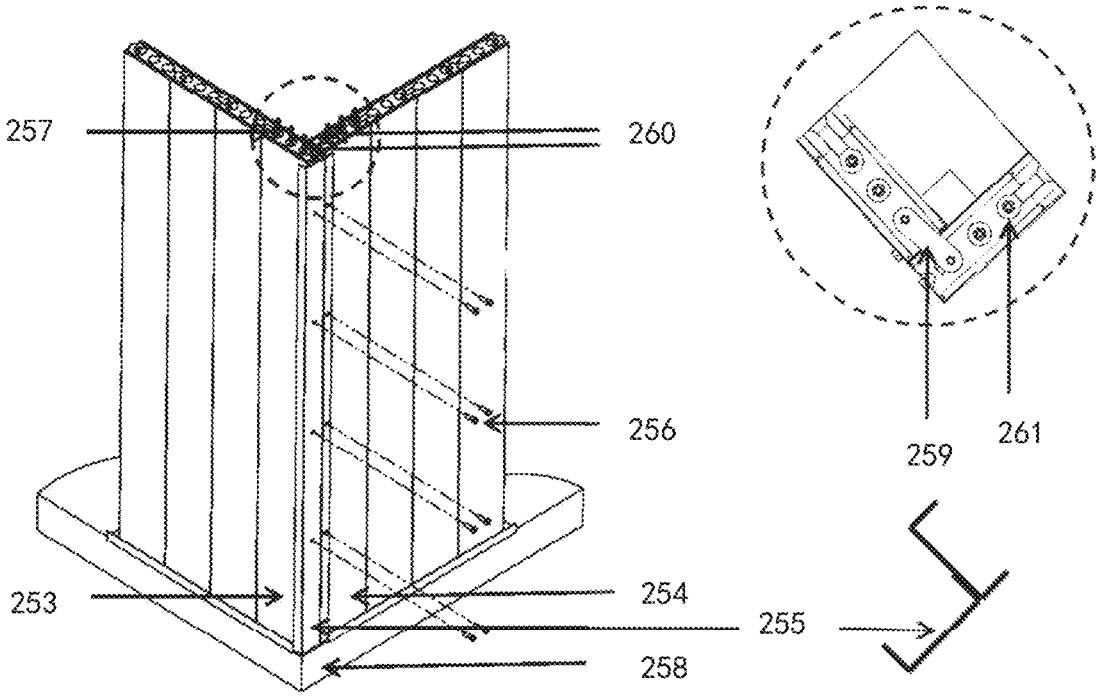
FIG. 18 shows the means by which a corner is created using two multi-layered panels and a steel capping post.

Referring to FIG. 18, two multi-layered panels 253 and 254 are abutted against one another to form a right angle join by placing one edge of each in one open channel of a metal capping post 255. The metal capping post 255 is composed of two C-channels welded together such that the channel of one C-channel is at a right angle to the channel of the other C-channel and the height of the capping post 255 is equal to that of the multi-layered panels 253 and 254 to be joined. The edge of each panel 253 and 254 to be joined is firmly inserted into that channel of the capping post 255 that has its opening orientated in line with the respective panel. Mechanical fastenings 256 are used to fasten the outside faces of the capping post to the edge or face of the respective panel.

A 50 mpa cement grout is injected into the void formed between the edge of each multi-layered panel 253 and 254 and the capping post 255 face that is perpendicular to it to provide a strong medium for the mechanical fastenings 256 to take purchase.

A tie rod 257 is installed within the vertical holes of each multi-layered panel 253 and 254 participating in the join, each tie rod 257 being firmly fastened to the foundation block 258 by means of threading into a metal ferrule that is fastened to an anchor rod fixed in the foundation block 258. A 50 mpa cement grout is injected into each hole of each participating panel 253 & 254 so as to increase their load bearing capacity. A metal locking plate 259 is placed over the two adjoining tie rods 260, each of which is inserted in one of the participating multi-layered panels 256 & 254, to form a mechanical connection between the participating panels 253 & 254. Tension is applied to each tie rod 257 via a nut and washer arrangement 261 so as to fasten the participating panels securely to the foundation block 258.

Figure 19:
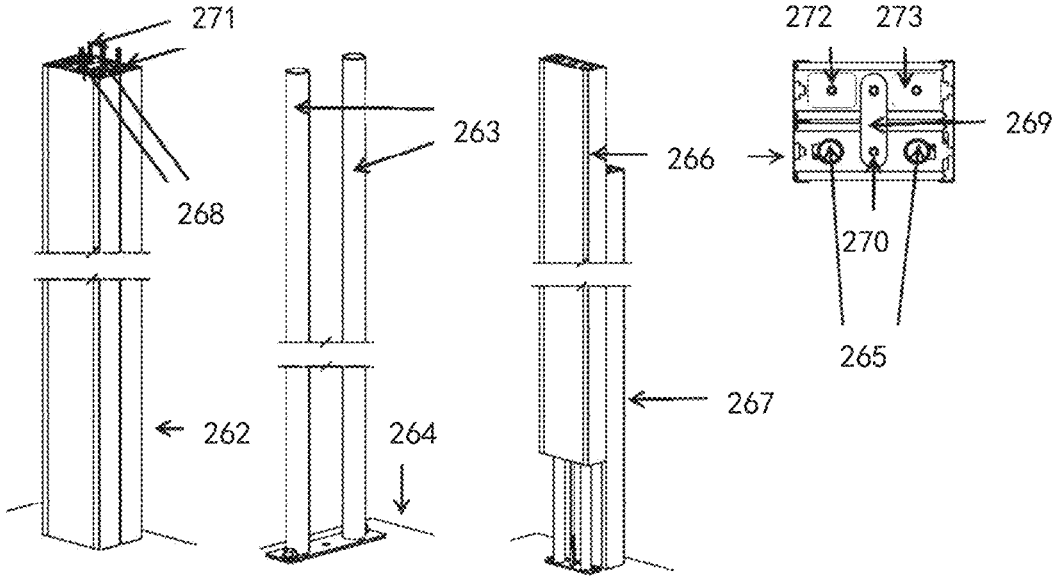
FIG. 19 shows how a free standing column is created using two multi-layered panels, two steel tubes, and a combination of tie rods.

Referring to FIG. 19, a free-standing column 262 is created by fixing two vertical steel tubes 263 to the foundation block 264 via a steel plate 264 that is mechanically fastened to foundation block 264. The vertical steel tubes 263 are positioned such that they correspond with the outer holes 265 of one of the multi-layered panels 266, hereon known as the primary panel, which is placed over the steel tubes 263 to sit on foundation block 264. A multi-layered panel 267, hereon known as the secondary panel, is placed adjacent to the primary panel 266 such that one face of the secondary panel 267 is pressed against one face of the primary panel 266 and the edges of both panels are in line with one another.

Tie rods 268 are placed in the centre hole of each of the primary panel 266 and secondary panel 267 and are attached to the foundation block 264 via ferrules connected to anchor rods as described in FIG. 15. The tie rods 268 are connected together by a locking plate 269. A nut and washer arrangement 270 is used on each tie rod to fasten the participating panels securely to the foundation block 264. Tie rods 271 are placed in each of the outer holes of the secondary panel 267 and securely fastened to foundation block 264 by same means as that described for tie rods 268. A 50 mpa grouting cement is injected into the outer holes of the secondary panel 267 after it has been secured to the foundation block 264 by means of a nut and washer arrangement 272 exerting a compressive force via single tie rod plates 273.

The resultant free standing column 263 is therefore securely fixed to foundation block 264 and is able to withstand significant compressive and lateral forces enabling it to act as a load bearing element.

We refer now to FIGS. 20 to 28.

Figure 20:
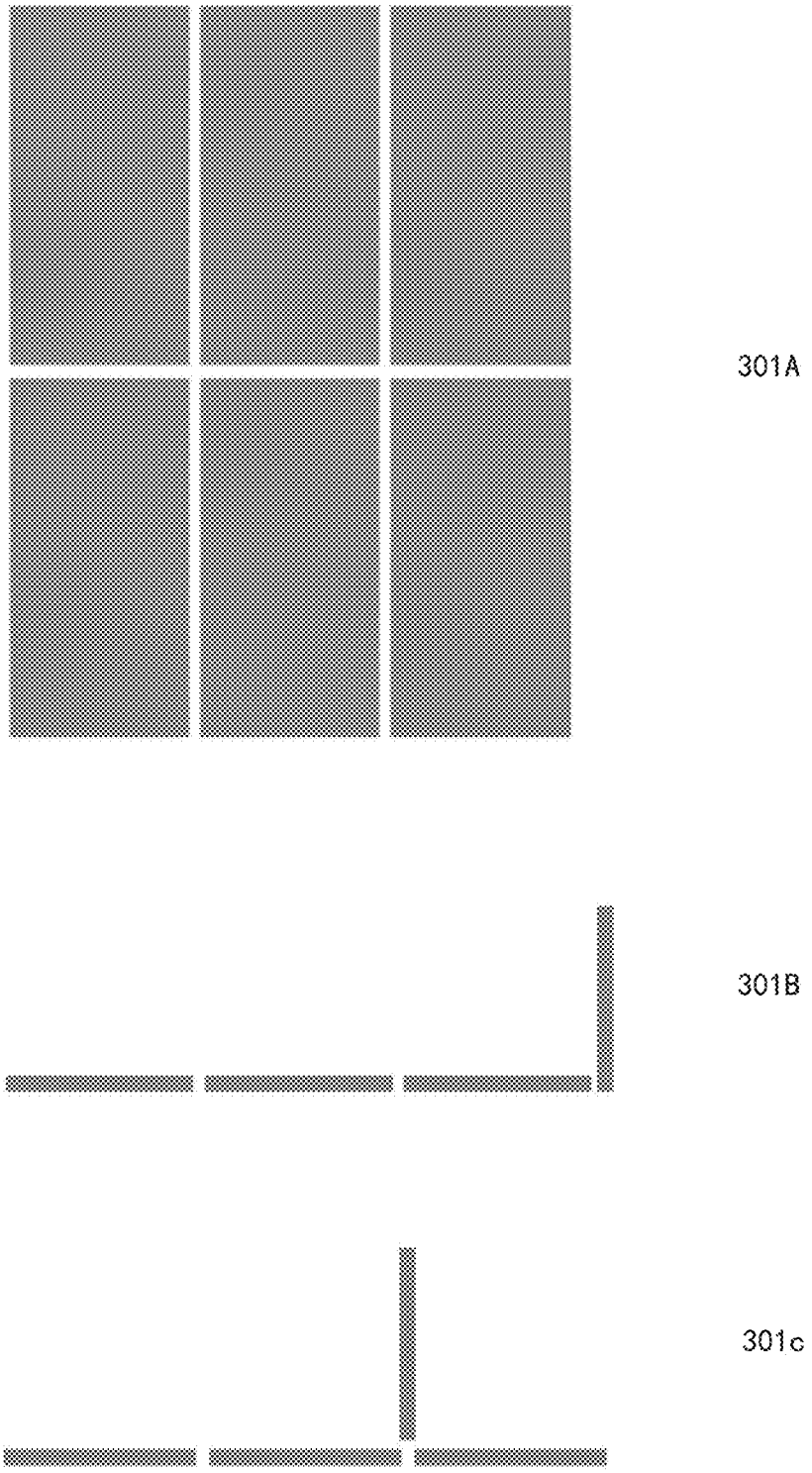
FIG. 20 shows an abstract arrangement of panels to indicate typical configurations in which the panel may be employed.

Referring to FIG. 20, an abstract representation 301A of a series of encased core precast panels (also referred to as "panel" in this description, for the sake of brevity) is shown, depicting two wall segments, one positioned above the other as in a two storey building, each composed of three encased core precast panels joined together. The respective vertical and horizontal joins are shown white to help distinguish between the panels. The representation is intended to convey a general class of configuration, which are multiple storeys of walls.

The encased core precast panels may also be configured at right angles, but not limited to the right angle, to each other 301B so as to form a corner between two walls. The configuration represented by the top view representation 301B may be repeated over multiple storeys. Joins between panels are shown in white to distinguish between individual panels.

A panel or wall made of multiple panels may be joined 301C to another wall, preferably at right angles, at an intermediate point of the latter so as to form a partition, such as in the case of an interior wall in a building. The configuration represented by the top view representation 301C may be repeated over multiple storeys. Joins between panels are shown in white to distinguish between individual panels.

Figure 21:
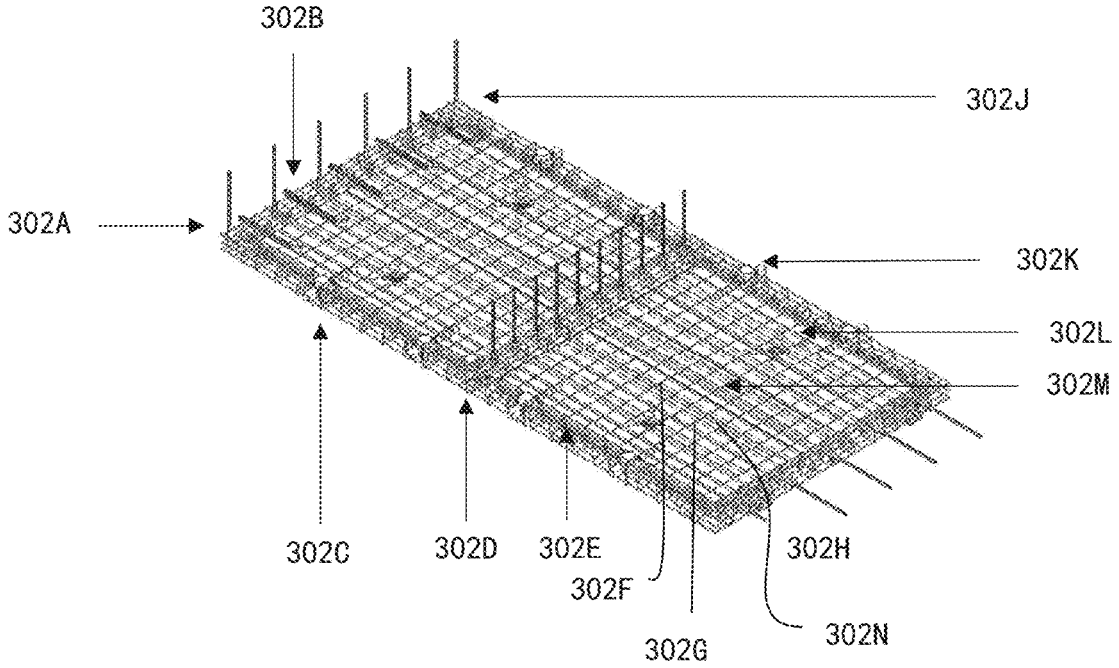
FIG. 21 shows an overall view of a panel and its components.

Referring to FIG. 21, the main elements of a typical encased core precast panel in production orientation (flat to the floor) are depicted. Two blocks of insulating core 302E, preferably made of polystyrene, are encased within a concrete casing 302D. Preferably, the insulating core 302E lies between two sheets of reinforcing mesh 302F, with only the top sheet visible in this depiction, and a pattern of rebars 302M running longitudinally. The top mesh 302F is separated from the insulating core 302E by means of spacer chairs 302L. An edge frame 302G made of an assembly of reinforcing bars forms the structural foundation for all the elements. A pattern of protruding reinforcing bars extend perpendicular 302A to the face of the panel and parallel 302H to the face of the panel provide for strong mating with other panels or building bodies, such as floors, at the desired orientation. A series of middle casting locks 302G for joining the panel edge to the edge of another panel are embedded within the concrete. A series of corner casting locks 302K for joining the face of the panel to the edge of another panel, as in the case of a wall corner, can also be embedded within the concrete structure and edge frame. The said arrangement of casting locks represents only one configuration. For instance, in the case of the panel forming part of a straight wall the middle casting locks would be located at both long edges of the panel. Multiple lifting plates 302N are embedded within the structure and securely fixed to the edge frame 302G providing a robust means of attaching lifting devices to the panel for the purpose of handling and installation.

Figure 22:
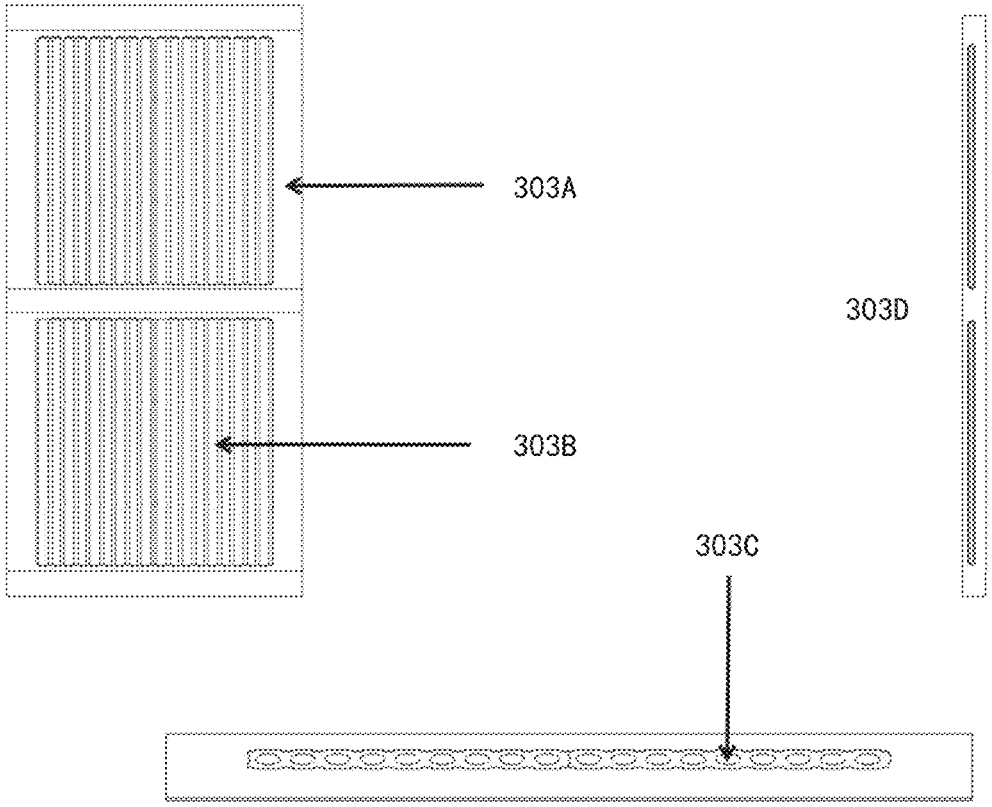
FIG. 22 shows the concrete casing and insulating core blocks in isolation and in relation to one another.

Referring to FIG. 22, two insulating cores 303B are encased within a concrete body 303A. A side view 303D shows the placement of the insulating cores 303B in the concrete body 303A. A top view shows insulating core 303B incorporating hollow tubes 303D open at the upper edge of insulating core 303B so as to provide for the insertion of pipes or cables forming part of the plumbing, electrical and associated services. All other elements of the encased core precast panel are excluded from this depiction for the sake of clarity.

Figure 23:
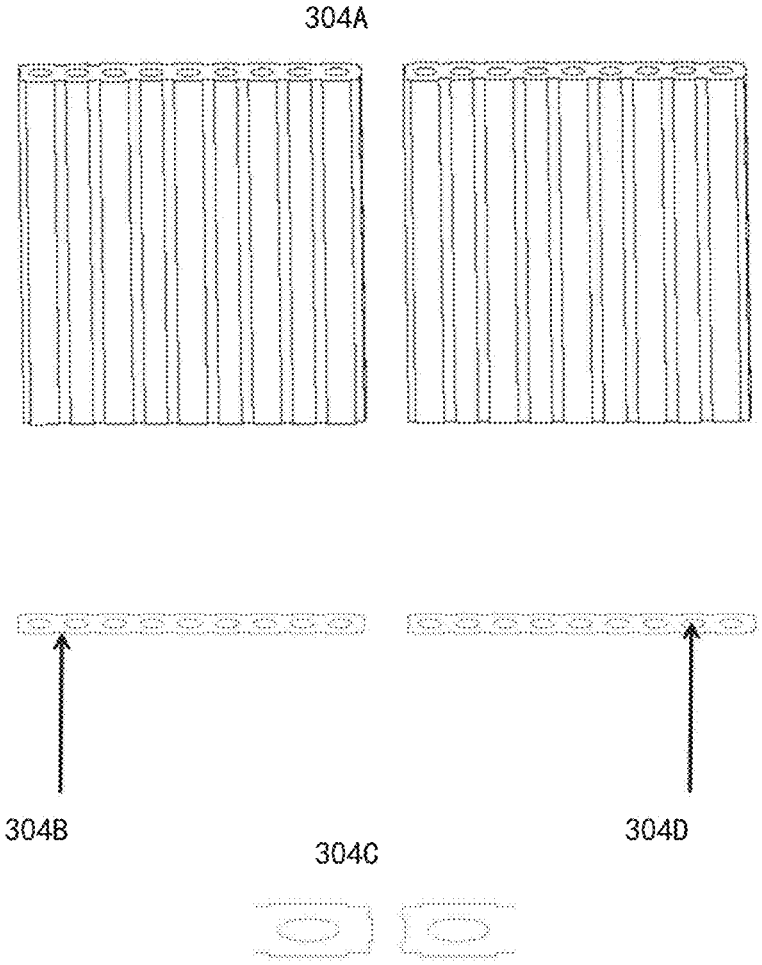
FIG. 23 shows the architecture of the insulating core blocks.
Figure 24:
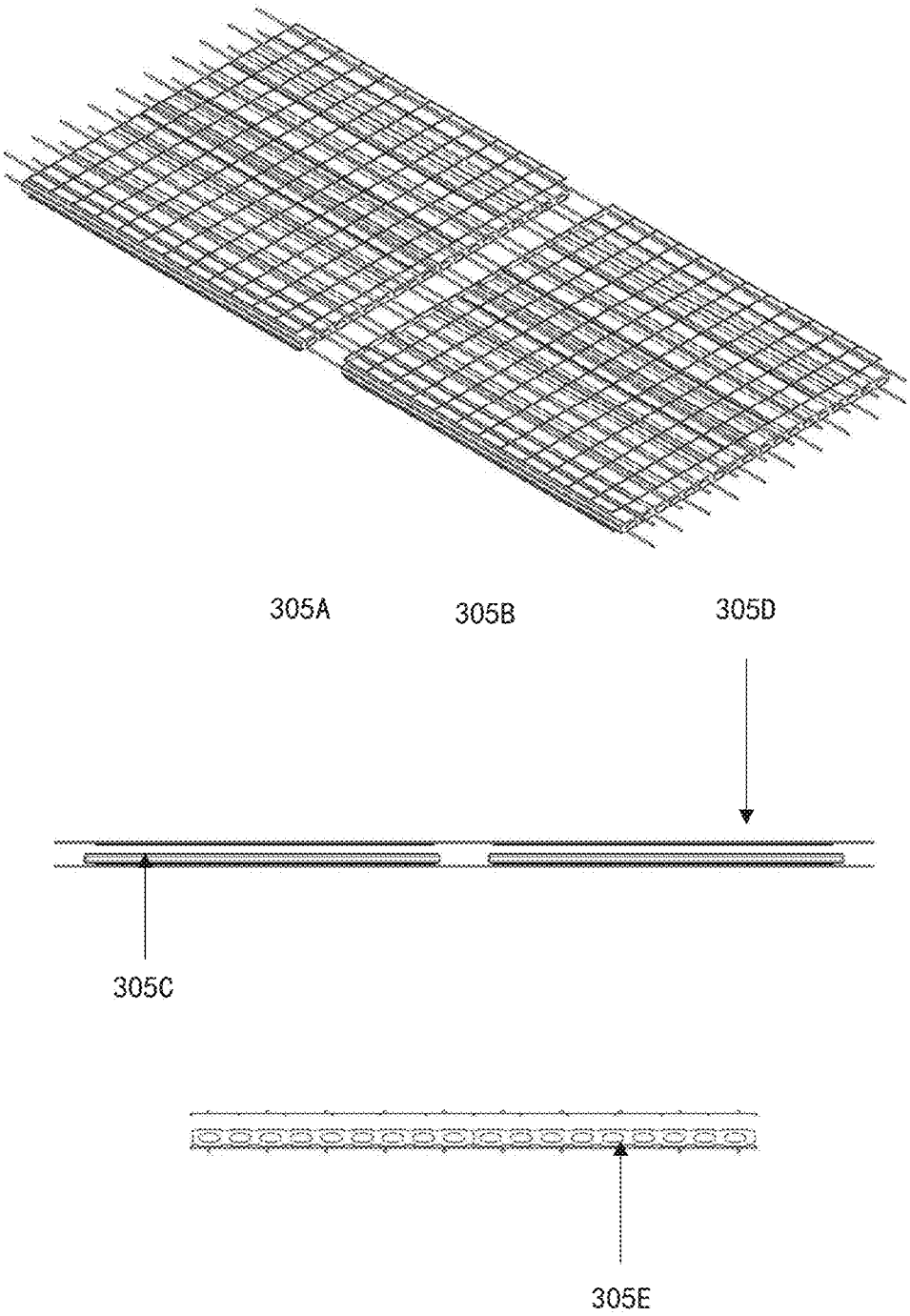
FIG. 24 shows the insulation blocks and the reinforcing elements in isolation and in relation to one another.

Referring to FIG. 23, two core insulation bodies 304A, preferably made of polystyrene, as would typically be included in an encased core precast panel, are shown in isolation for the purpose of illustration. Said core insulation bodies 304A are typically joined at their longer edge, but are shown as separated for the sake of illustration.

The core insulation body 304B incorporates hollow tubes 304D that preferably extend the full height of the insulation core 304B such that each tube presents an open face at the edge of the insulation core 304B that corresponds to the upper edge of the encased core precast panel when in its working vertical position. Said tubes provide a means of installing electrical and plumbing services (as well as other services requiring pipes or cables) in the panel itself. Said tubes can be accessed post-installation by means of drilling a hole in the face of the panel.

As indicated above, said core insulation bodies can be joined along their vertical (when in working position) edges. The two longer edges of each insulation core are formed such that the cross sectional profile of one edge is the reverse of the cross sectional profile of the opposing edge as depicted in 304C. In this manner, a multi-step join between two insulation core bodies can be created, whereby the edge of one insulation core body fits neatly into the edge of the adjoining insulation core body.

Figure 25:
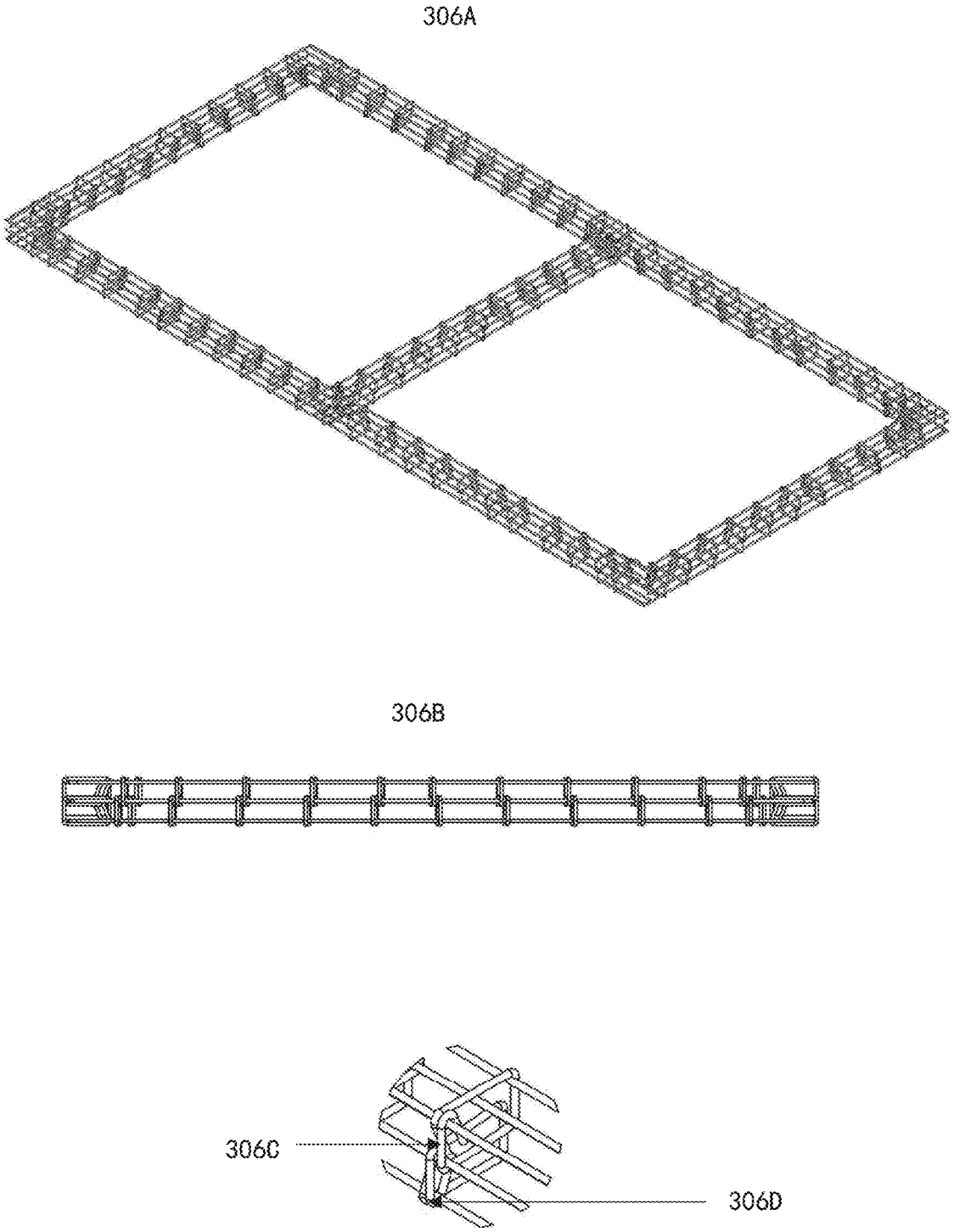
FIG. 25 shows the reinforcing skeleton in isolation.

Referring to FIG. 25, insulating core 5C, reinforcing mesh 305B and reinforcing bars 305A are shown in isolation from the other components of the encased insulation precast panel for the sake of illustration. Preferably, insulating core 5C is located between two layers of reinforcing mesh 305B. Insulating core 305C is positioned closer to one face of the panel. Top reinforcing mesh 305D is separated from insulating core 305C via spacer chairs, omitted from the current figure for the sake of simplicity. Preferably, two bodies of insulating core 305C are positioned within the boundaries of the panel such that a gap exists between the two core insulating bodies. In this manner, a region of solid concrete is formed in the corresponding volume so as to act as a strength element. Said bodies of insulating core are joined together when in top view. Preferably, said insulating core bodies incorporate hollow tubes 305E that present an opening at the top edge of said insulating core bodies in top view, such hollow tubes being for the purpose of accommodating the installation of pipes, cabling and the like within the body of the panel post-lockup.

Figure 26:
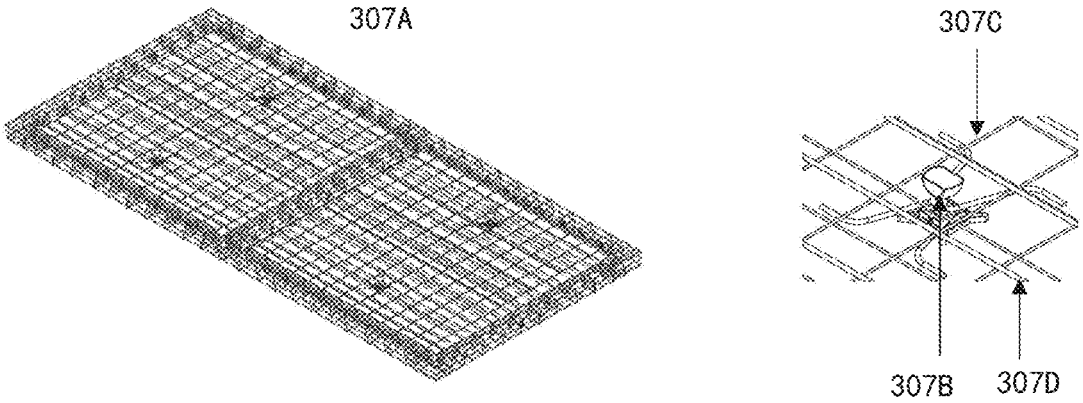
FIG. 26 shows the means by which lifting chairs separate the reinforcing mesh from the insulation blocks.

Referring to FIG. 26, the edge frame 306E of the encased insulation precast panel is shown in isolation for the sake of clarity. Said edge frame is composed of an arrangement of reinforcing bars 306D positioned in relation to each other via a series of reinforcing elements 306C each composed of a length of reinforcing bar formed into an approximate rectangle orientated approximately perpendicular to the longitudinal axis of the reinforcing bar 306D. Said reinforcing elements 306C are positioned at regular intervals 306B along the lengths of said reinforcing bars 306D, which are positioned 306A so as to form the shape of the respective panel and of a length and width slightly less than that of the panel. An arrangement of reinforcing bars 306D and positioning elements 306C extends from the approximate midpoint of a long edge (in production orientation) of the panel to the corresponding midpoint of the opposite long edge so as to provide a region of reinforcing across the middle of the panel.

Figure 27:
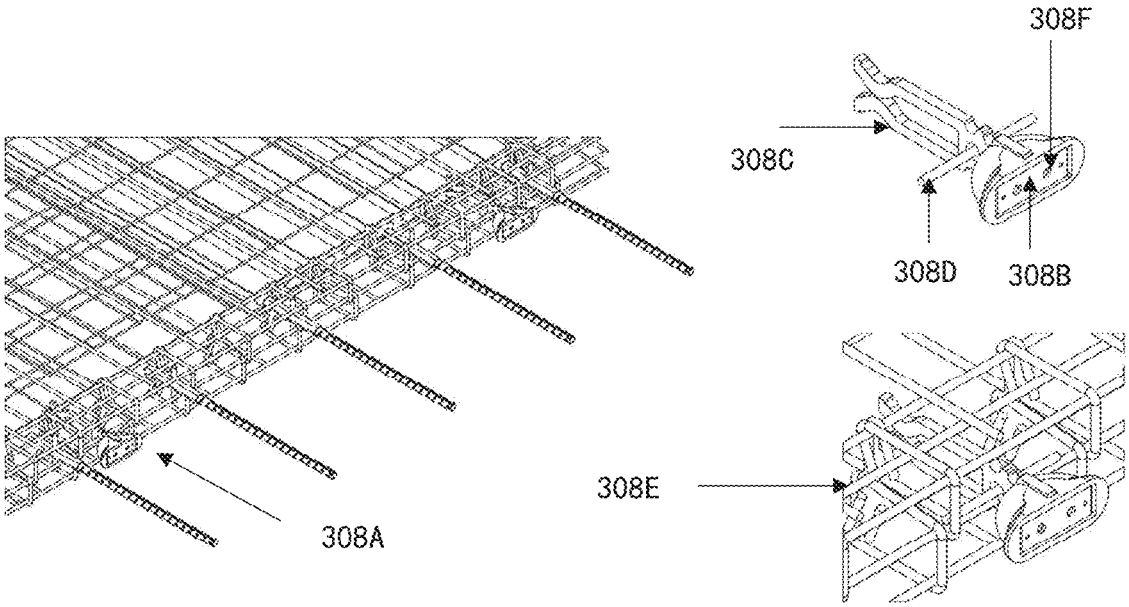
FIG. 27 shows the structure and placement of the lifting plates.

Referring to FIG. 27, an arrangement of spacer chairs 307B is shown 307A in relation to the core insulating bodies and reinforcing arrangement 307D described in earlier figures. Said space chairs 307B are seated on the core insulating bodies and incorporate an arrangement of rods formed into shape and located so as to support the reinforcing mesh in the desired position in relation to the concrete body of the panel.

Figure 28:
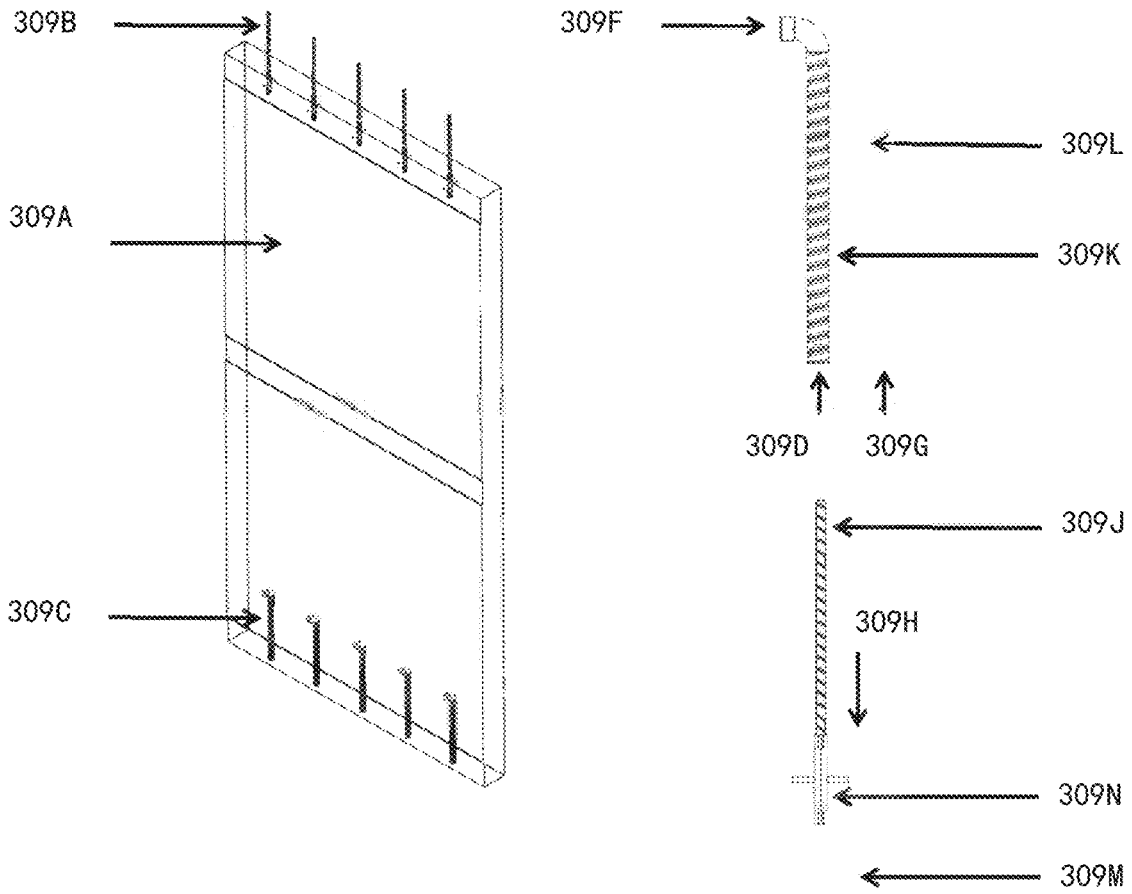
FIG. 28 shows the grouting tubes and the vertically protruding reinforcing bars that engage with the corresponding tubes.

Referring to FIG. 28, multiple lifting plates 308A are shown embedded within the structure of the panel. Said lifting plates 308A incorporate a steel plate 308B strongly attached to an arrangement of structural arms 8C. Said structural arms arrangement is designed to directly engage with reinforcing bars 308D and 308E such that the lifting plate 308A is firmly fixed to the reinforcing edge of the panel and encased within the concrete body of the panel. Preferably, steel plate 308B incorporates threaded holes 308F to enable attachment to external lifting devices and equipment.

Figure 29:
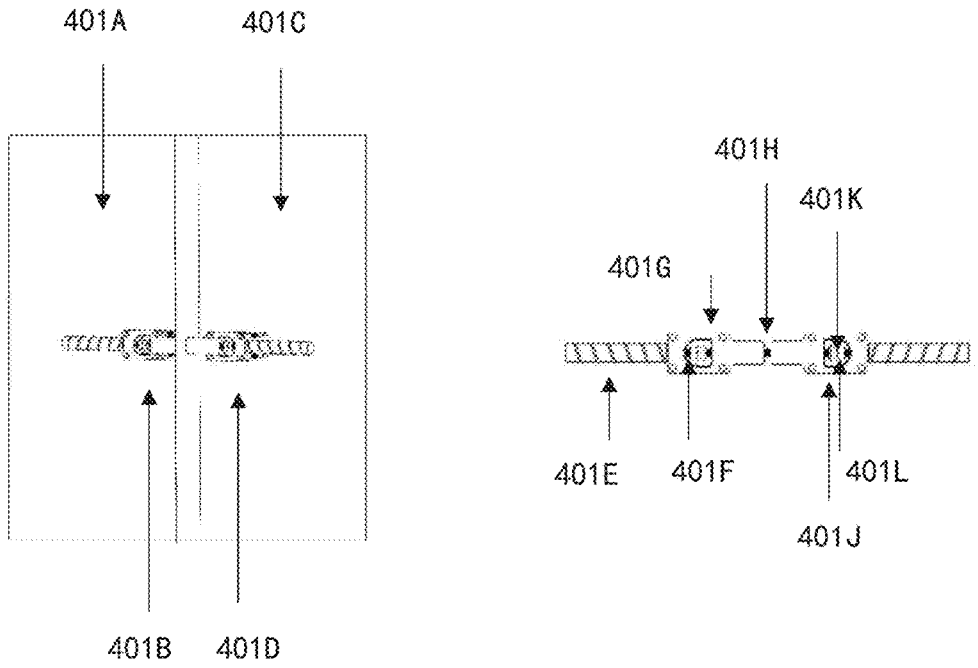
FIG. 29 depicts two casting locks each embedded in a precast panel and connected to each other such that the corresponding panels are joined in a precise and strong manner.

Referring to FIG. 29, the design of the encased core precast panel 309A incorporates a series of reinforcing connector bars 309B (and 309J) embedded within the body of the panel 309A and protruding from the top edge 309H (when viewed in a typical vertical orientation) of the panel 309A (and 309M). Reinforcing connector bars 309B and 309J incorporate a metal head 309N at that end of the reinforcing connector bar 309J embedded within panel 309M shaped in such a fashion as to firmly fix reinforcing connector bar 309J within panel 309M along the axis of the long edge of panel 309M and in relation to rotation around the long axis of reinforcing connector bar 309J.

Said panel 309A also incorporates a series of connector tunnels 309C (and 309K) along its bottom edge 30309G extending from the face of the bottom edge towards the centre of the panel and aligned with the long edge of panel 309L. The pattern of tunnels 309K (and 309C) is designed to correspond with the pattern of reinforcing connector bars 309J (and 309B) such that when panel 309L is installed on top of panel 309M, as in the case of a two storey construction, with the bottom edge 30309G of panel 309L seated on edge 309H of panel 309M, the reinforcing connector bars 309J completely penetrate into the corresponding tunnels 309K.

Connector tunnels 309K present one open face 309D at the bottom edge 30309G of panel 309L and one open face 309F at the face of panel 309L, having been formed by the incorporation of correspondingly shaped tubes into the respective panel mould prior to casting. By this means concrete may be injected via open tunnel face 309F into the void between connector reinforcing bar 309J and connector tunnel 309K upon panel 309L having been seated on panel 309M, thus fixing panel 309L to 309M along both the axis of the short edge and the axis of the long edge.

We refer now to FIGS. 29 to 34.

Referring to FIG. 29, first panel 401A is joined to second panel 401C, with the edges of each panel butted to each other, through the connection of first casting lock 401B and second casting lock 401D.

A top view of the dual casting lock configuration shows each casting lock to include a retreat tunnel 401E, which allows threaded rod 401F to be placed in casting lock body 401G such that it does not protrude beyond casting lock body 401G during the process of incorporating the respective casting lock into the panel mould. Retreat tube 401E includes a ridge spiralling externally around its circumference and along its length in order to ensure an effective bonding to the hardening material. Preferably, retreat tube 401E is attached to casting lock body 401G by means of a coarse thread. When in connecting mode, threaded rod 401F extends across the boundary 401H between the panels 401A and 401C such that tightening nut 401K of each casting lock in the pair can be tightened against casting lock body 401G via spring washer 401J such that tension is produced in threaded rod 401F thus forcing the first casting lock 401B against the second casting lock 401D. A locking nut 401L is tightened against tightening nut 401K to fix it in position relative to threaded rod 401F.

By this means, the connection of casting locks 401B and 401D firmly fixes first panel 401A to second panel 401C in all dimensions.

Location markings 1N and 1M enable the precise placement of a casting lock in its respective precast panel with reference to the relevant edges of the precast panel. Location markings 1N and 1M enable precise monitoring and adjustment of the geometry of the mould during casting to ensure that the geometry of each panel is identical and the positioning of the respective casting locks is consistent. By such means the casting locks are positioned accurately relative to each other, enabling the effective mating of one casting lock to its corresponding partner in the adjacent panel.

Figure 30:
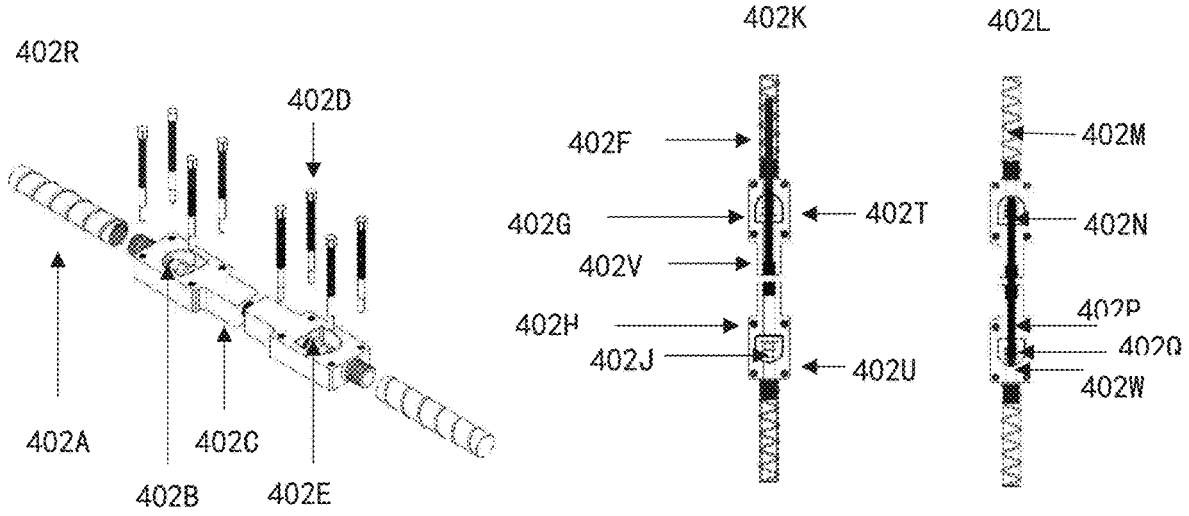
FIG. 30 depicts a pair of casting locks in a connected configuration. Panels are omitted for the purpose of clarity.

Referring to FIG. 30, a post-lock configuration 2R of two casting locks is shown in exploded form for the purposes of illustration. Each casting lock assembly is embedded in its host panel as described in FIG. 31. A threaded rod 402B runs through the body 402C of each casting lock in the post-lock configuration. An arrangement 402E of a washer, tightening nut and locking nut engages with the threaded rod such that a tightening of the opposing arrangements 402E creates tension in the threaded rod 402B thus fixing the two casting locks, and therefore the panels within which they are embedded, in relation to each other. The retreat tubes 402A and positioning bolts 402D are shown detached for the purposes of illustration.

Figure 31:
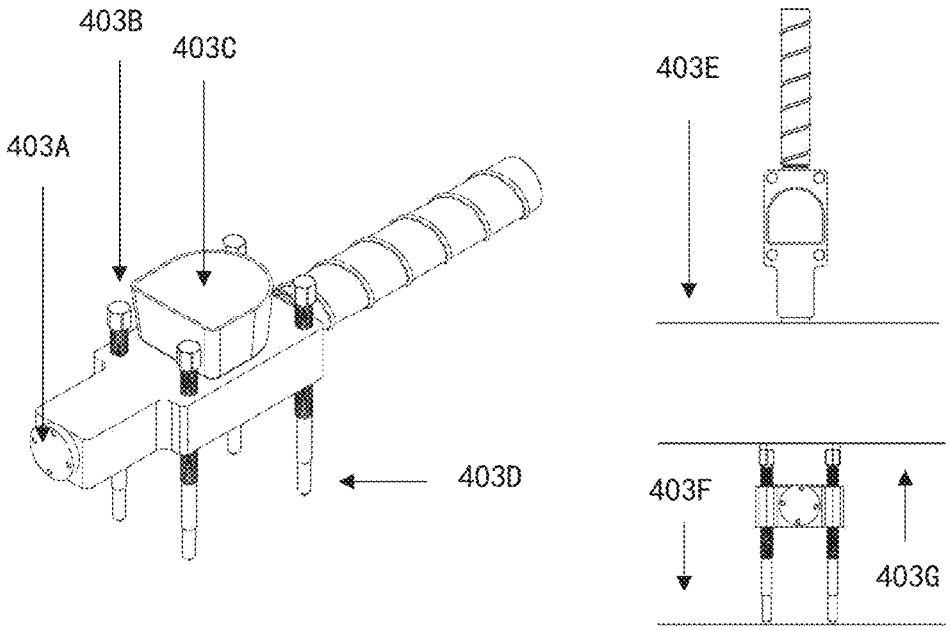
FIG. 31 depicts a casting lock in pre-connection configuration ready for placement in the mould for the precast panel. The figure illustrates the relationship of the casting lock extremities to the panel boundaries.

A pre-lock configuration 402K is shown whereby threaded rod 402V is contained within the length of casting lock 402T and retreat tube 402F during the moulding process, as described in FIG. 31. Nut and washer assembly 402G is not engaged with the casting lock body in this pre-lock configuration 402K. The aperture within casting lock body 402U is free of threaded rod while void 402J lies empty. Thus, there are two forms of pre-lock configuration. The first form includes a threaded rod protected within the casting lock and retreat tube as well as a tightening nut, locking nut and washer arrangement, while the second form excludes the threaded rod and tightening assembly. However, each form can be converted into the other simply by the addition or subtraction of the threaded rod and tightening assembly. This transformation can occur post-moulding on the basis that access to the void within the casting lock body is available post-moulding. Thus, each form of the pre-lock configuration represents a convenience rather than a fundamental distinction.

Post-lock configuration 402L shows threaded rod 402P extending into void 402W of casting lock 402U. Tightening assembly 402Q is engaged with threaded rod 402P such that the coordinated tightening of nut and washer assemblies 402N and 402Q imposes tension in threaded rod 402P when the respective panel edges press against one another (as depicted in FIG. 29). Retreat tube 402M lies empty due to the post-lock position of threaded rod 402P.

Referring to FIG. 31, a casting lock is shown ready for incorporation into a panel mould. The casting lock is positioned precisely within the panel mould such that face plate 403A is slightly flush of the edge 403E of the panel mould when viewed in top view. Positioning bolts 403B are of a total length that is equal to the thickness of the panel as represented by bottom edge 403F and top edge 403G when viewed from front view. Positioning bolt caps 403B incorporate conical ends 403D to rest on the panel mould basin such that upon the introduction of hardening material, such as concrete, and the subsequent hardening, the area occupied by each positioning bolt cap 403D is so minor as to produce a practically imperceptible visual footprint.

Figure 32:
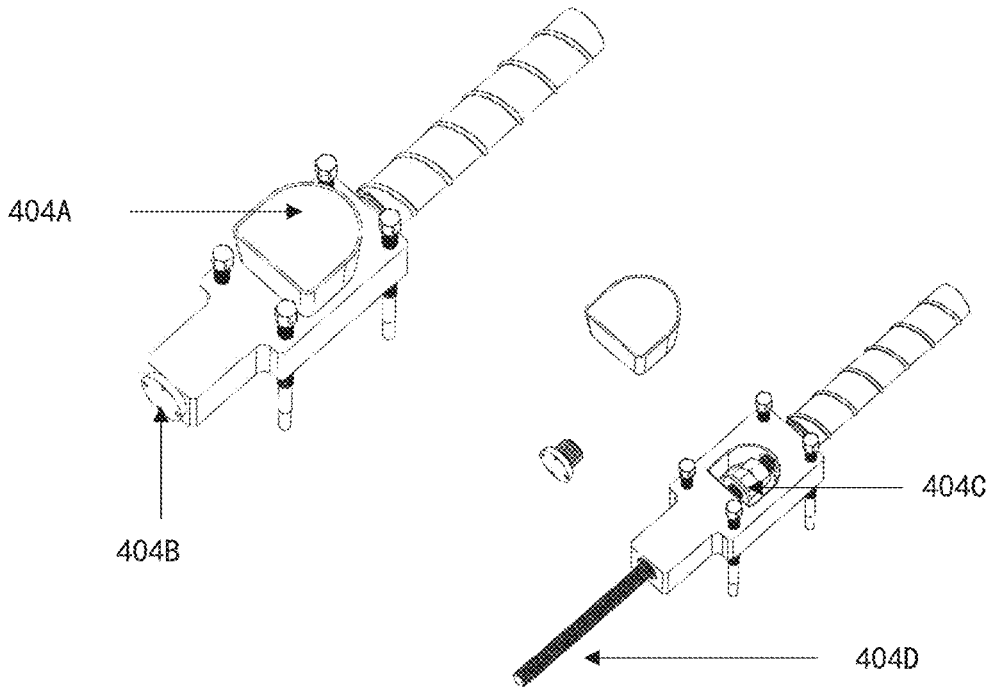
FIG. 32 depicts a casting lock in pre-lock and post-lock configurations to illustrate the means by which the casting lock is employed following moulding of the corresponding precast panel into which it is embedded.

Referring to FIG. 32, a casting lock is shown in pre-mould configuration ready for incorporation into a panel mould as described in FIG. 31. Cavity protector cap 404A is in position to prevent hardening material entering the cavity that provides access to the tightening arrangement. Threaded face plate 404B is threaded in position to prevent intrusion of hardening material into the aperture that provides the avenue by which threaded rod 404D may be wound into position through the exercising of the tightening arrangement 404C, which comprises a spring washer, tightening nut and locking nut as described in FIG. 30.

The post-mould configuration shows the cavity protector cap removed so as to reveal the tightening arrangement 404C. Threaded face plate 404B is also removed to enable threaded rod 404D to be progressively extended into the tunnel of a casting lock embedded in the panel to be joined (not shown) such as to engage with another tightening arrangement.

Following the tightening of the connection between the two casting locks the central body cavity of each casting lock is injected with hardening material so as to complete the immersion of the casting lock within the panel structure.

Figure 33:
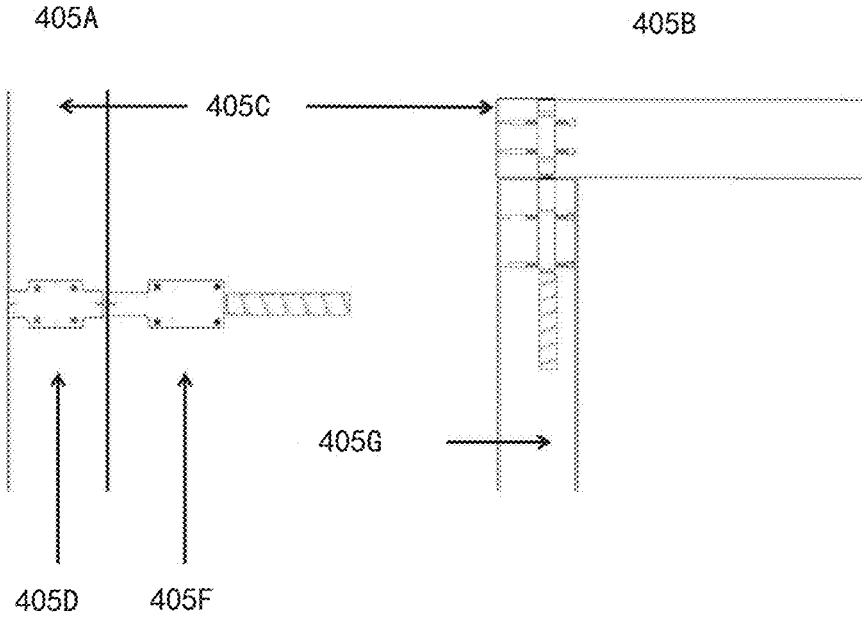
FIG. 33 depicts two precast panels joined at right angles to each other using a corner casting lock.

Referring to FIG. 33, a configuration is shown in which two precast panels, typically in vertical orientation, at right angles to each other relative to the top view, are joined by a combination of a casting lock and a corner casting lock. Side view 405A shows Panel 5C joined at right angles to panel 5G via corner casting lock 405D and middle casting lock 405F. Top view 405B shows such configuration from a different perspective.

Figure 34:
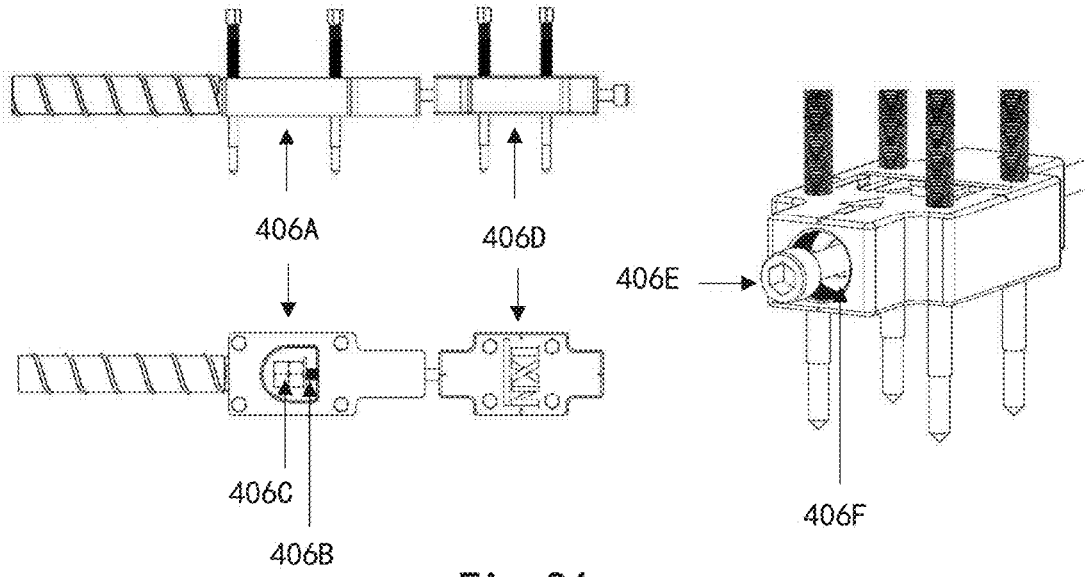
FIG. 34 shows the elements of a corner casting lock and the means by which the threaded rod can exert tension while the head of the threaded rod lies within the body such that it does not protrude.

Referring to FIG. 34, middle casting lock 406A is shown connected to corner casting lock 406D via tension place on threaded rod 406B through tightening nut 406C against the body of middle casting lock 406A. Threaded rod 406B contains hexagonal head 406E, the shoulder of which seats against spring washer 406F when in tension.

We refer now to FIGS. 35 to 40.

Figure 35:
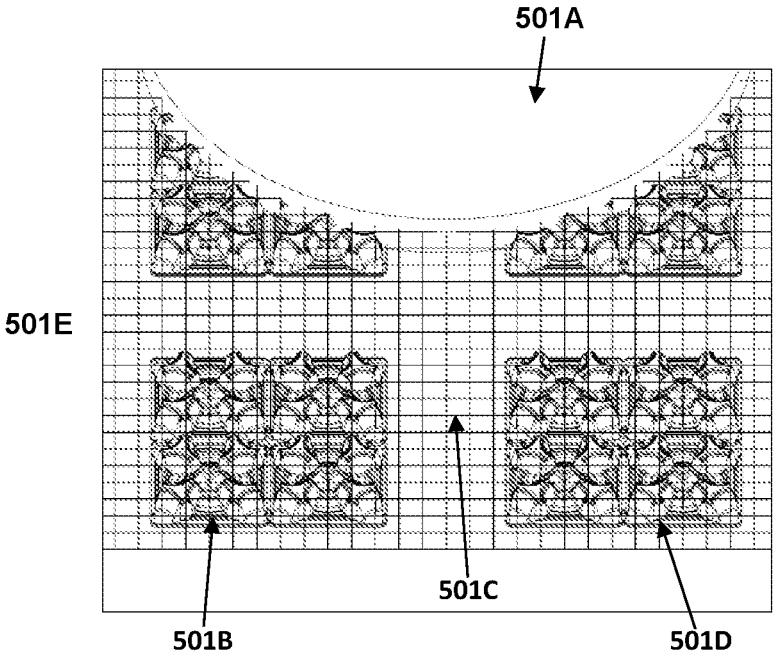
FIG. 35 shows a cut away view of an idealised wafflepod installation.

Referring to FIG. 35, a schematic foundation utilising the triple concave wall wafflepod 501B is shown. Wafflepod segments 501B are placed on synthetic sheeting, preferably plastic, to create a moisture barrier between the underlying soil and the wafflepod sections 501B. Reinforced mesh 501C is placed on spacer chairs 501E such that a separation is achieved between the topmost surface of the wafflepod segments 501B and the reinforced mesh 501C. Wet concrete 501A is introduced into the entire arrangement such that the voids created by the wafflepods 501B are filled with concrete 501A and a layer of concrete 501A covers the mesh to a thickness sufficient to meet the particular specifications of the respective foundation.

Figure 36:
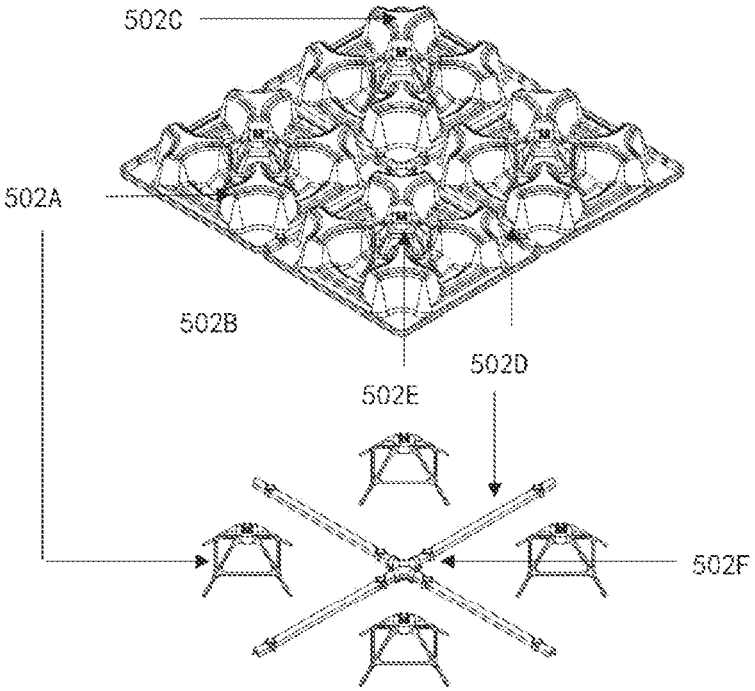
FIG. 36 shows an arrangement of 4 wafflepod segments and a stripped view of connector strips and spacer chairs.

Referring to FIG. 36, a configuration of multiple wafflepod segments 502B is joined by inverted U connector 502D is shown. Preferably, inverted U connectors 502D are joined to each other by inverted quadruple U connector 502F. Preferably, each wafflepod segment 502B includes four tri-concave-wall pods 502C, preferably arranged symmetrically on and integrated with an approximately flat base, which includes a middle pod 502E positioned at its centre. Preferably, the middle pod 502E forms a truncated square pyramid such that its based is parallel with the wafflepod segment base 502B and its top forms a smaller square surface parallel to the base and with its centre aligned with the centre of the base of the central pod 502E. Preferably, the base of middle pod 502E is orientated such that its corners bisect the space between the innermost corners of the tri-concave-wall pods and are extended such that the base of middle pod 502E largely occupies the space between the innermost bottom corners of tri-concave-wall pods 502C, but leaving sufficient room for the legs of spacer chair 502A to be place on the surface of wafflepod segment 502B.

Preferably, the height of tri-concave-wall pod 502C is less than the thickness of the respective foundation such that the difference corresponds to the desired thickness of the contiguous concrete layer covering the mesh as described in FIG. 35. Preferably, the height of middle pod 502E is lower than the height of tri-concave-wall pod 502C such that the top of spacer chair 502A, which sits above the top of middle pod 502E, positions the reinforcing mesh (not shown, refer to FIG. 35) at the desired displacement from the topmost surfaces of tri-concave-wall pods 502C.

Figure 37:
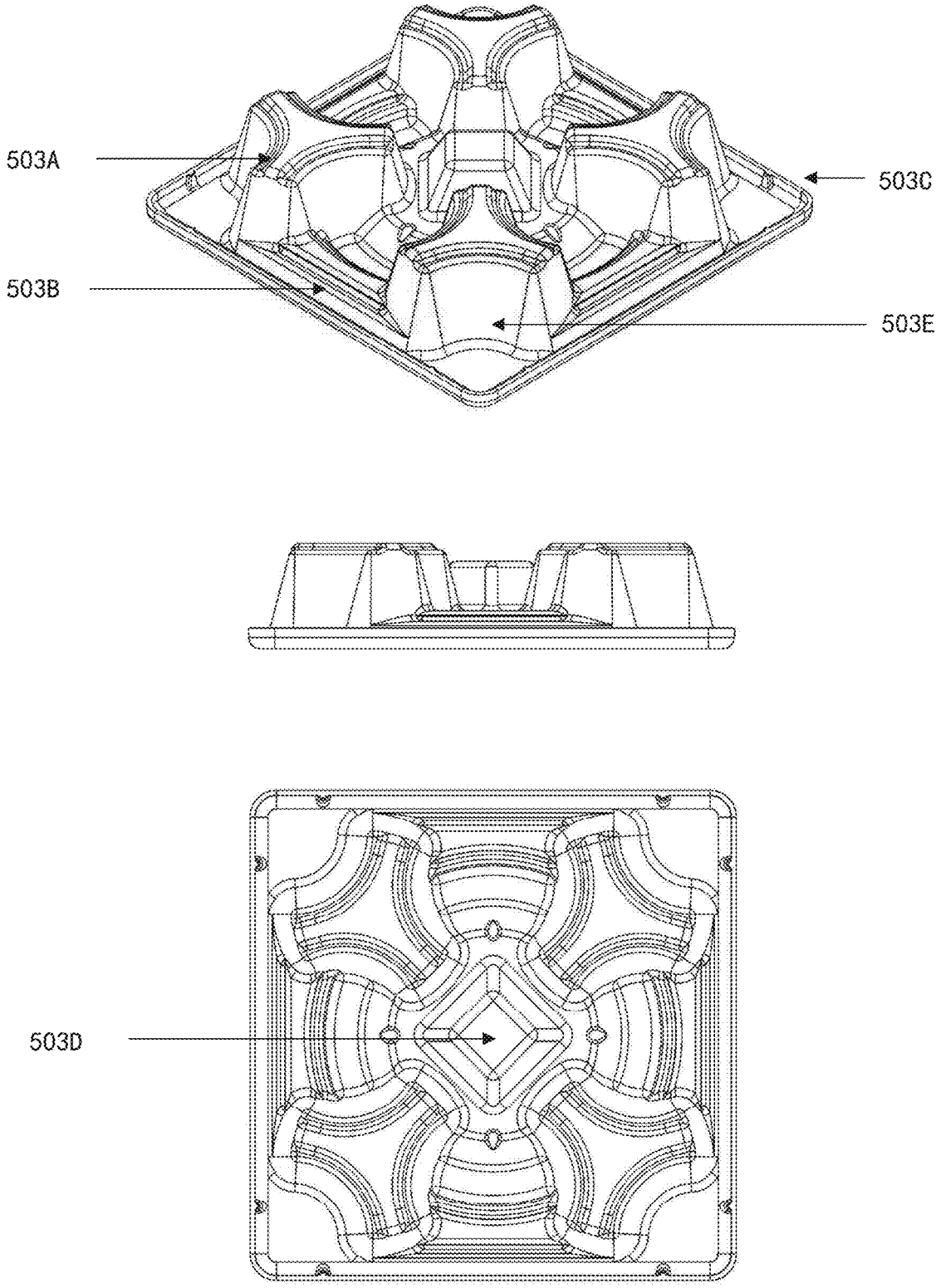
FIG. 37 shows multiple views of a single wafflepod segment.

Referring to FIG. 37, a single complex void wafflepod segment 503B is depicted. Preferably, each wafflepod segment 503B incorporates four tri-concave-wall pods 503A and a middle pod 503D. Preferably, middle pod 503D is placed in the centre of wafflepod segment 503B. Preferably, tri-concave-wall pods 503A (also called "outer pods") are placed symmetrically around middle pod 503D. Preferably, each outer pod 503A emanates from the base of wafflepod segment 503B with its vertical axis approximately perpendicular to the base. Preferably, the height of the topmost surface of outer pod 503A is such that a reinforcing mesh (not shown, see FIG. 36) placed slightly above the topmost surface lies at a height less than the thickness of the respective foundation (not shown, see FIG. 35).

Preferably, each outer pod 503A forms three concave faces 503E orientated outwards from the centre of the outer pod 503A, the vertical axis of which is approximately perpendicular to the base of wafflepod segment 503B. Preferably, the three concave faces 503E of each outer pod 503A are distributed evenly around the centre of each outer pod 503A. Preferably, the size, shape and positioning of the outer pods 503A and middle pod 503D are such that the resultant voids are of sufficient volume and placed such that the concrete structure resulting from the introduction of wet concrete into the wafflepod arrangement possesses the strength necessary to meet the design requirements.

Figure 38:
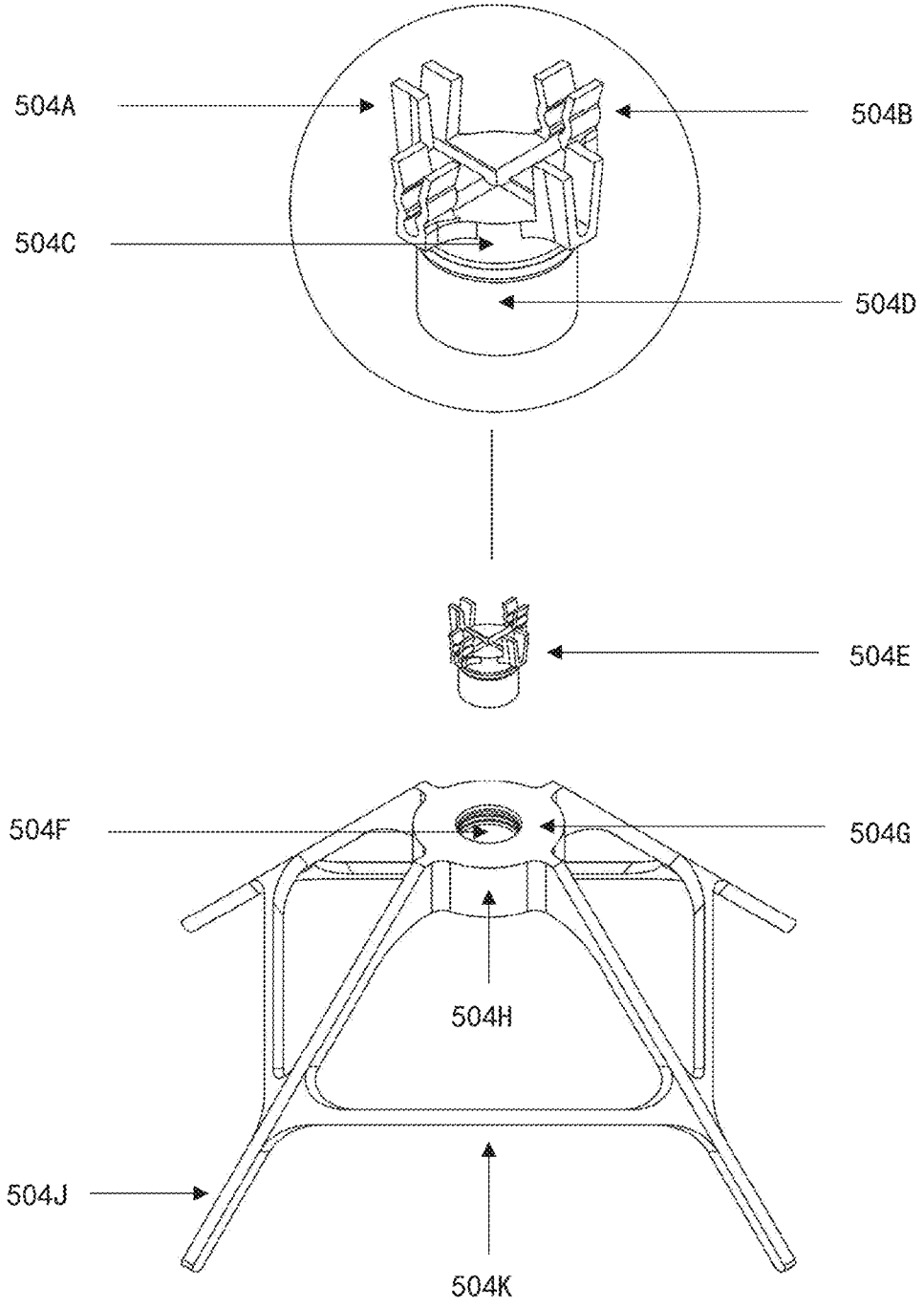
FIG. 38 shows an exploded view of a spacer chair.

Referring to FIG. 38, a spacer chair is shown composed preferably of four legs 504J supported by cross struts 504K between each pair of logs 504J. The legs 504J are attached to or integrated with a seat 504G with a central hole 504G preferably threaded, into which the barrel 504D of support clip 504E fits neatly. A cover plate 504C is attached to or integrated with barrel 504D. Emanating from cover plate 504C are two reinforcing rod clips 504A and two mesh clips 504A. Rod clips 504A are able to accept reinforcing rod and mesh rod (from which the mesh is constructed). Preferably, each pair of clips is positioned such that each clip sits at the outer edge of cover plate 504C diametrically opposite to the other clip of the pair. Preferably, the two pairs of clips 504A and 504B are orientated such that the horizontal axis passing through the centres of each pair are at right angles to the horizontal axis passing through the centres of the remaining pair.

Figure 39:
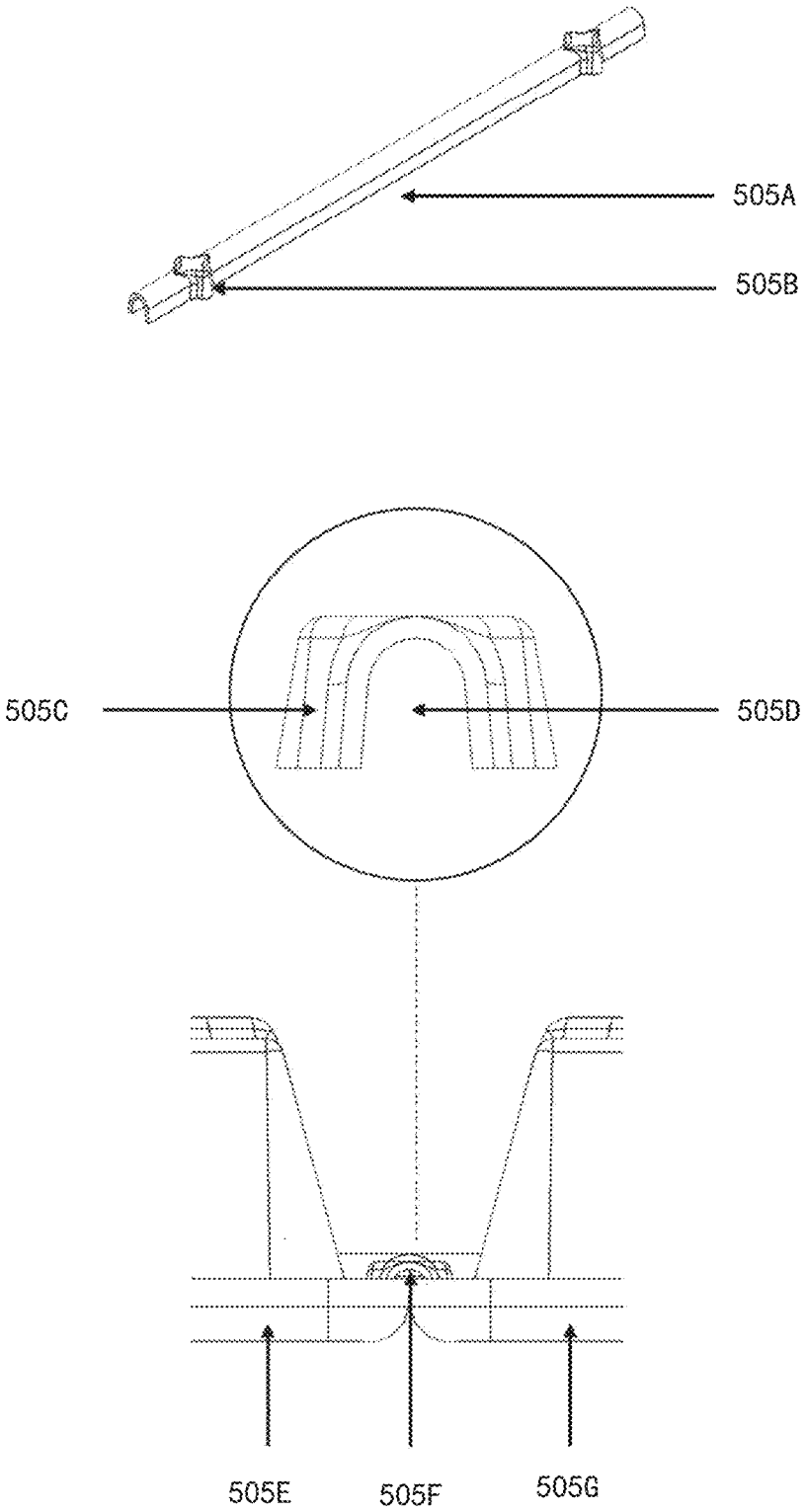
FIG. 39 shows various views of an inverted U connector strip.

Referring to FIG. 39, two wafflepod segments 505E and 505G are shown as joined edge to edge by inverted U connector strip 505F. Inverted U connector strip 505F is comprised of a strip body 505C composed preferably of plastic, which forms an approximate isosceles trapezoid in the cross section. A channel 505D with a cross section preferably approximating a downward facing parabola runs the entire length of connector strip body 505C and 505A. Preferably, two symmetrical flared sections 505B are incorporated into strip body 505A, effectively widening the channel 505D at those positions. These flares 505B correspond to the shape and position of two protrusions (not shown) extending inwards from the outside edges of each wafflepod segment.

Joining of wafflepod segments 505E and 505G involves placing their two edges together, such that the corresponding perpendicular edges are in line, and placing inverted U connector strip 505A and 505F such that the inner edges of strip body 505C engage with the inner walls of the outside edges of wafflepod segments 505E and 505G that are formed by cavities running along the inside perimeter of each wafflepod segment. The inverted U connector is positioned such that symmetrical flares 505B engage with the corresponding protrusions in the edges of the wafflepod segments. In this fashion, wafflepod segments 505E and 505G are fixed such that they cannot move relative to each other along the longitudinal axis of the joined edges and cannot be separated from each other.

Figure 40:
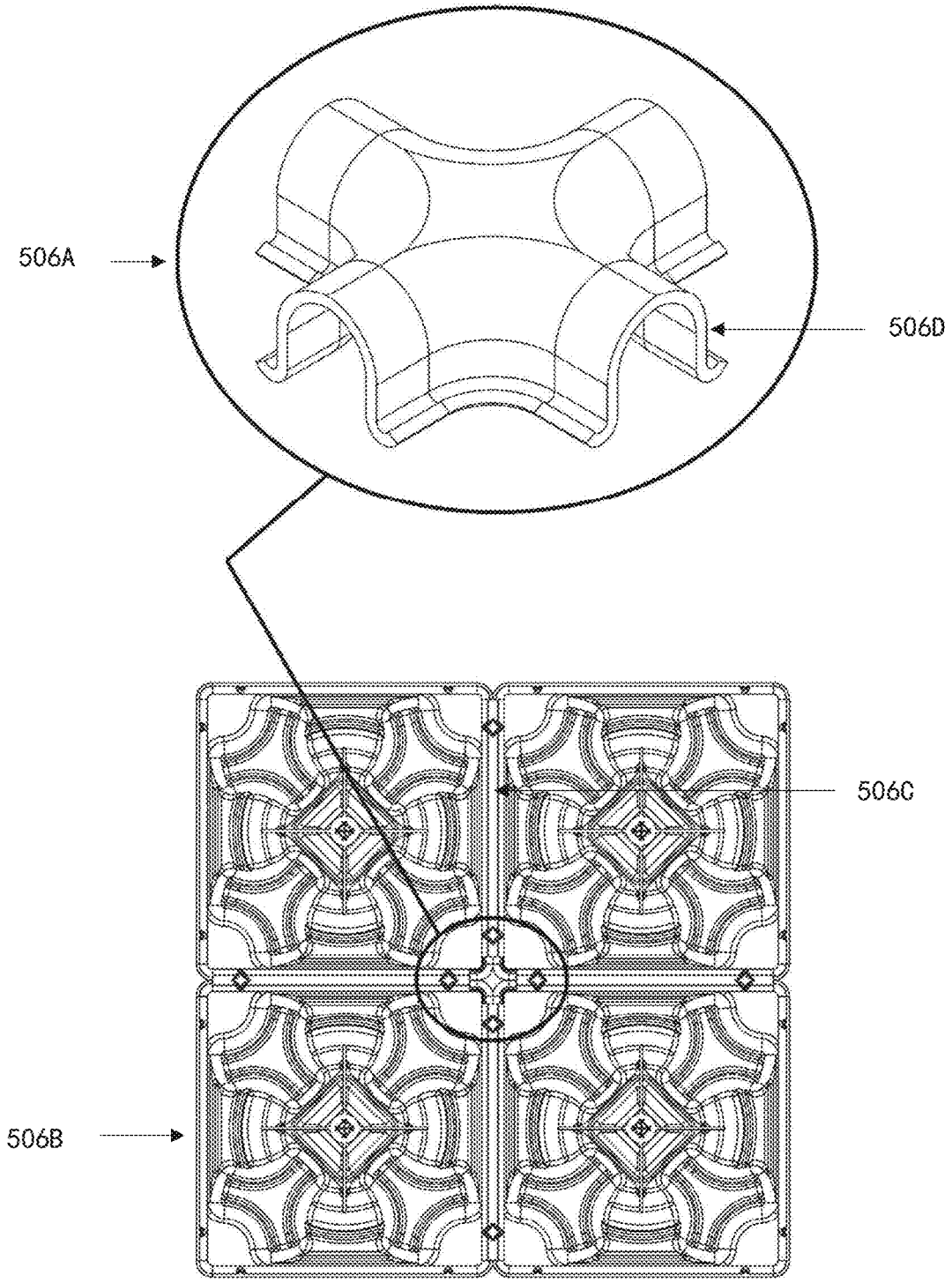
FIG. 40 shows a view of a quadruple inverted U connector and its employment in the joining of multiple wafflepod segments.

Referring to FIG. 40, a configuration of wafflepod segments 506B is shown whereby wafflepod segments 506B are joined to each other via inverted U connectors 506C. Quadruple inverted U connector 506A is shown, whereby four wafflepod segments are joined at their common intersection by placing an inverted U arm 506D over the edge lips of each pair of adjoining wafflepod segments 506B.

Figure 41:
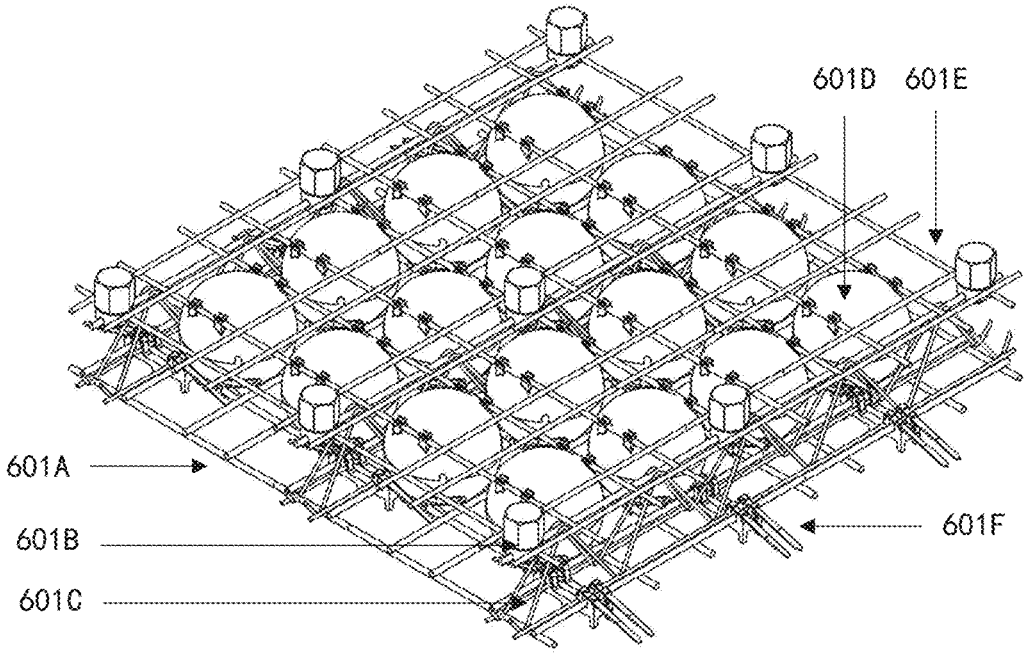
FIG. 41 shows the general layout of the components comprising the structural body relative to each other.

Referring to FIG. 41, a series of hollow spheroids 601D are shown positioned between a bottom steel reinforcing mesh 601A and a top steel reinforcing mesh 601E. The bottom reinforcing mesh 601A and the top reinforcing mesh 601E are held in a fixed position in relation to each other and to a series of trusses 601C via a combination of bottom connector chairs 601F and top connectors 601B. The bottom connector chairs 601F elevate the overall assembly relative to the ground. The hollow spheroids 601D are fixed relative to the bottom reinforcing mesh 601A and the top reinforcing mesh 601E via an arrangement of clips. The overall assembly is thus an integrated unit that can be transported and installed as a single entity.

Figure 42:
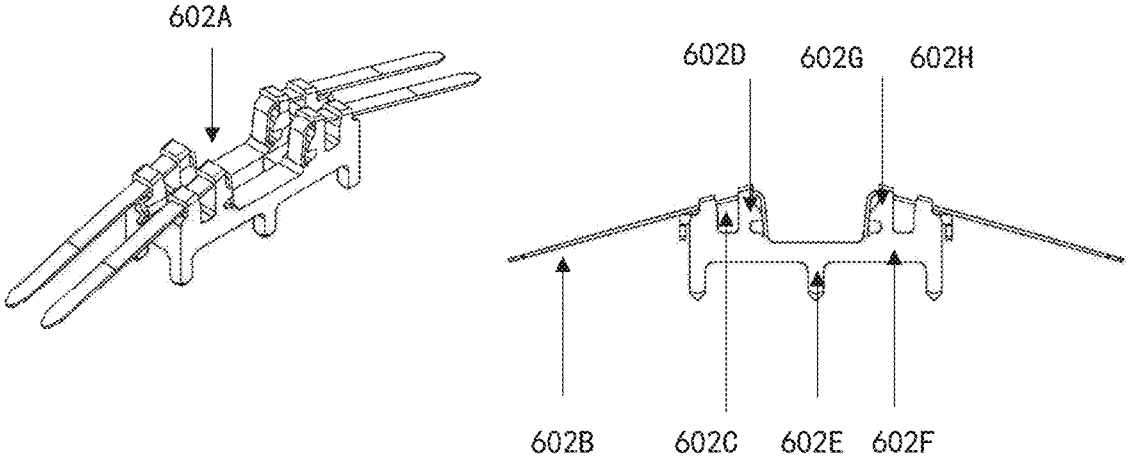
FIG. 42 shows the design of the bottom locator chair.

Referring to FIG. 42, a bottom connecting chair 602A is shown. The body 602F of the bottom connecting chair 602A is constructed of a high strength plastic and includes a set of integrated legs 602E to elevate any mesh attached to it off the surface on which the current invention is applied. An aperture 602C is provided in order to accept insertion of an element of mesh such that the mesh is fixed in the lateral dimension relative to the bottom connecting chair 602A. An aperture 602D is provided in order to accept insertion of an element of a steel truss such that the truss is fixed in the lateral dimension relative to the bottom connecting chair 602A. A plastic strap 602B is fixed at one end to the body 602F of the bottom connecting chair 602A and is passed through a slit in an inner protrusion 602G and a slit in an outer protrusion 602H such that the mesh engaged with aperture 602C and the truss engaged with aperture 602D are both held fixed relative to the bottom connecting chair 602A in the vertical dimension. The protrusions 602G and 602H are part of the moulded body 602F.

Figure 43:
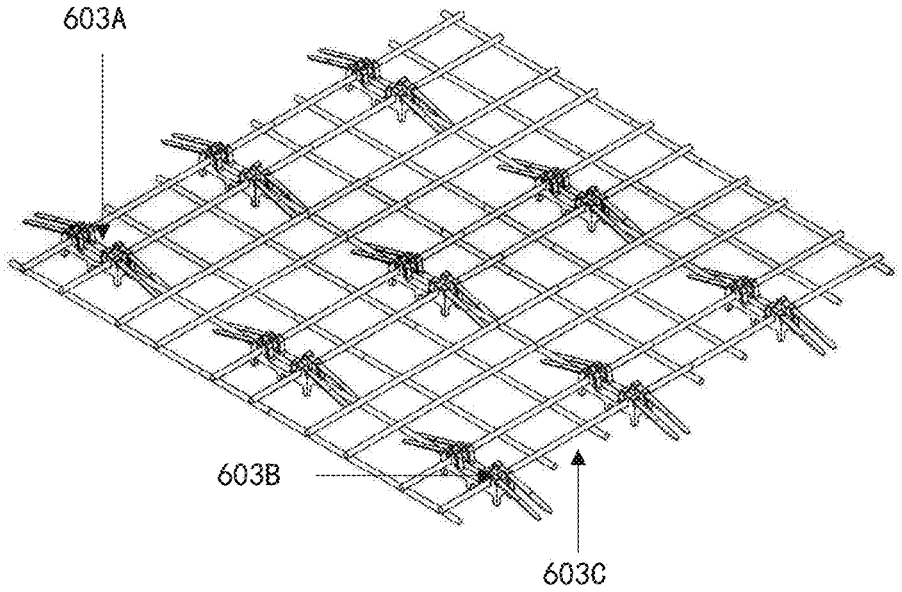
FIG. 43 shows a bottom reinforcing mesh seated in a series of bottom locator chairs.

Referring to FIG. 43, a bottom reinforcing mesh 603C is shown connected to a series of bottom connecting chairs 603A via engagement with integrated apertures 603B in bottom connecting chairs 603A. In this manner, bottom reinforcing mesh 603C is elevated relative to the respective surface on which the invention is being applied.

Figure 44:
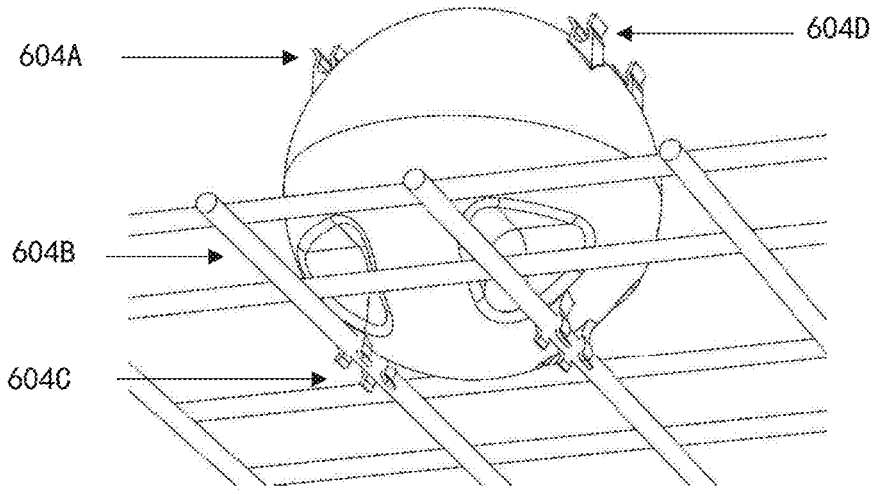
FIG. 44 shows a hollow spheroid and its method of attachment to a bottom reinforcing mesh.

Referring to FIG. 44, a hollow spheroid 604A is affixed to bottom reinforcing mesh 604B via clips 604C that are integrated into the hollow spheroid 604A. Clips 604D are shown ready to be engaged with a top reinforcing mesh.

Figure 45:
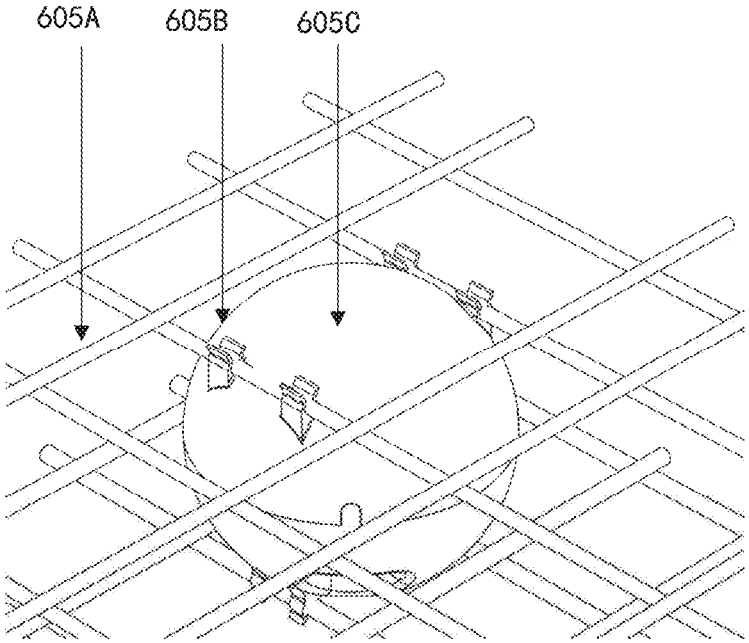
FIG. 45 shows a hollow spheroid and its method of attachment to a top reinforcing mesh.

Referring to FIG. 45, a hollow spheroid 605C is shown fixed to top reinforcing mesh 605A via clips 605B, which are integrated into the structure of hollow spheroid 605C.

Figure 46:
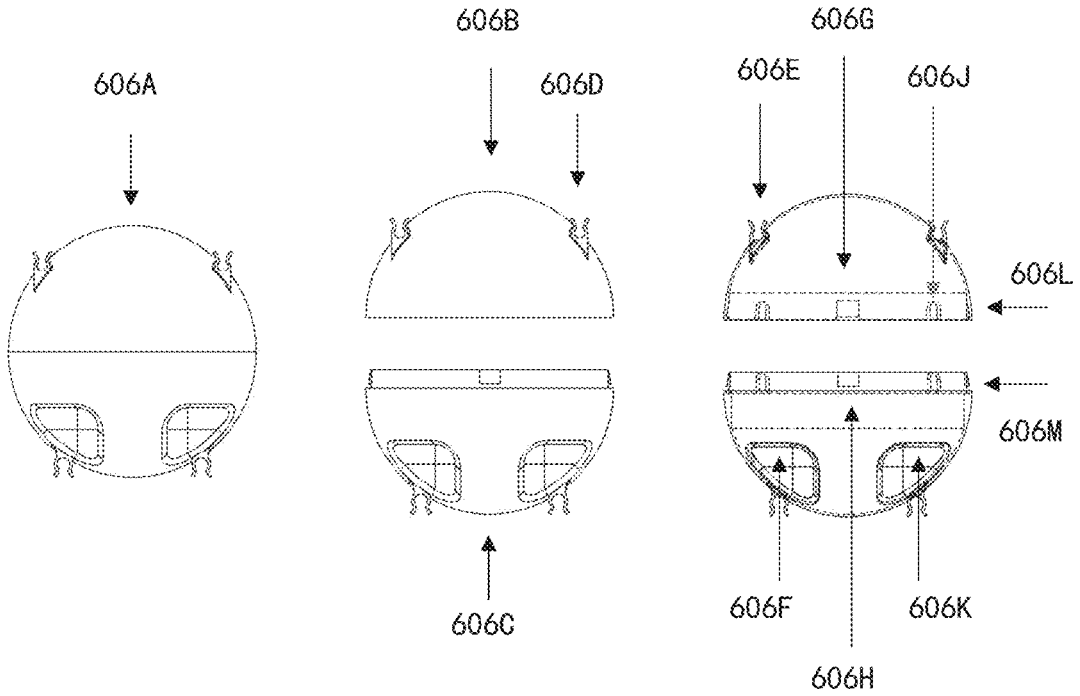
FIG. 46 shows the design and structure of a hollow spheroid.

Referring to FIG. 46, the structure of a hollow spheroid 606A is shown to consist of a top segment 606B and a bottom segment 606C. The two are combined to form a hollow spheroid by means of sliding top segment 606B over an indented lip 606D protruding from and being part of bottom segment 606C and being a close fit with the maximum inside diameter of top segment 606B, thus ensuring that that the two segments are fixed laterally in relation to each other.

The upper partial spheroid 606B contains two or more indentations in the inner surface, each of which forms an inverted wedge on its cross section with the deeper end of the wedge closest to the surface of dissection but not coincident with it. The lower partial spheroid contains protrusions corresponding in number, location and cross section to the wedge indentations in the upper segment. The cross section of the lower protrusion is a reverse reflection of the cross section of the upper wedge such that when the two segments are joined the wedge indentation engages tightly with the wedge protrusion. The wedge indentation presents a face at its thickest end as does the wedge protrusion. Upon engagement, the faces of the two wedge elements coincide with one another and fix the two segments firmly in relation to the direction of separation. By this means the two segments resist being pulled apart.

The indented lip in the lower partial spheroid 606C presents a face 606D concentric to the circle formed at the dissection. This face contains one or more protrusions 606H, the thickness of each being such that the outer face of the protrusion is flush with the surface of the partial spheroid. The outer face of the protrusion is preferably approximately rectangular but can be any desired shape within the constraints of engineering and manufacturing. Upper partial spheroid 606B contains one or more slots 606G with their open face at the dissection. The slots 606G are located and shaped so as to coincide precisely with the protrusions 606H when the two partial spheroids 606B & 606C are joined together to form a complete spheroid. By this means the two partial spheroids are fixed relative to each other in relation to rotational displacement.

Incorporated into the surface profile of lower partial spheroid 606C are a series of cavities, preferably four in number. Upon hardening of material, such as concrete, following its introduction into the structural body being the subject of the current invention, the lower partial spheroid is fixed to the hardened material. By this means the lower partial spheroid, and therefore the entire spheroid by way of both partial spheroids being firmly fixed relative to each other, is fixed relative to the hardened material along the horizontal dimension in all directions.

Figure 47:
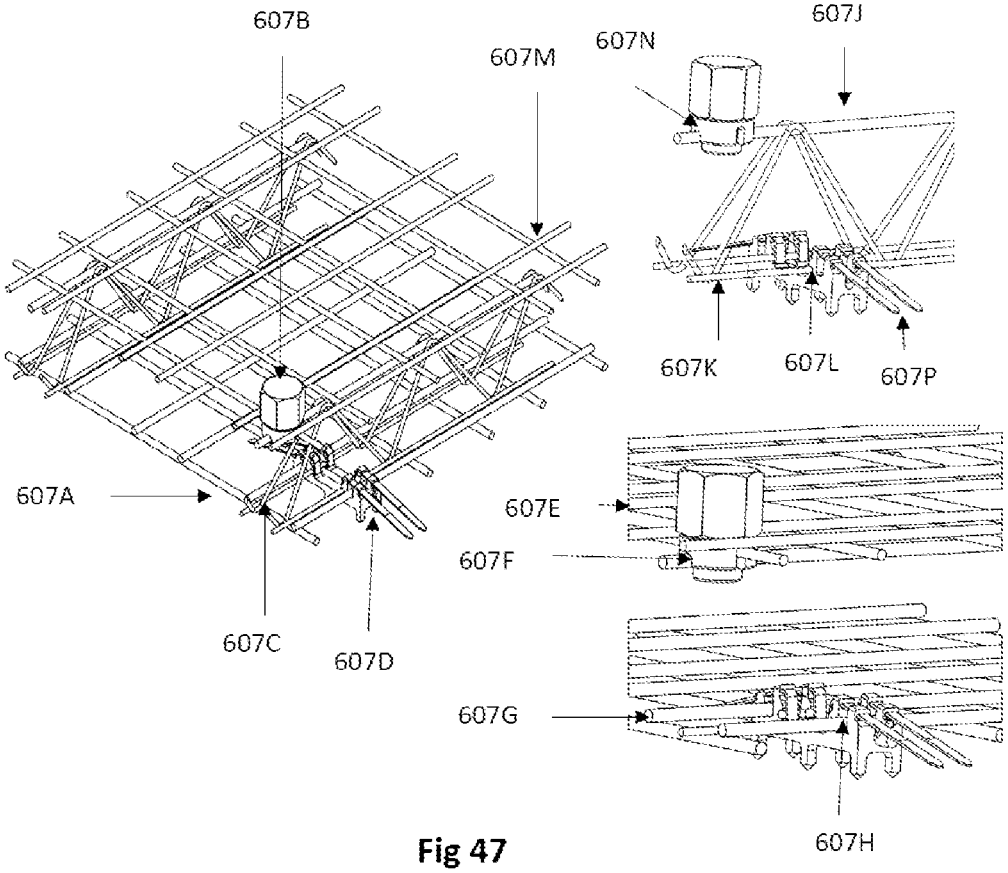
FIG. 47 shows the method by which top and bottom reinforcing meshes are positioned relative to each other and to a truss arrangement by means of connection via top locators and bottom locator chairs.

Referring to FIG. 47, a bottom reinforcing mesh 607A is fixed relative to a top reinforcing mesh 607M via the engagement of both top and bottom reinforcing meshes 607A & 607C with truss assembly 607C. The truss assembly 607C is connected to the top reinforcing mesh 607M via top locator nut 607B and is connected to the bottom reinforcing mesh 607A via bottom joiner chair 60607D.

Figure 48:
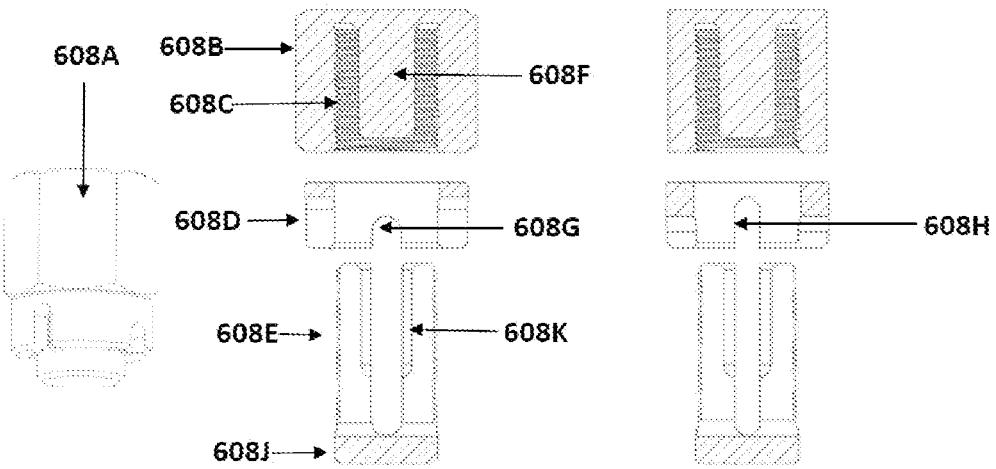
FIG. 48 shows the structure and design of a top locator.

The truss assembly 607C is held in position relative to top mesh by means of top rod 607J passing through an aperture 607N in top locator 607B and subjected to a compressive force relative to top locator 607B via a tightening mechanism described in FIG. 48. The truss assembly 607C is held in position relative to the bottom mesh 607A by means of bottom rods 607K passing through corresponding apertures 607L and held in place by straps 607P.

Top mesh 607M is held in position relative to top locator 607B via a rod 60607E of top mesh 607M passing through an aperture 607F in top locator 607B and subjected to a compressive force relative to top locator 607B via a tightening mechanism described in FIG. 48.

Bottom mesh 607A is held in position relative to bottom locator chair 60607D via rods 607G passing through corresponding apertures 607H in bottom locator chair 60607D and being held in place by straps 607P.

By the combination of connections so described, a structure is obtained whereby the top and bottom meshes 607A & 607M are held in a fixed position relative to one another and given vertical strength by means of being commonly joined by the top and bottom locators 607B & 60607D respectively.

Referring to FIG. 48, the structure of top locator 608A is shown. A top locator nut 608B incorporates a hollow threaded cylinder 608C and a solid unthreaded stem 608F of a diameter less than threaded cylinder 608C emanating from the inside face of threaded cylinder 608C and terminating short of the lower face of top locator nut 608B.

An intermediate locator disk 608D incorporates a hollow centre with a diameter sufficient to allow unthreaded stem 608F to pass through and contains two pairs of notches 608G and 608H with openings at the face furthest removed from top locator nut 608B when assembled in the correct manner. One pair of notches 608G are positioned such that a line drawn through the centres would pass through the centre of the circle formed by the hollow interior of intermediate locator disk 608D. The size and shape of apertures 608G are designed to coincide precisely with the diameter of the top rod of the truss assembly as described in FIG. 47. The size and shape of apertures 608H are designed to fit over both the top rod of the truss assembly and a rod of the top reinforcing mesh as described in FIG. 47.

The top locator threaded stem 608E incorporates a solid base 608J from which four threaded bars 608K emanate. The bars are curved across their width such that were there to be no spaces between the bars they would form a threaded cylindrical stem. The threaded bars 608K are arranged such that two apertures are formed at right angles to each other, each running through the centre of the circle formed by the inner surface of solid base 608J and each extending to an open face at the opposite end of the solid base 608J. The apertures are of a size and shape to produce a snug fit with the rods of the top reinforcing mesh and the top rod of the truss assembly as explained in FIG. 47 when placed over them.

Thus, the method for connecting the top reinforcing mesh to the truss assembly such that the two elements are fixed strongly relative to each other involves sliding the threaded stem 608E over an arrangement of reinforcing mesh and truss assembly as described in FIG. 47. The intermediate top locator disk 608D is then placed over the threaded stem 608E such that the apertures 608G & 608H mate with the respective rods of the reinforcing mesh and truss assembly. Top locator nut 608B is then threaded onto threaded stem 608E until unthreaded stem 608F places the desired compressive force on the respective rods.

We refer now to FIGS. 49 to 53.

Figure 49:
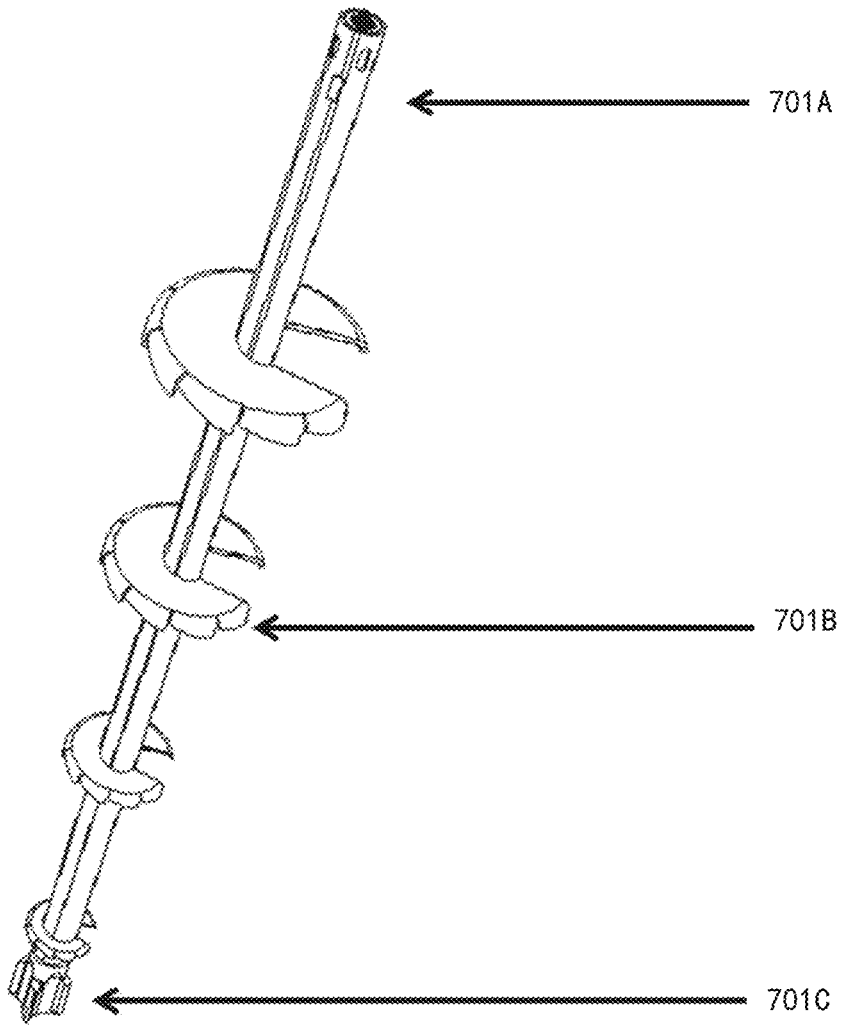
FIG. 49 depicts an entire helical screw pile assembly.

Referring to FIG. 49, a complete blade pile is shown with blade bit 701C attached to shaft 701A. A series of helical bearing plates 701B are firmly fixed to shaft 701A.

Figure 50:
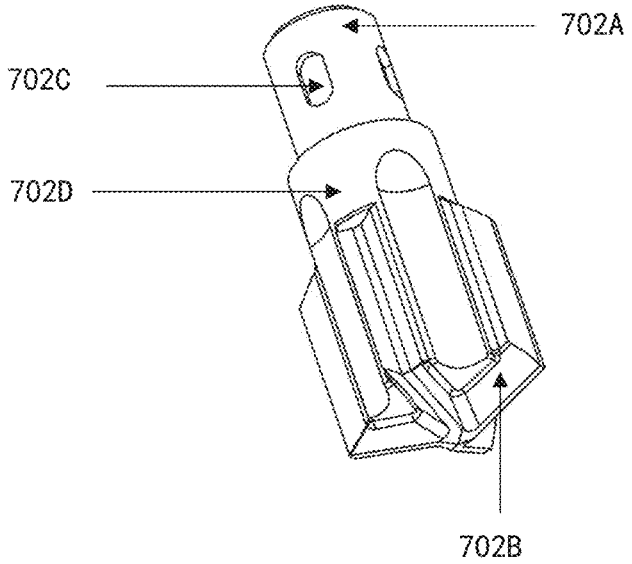
FIG. 50 depicts a blade bit.
Figure 50:
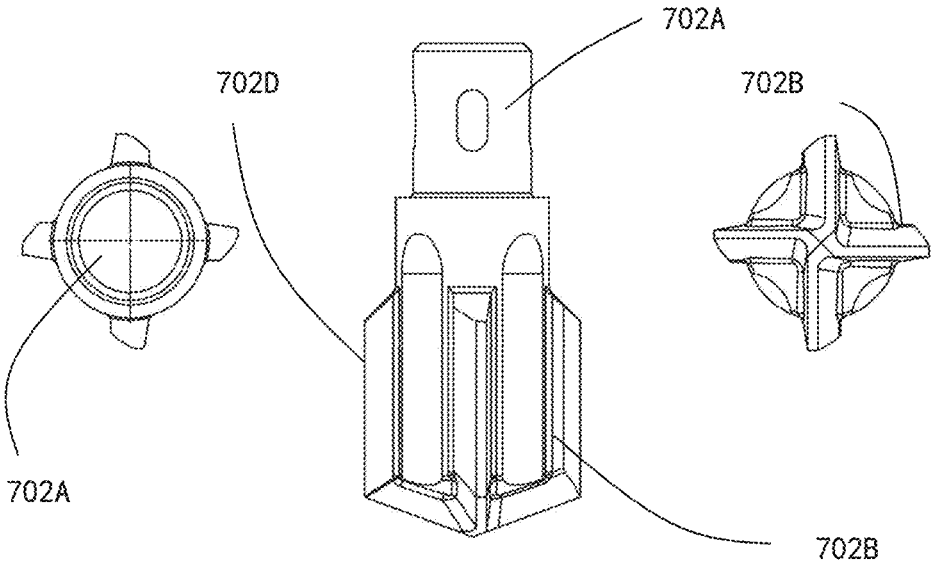

Referring to FIG. 50, a blade bit is shown composed of bit shaft 702A, bit body 702D and blades 702B. Bit shaft 702A incorporates slots 2C to create contact lines with the shaft (not shown) that can be welded to strengthen the connection between the shaft and the blade bit. Preferably, blades 702B are fixed to bit body 702D by welding. Preferably, blades 702B are produced with one side shorter than the other and sloping out from the outer edge to create a leading edge in order to enhance the penetration ability for a given torque.

Figure 51:
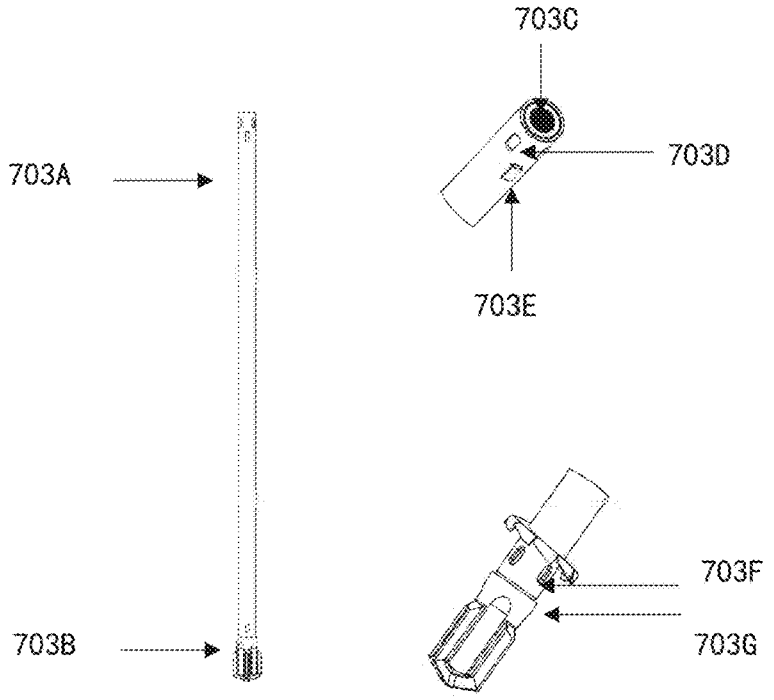
FIG. 51 depicts a shaft joined to a blade bit.

Referring to FIG. 51, shaft 703A is shown connected to blade bit 703B. Preferably, a threaded bush 703C is welded to top of shaft 703A to provide a means of threading a segment of shaft so as to extend the length of shaft 703A. Shaft 703A incorporates slots 703D to create contact lines for welding threaded bush 703C to shaft 703A added strength beyond that provided by welding the outer circumference of threaded bush 703C to the inner circumference of shaft 703A. Shaft 703A incorporates rectangular protrusions 703E to provide a means by which torque can be applied to shaft 703A by means of an appropriate machine.

Blade bit 703B incorporates slots 703F to provide contact lines between bit 703B and shaft 703A that can be welded to add further strength to the weld 703G connecting the inner circumference of blade bit 703B and the outer circumference of shaft 703A.

Figure 52:
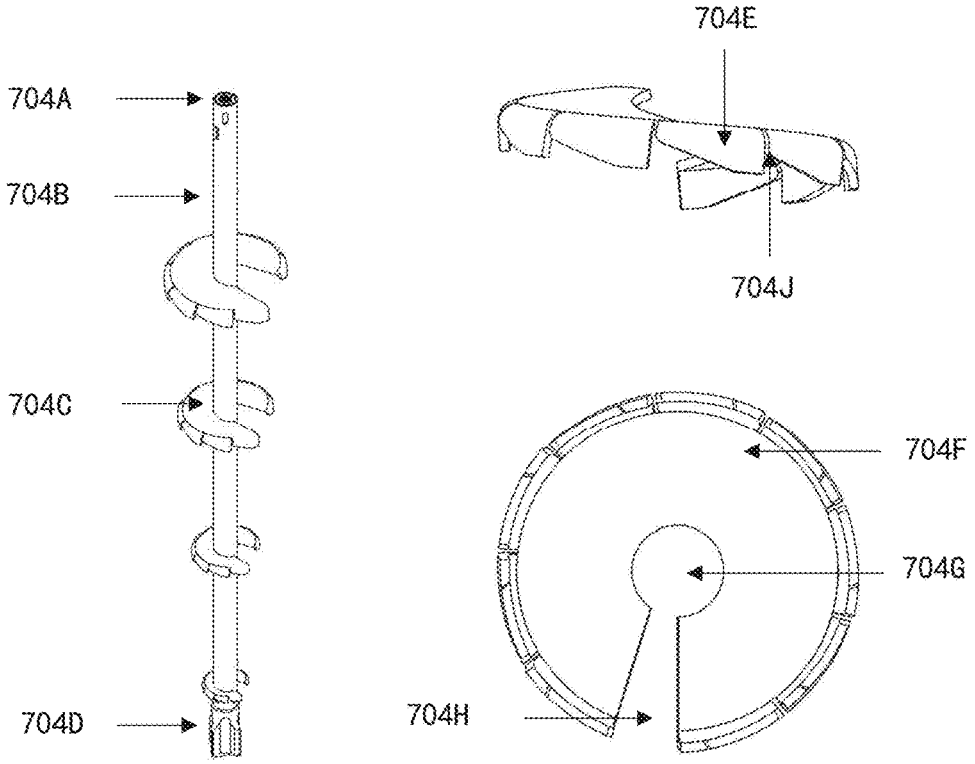
FIG. 52 depicts a helical bearing plate and its manner of incorporation with the shaft.

Referring to FIG. 52, a complete blade pile is shown, with shaft 704B attached to blade bit 704D and incorporating threaded bush 704A. Helical bearing plates 704C are welded firmly to shaft 704B and arranged so as to form an outside diameter progressively larger in proportion to the distance of the helical bearing plate 704C from blade bit 704D.

Helical bearing plate 704C is composed of helical base plate 704F, which incorporates central hole 704G with a diameter equal to the outside diameter of shaft 704B. Split 704H is the result of helical base plate 704F being evenly deformed perpendicular to its width such that a wide helical strip 704F is created around hole 704G. Helical bearing plate blades 704E are attached to the outer circumference of helical base plate 704F perpendicular to the base plate 704F and in series. Blade 704E is shaped in such a manner that the large edge 704J of the blade 704E contacts the soil prior to the small edge of the blade 704E when the helical bearing plate is rotated clockwise (from the top perspective). In this manner, the larger edge of each blade is able to make direct contact with the soil.

Referring to FIG. 53, a screw pile cap is depicted, which is circular in shape from the top view, but shows a wider diameter at the bottom than the top when viewed from the side. Preferably, a series of indentations 705B are imposed in the outer surface of the cap, so as to facilitate an integration of the cap with the surrounding soil. A closed cylinder 705C protrudes from the top centre of the cap, separated from outer body 705D so as to form a void 705A. The diameter of cylinder 705C at its bottom where it intersects with the horizontal face of body 705D is smaller than the diameter at its top. Similarly, the diameter of the circular void 705A at its bottom is larger than its diameter at the top. The result is that any material, whether it be soil or concrete, filling void 705A will resist the vertical dislocation of the cap relative to it.

The body 705D of the cap is hollow, with a closed face offset from the top and an open face presenting at the bottom. A hollow cylinder 5F protrudes from the closed face, sharing the same vertical axis and terminating slightly lower than the bottom of body 705D. Said cylinder incorporates two keyways 5G in order to couple firmly with the top of the blade pile, which contains rectangular protrusions of a matching shape. A regular series of walls connect the outside of said hollow cylinder to the inside surface of the larger cylinder formed by the hollow body such that a series of cavities are formed between the inside and outside cylinders. The said arrangement of cavities, each offering an open face in the downward orientation, enhances the integration of the cap with the host soil.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A precast transportable construction body for a building system, the precast transportable construction body comprising:

a first reinforcing mesh and a second reinforcing mesh defining a steel framework, each reinforcing mesh being substantially flat;

a plurality of substantially spheroidal bodies sandwiched between the first reinforcing mesh and the second reinforcing mesh;

each of the plurality of bodies comprising a plurality of protrusions, and each protrusion being configured to fasten to at least one of the first reinforcing mesh and the second reinforcing mesh such that the plurality of bodies are fixed to and directly connect the first reinforcing mesh and the second reinforcing mesh;

a plurality of bottom connector chairs attached to the second reinforcing mesh, each bottom connector chair comprising first and second apertures to allow insertion of substantially parallel rods of the second reinforcing mesh, each bottom connector chair being attached to the second reinforcing mesh by inserting at least the substantially parallel rods of the second reinforcing mesh into the first and second apertures;

a plurality of trusses to support the connection between the first reinforcing mesh and the second reinforcing mesh in a spaced apart relationship with respect to each other, each truss comprising an upper rod and two lower rods joined together by a pair of zig-zag shaped rods, the zig-zag shaped rods being joined together at the upper rod and each zig-zag shaped rod attached to a lower rod defining a triangular cross section of the truss, with the bottom connector chairs arranged to secure the two lower rods of the trusses to the second reinforcing mesh; and a hardened material;

wherein the plurality of substantially spheroidal bodies are arranged and positioned between the first reinforcing mesh and the second reinforcing mesh such that the steel framework formed by the first and second reinforcing meshes substantially determines boundaries of the precast transportable construction body; and wherein the plurality of substantially spheroidal bodies are arranged such that spaces are defined around and between each of the plurality of substantially spheroidal bodies that define a regular series of internal pillars of the hardened material that provide the precast transportable construction body with load bearing capability.

2. A precast transportable construction body according to claim 1 wherein the bottom connector chairs comprise legs for defining a space between the second reinforcing mesh and a face of the precast transportable construction body.

3. A precast transportable construction body according to claim 1 wherein the plurality of protrusions comprises pairs of opposing protrusions protruding from each body defining channels for receiving a section of the first reinforcing mesh and the second reinforcing mesh.

4. A precast transportable construction body according to claim 1 wherein the plurality of bodies comprise hollow bodies.

5. A precast transportable construction body according to claim 1 wherein the plurality of bodies comprise two sections releasably attached to each other.

6. A precast transportable construction body according to claim 1 wherein the plurality of bodies comprise insulating material.

7. A precast transportable construction body according to claim 1 wherein the plurality of substantially spheroidal bodies are spherical.

8. A precast transportable construction body according to claim 1, wherein each bottom connector chair comprises a recess configured to receive a rod of the second reinforcing mesh that is substantially perpendicular to the substantially parallel rods of the second reinforcing mesh.

* * * * *